US011088438B2

(12) United States Patent
Park et al.

(10) Patent No.: US 11,088,438 B2
(45) Date of Patent: Aug. 10, 2021

(54) ANTENNA USING SLOT AND ELECTRONIC DEVICE INCLUDING THE SAME

(71) Applicant: Samsung Electronics Co., Ltd., Suwon-si (KR)

(72) Inventors: Seongjin Park, Suwon-si (KR); Dongyeon Kim, Suwon-si (KR); Sehyun Park, Suwon-si (KR); Sumin Yun, Suwon-si (KR); Woomin Jang, Suwon-si (KR); Myunghun Jeong, Suwon-si (KR); Jehun Jong, Suwon-si (KR); Jinwoo Jung, Suwon-si (KR); Jaehoon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 79 days.

(21) Appl. No.: 16/676,824

(22) Filed: Nov. 7, 2019

(65) Prior Publication Data

US 2020/0153086 A1 May 14, 2020

(30) Foreign Application Priority Data

Nov. 14, 2018 (KR) ..... 10-2018-0139558

(51) Int. Cl.
*H01Q 1/24* (2006.01)
*H01Q 13/16* (2006.01)
(Continued)

(52) U.S. Cl.
CPC ..... *H01Q 1/243* (2013.01); *H01Q 13/16* (2013.01); *H01Q 21/064* (2013.01); *H01Q 21/30* (2013.01)

(58) Field of Classification Search
CPC .... H01Q 21/064; H01Q 21/29; H01Q 21/293; H01Q 13/10; H01Q 13/16; H01Q 1/22;
(Continued)

(56) References Cited

U.S. PATENT DOCUMENTS 9,793,607 B2 10/2017 Mcgough et al.
10,903,566 B2 1/2021 Di Nallo et al.
(Continued)

FOREIGN PATENT DOCUMENTS

JP 2012-205171 A 10/2012
KR 10-2010-0018371 A 2/2010
(Continued)

OTHER PUBLICATIONS

International Search Report dated Feb. 20, 2020, issued in International Patent Application No. PCT/KR2019/015043.

*Primary Examiner* — Jason Crawford
(74) *Attorney, Agent, or Firm* — Jefferson IP Law, LLP

(57) ABSTRACT

An electronic device is provided. The electronic device includes a housing including a first plate, a second plate directed in an opposite direction to the first plate, and a side member surrounding a space between the first plate and the second plate and being combined with or being integrally formed with the second plate, a display configured to be seen through at least a part of the first plate, an antenna structure arranged inside the housing, the antenna structure including a first conductive layer including a first region including a first U-shaped slot and a second region coming in contact with the first region, and a second conductive layer facing the first conductive layer to be spaced apart from the first conductive layer, and including a third region including a second U-shaped slot facing the first U-shaped slot and a fourth region coming in contact with the third region and facing the second region, and at least one wireless communication circuitry electrically connected to the first conductive layer or the second conductive layer and configured to transmit and/or receive a signal having a frequency in a range of 3 GHz to 100 GHz. Other various embodiments are possible.

20 Claims, 51 Drawing Sheets

(51) Int. Cl.
*H01Q 21/30* (2006.01)
*H01Q 21/06* (2006.01)

(58) Field of Classification Search
CPC ..... H01Q 1/2283; H01Q 1/2291; H01Q 1/241–1/243
See application file for complete search history.

(56) References Cited

U.S. PATENT DOCUMENTS

| | | | | |
|---|---|---|---|---|
| 2012/0176292 | A1* | 7/2012 | Hung | H01Q 1/243 343/846 |
| 2013/0257659 | A1* | 10/2013 | Darnell | H05K 1/181 343/702 |
| 2013/0342411 | A1* | 12/2013 | Jung | H01Q 5/307 343/767 |
| 2014/0218244 | A1* | 8/2014 | Chang | H01Q 1/243 343/702 |
| 2016/0164186 | A1 | 6/2016 | Ganchrow et al. | |
| 2016/0336654 | A1 | 11/2016 | Aoki et al. | |
| 2017/0250460 | A1* | 8/2017 | Shin | H04M 1/0266 |
| 2018/0034134 | A1 | 2/2018 | Dalmia | |
| 2018/0269561 | A1* | 9/2018 | Kim | H01Q 1/085 |
| 2019/0097317 | A1* | 3/2019 | Di Nallo | H01Q 13/16 |

FOREIGN PATENT DOCUMENTS

| | | | |
|---|---|---|---|
| KR | 10-2010-0108097 | A | 10/2010 |
| KR | 10-2018-0105356 | A | 9/2018 |

* cited by examiner

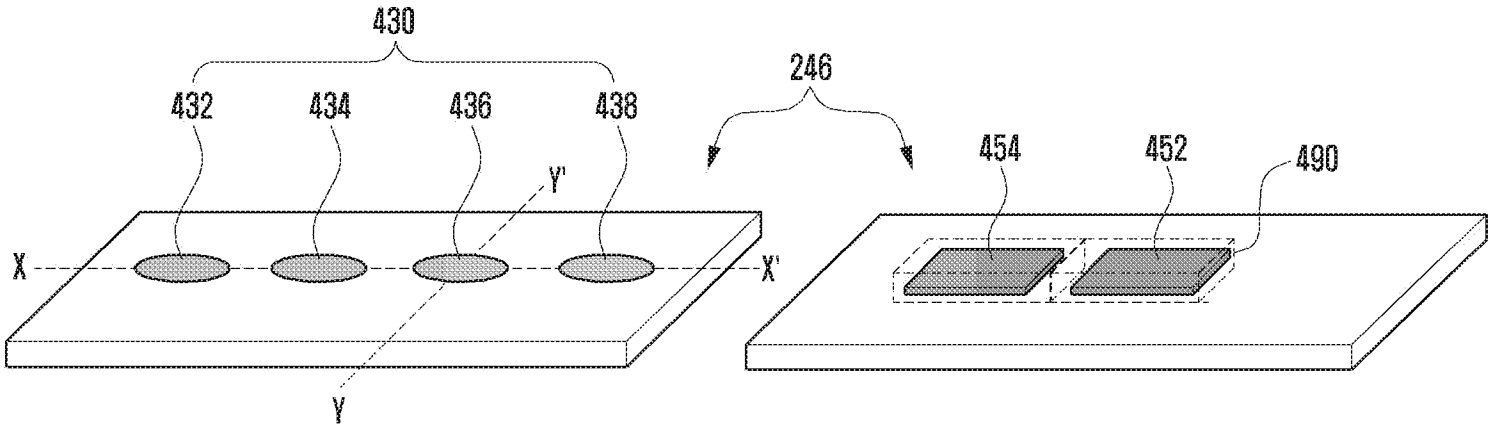
FIG. 4AB
FIG. 4AA
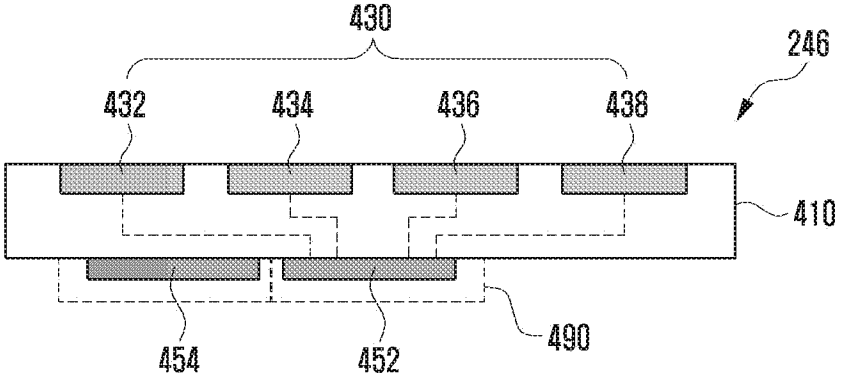
FIG. 4AC

FIG. 11B
farfield (f=28) [1[1,0]+2[1,180]]
| | |
|---|---|
| Type | Farfield |
| Approximation | enabled (kR >> 1) |
| Component | Abs |
| Output | Realized Gain |
| Frequency | 28 GHz |
| Rad. effic. | -0.6061 dB |
| Tot. effic. | -1.007 dB |
| rlzd.Gain | 2.283 dB |
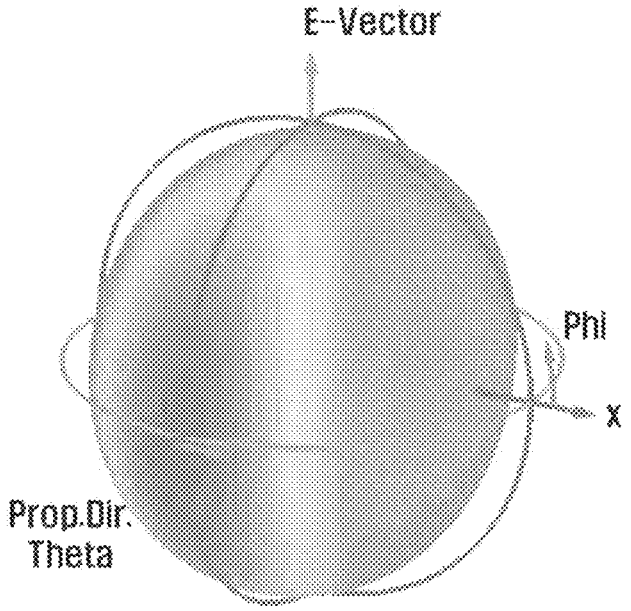
farfield (f=39) [1[1,0]+2[1,180]]
| | |
|---|---|
| Type | Farfield |
| Approximation | enabled (kR >> 1) |
| Component | Abs |
| Output | Realized Gain |
| Frequency | 39 GHz |
| Rad. effic. | -0.6073 dB |
| Tot. effic. | -0.9059 dB |
| rlzd.Gain | 1.817 dB |
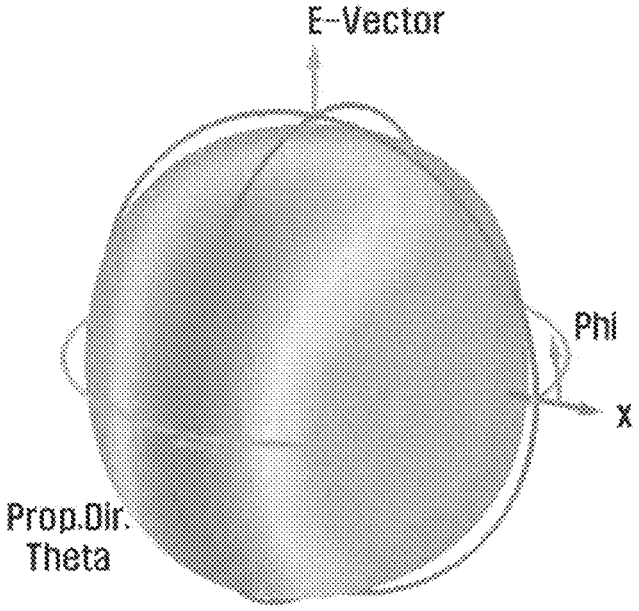

ANTENNA USING SLOT AND ELECTRONIC DEVICE INCLUDING THE SAME

CROSS-REFERENCE TO RELATED APPLICATION(S)

This application is based on and claims priority under 35 U.S.C. § 119(a) of a Korean patent application number 10-2018-0139558, filed on Nov. 14, 2018, in the Korean Intellectual Property Office, the disclosure of which is incorporated by reference herein in its entirety.

BACKGROUND

1. Field

The disclosure relates to an antenna using a slot and an electronic device including the same.

2. Description of Related Art

With the development of wireless communication technology, electronic devices (e.g., communication electronic devices) are commonly used in daily life; thus, use of contents is increasing exponentially. Because of such rapid increase in the use of contents, a network capacity is reaching its limit. After commercialization of 4th generation (4G) communication systems, in order to meet growing wireless data traffic demand, a communication system (e.g., 5th generation (5G) or pre-5G communication system, or new radio (NR)) that transmits and/or receives signals using a frequency of a high frequency (e.g., millimeter wave (mmWave)) band (e.g., 3 GHz to 300 GHz band) is being studied.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an antenna using a slot and an electronic device including the same.

The next-generation wireless communication technology can actually transmit and receive signals using frequencies in the range of 3 GHz to 100 GHz, and in order to overcome a high free-space loss caused by the frequency characteristics and to heighten a gain of an antenna, there is a trend of developing an efficient mount structure and a corresponding new antenna structure.

The above-described antenna may be configured to form beam patterns in front and/or rear directions of an electronic device. Recently, in order to form beam patterns on not only front and/or rear surfaces but also a side surface of the electronic device, an antenna using a pair of conductive layers spaced apart from each other at a predetermined interval and intervened by a dielectric material (e.g., shortened patch antenna (S-patch antenna) or polarized antenna) has been developed. However, such a type of antenna operates mainly in a single band, and it may be difficult for the antenna to be fully used due to an insufficient bandwidth in multiple bands (e.g., first frequency band (e.g., frequency band in the range of about 24 GHz to 34 GHz) or second frequency band (e.g., frequency band in the range of about 37 GHz to 44 GHz)).

Various embodiments of the disclosure can provide an antenna using a slot and an electronic device including the same.

Another aspect of the disclosure is to provide an antenna using a slot capable of operating in multiple bands (e.g., dual bands) and an electronic device including the same.

Another aspect of the disclosure it to provide an antenna using a slot configured to adjust an operating frequency band or to be able to extend a bandwidth and an electronic device including the same.

Additional aspects will be set forth in part in the description which follows and, in part, will be apparent from the description, or may be learned by practice of the presented embodiments.

In accordance with an aspect of the disclosure, an electronic device is provided. The electronic device includes a housing including a first plate, a second plate directed in an opposite direction to the first plate, and a side member surrounding a space between the first plate and the second plate and being combined with or being integrally formed with the second plate, a display configured to be seen through at least a part of the first plate, an antenna structure arranged inside the housing, the antenna structure including a first conductive layer including a first region including a first U-shaped slot and a second region coming in contact with the first region, and a second conductive layer facing the first conductive layer to be spaced apart from the first conductive layer, and including a third region including a second U-shaped slot facing the first U-shaped slot and a fourth region coming in contact with the third region and facing the second region, and at least one wireless communication circuitry electrically connected to the first conductive layer or the second conductive layer and configured to transmit and/or receive a signal having a frequency in a range of 3 GHz to 100 GHz.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIGS. 4AA, 4AB, and 4AC are views illustrating an embodiment of a structure of a third antenna module explained with reference to FIG. 2 according to an embodiment of the disclosure;

FIG. 9H is a graph illustrating frequency change relationships in accordance with a change of a partial structure of an antenna structure according to an embodiment of the disclosure;

FIG. 11B is a diagram illustrating a radiation pattern for each frequency of an antenna module of FIG. 10A according to an embodiment of the disclosure;

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
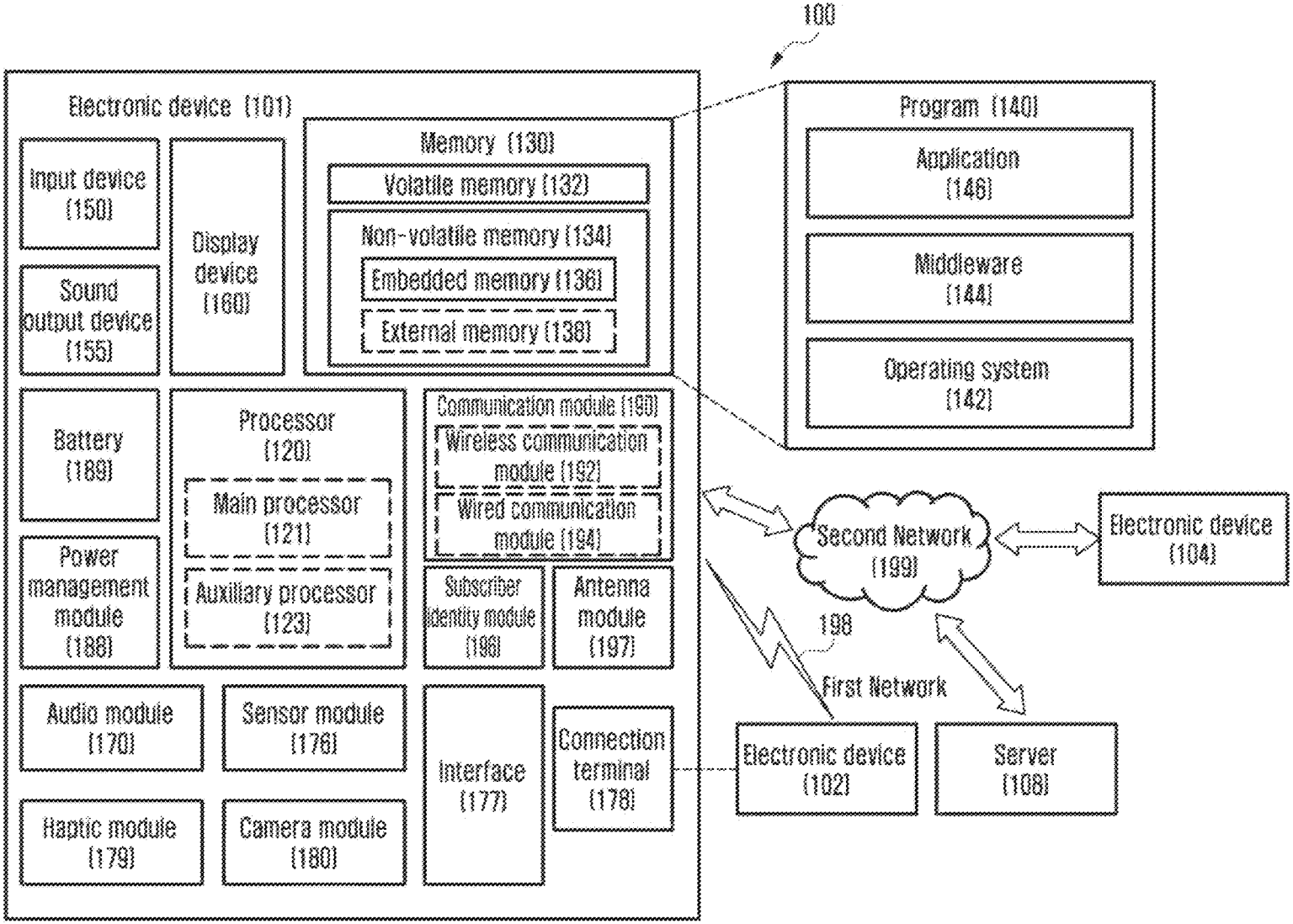
FIG. 1 is a block diagram of an electronic device in a network environment according to an embodiment of the disclosure.

FIG. 1 illustrates an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. As at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The audio output device 155 may output sound signals to the outside of the electronic device 101. The audio output device 155 may include, for example, a speaker or a receiver. The speaker may be used for general purposes, such as playing multimedia or playing record, and the receiver may be used for an incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. The interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). The connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include, for example, a motor, a piezoelectric element, or an electric stimulator.

The camera module 180 may capture a still image or moving images. The camera module 180 may include one or more lenses, image sensors, image signal processors, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. The antenna module 197 may include an antenna including a radiating element composed of a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

An electronic device according to an embodiment may be one of various types of electronic devices. The electronic device may include a portable communication device (e.g., a smart phone), a computer device, a portable multimedia device, a portable medical device, a camera, a wearable device, or a home appliance. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "$1^{st}$" and "$2^{nd}$", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

The term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory or embedded memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may still perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
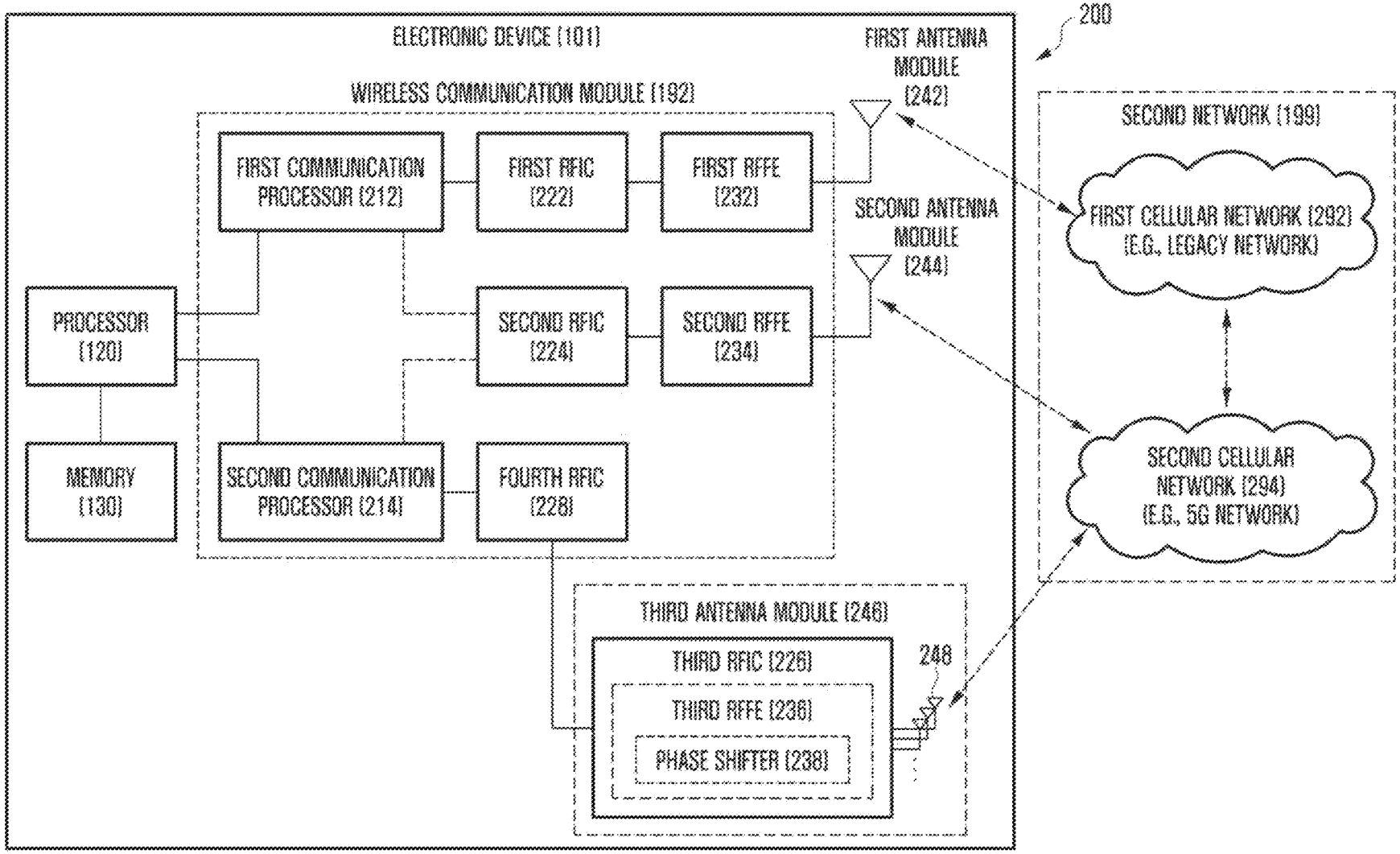
FIG. 2 is a block diagram of an electronic device in a network environment including a plurality of cellular networks according to an embodiment of the disclosure.

FIG. 2 is a block diagram illustrating an electronic device in a network environment including a plurality of cellular networks according to an embodiment of the disclosure.

Referring to FIG. 2, the electronic device 101 in a network environment 200 may include a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, and antenna 248. The electronic device 101 may include a processor 120 and a memory 130. A second network 199 may include a first cellular network 292 and a second cellular network 294. According to another embodiment, the electronic device 101 may further include at least one of the components described with reference to FIG. 1, and the second network 199 may further include at least one other network. According to one embodiment, the first communication processor 212, second communication processor 214, first RFIC 222, second RFIC 224, fourth RFIC 228, first RFFE 232, and second RFFE 234 may form at least part of the wireless communication module 192. According to another embodiment, the fourth RFIC 228 may be omitted or included as part of the third RFIC 226.

The first communication processor 212 may establish a communication channel of a band to be used for wireless communication with the first cellular network 292 and support legacy network communication through the established communication channel. According to various embodiments, the first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel. According to various embodiments, the second cellular network 294 may be a 5G network defined in 3GPP. Additionally, according to an embodiment, the first communication processor 212 or the second communication processor 214 may establish a communication channel corresponding to another designated band (e.g., about 6 GHz or less) of bands to be used for wireless communication with the second cellular network 294 and support 5G network communication through the established communication channel. According to one embodiment, the first communication processor 212 and the second communication processor 214 may be implemented in a single chip or a single package. According to various embodiments, the first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 (e.g., legacy network) through an antenna (e.g., the first antenna module 242) and be preprocessed through an RFFE (e.g., the first RFFE 232). The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network). Upon reception, a 5G Sub6 RF signal may be obtained from the second cellular network 294 (e.g., 5G network) through an antenna (e.g., the second antenna module 244) and be pretreated through an RFFE (e.g., the second RFFE 234). The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 (e.g., 5G network) through an antenna (e.g., the antenna 248) and be preprocessed through the third RFFE 236. The third RFIC 226 may convert the preprocessed 5G Above6 RF signal to a baseband signal so as to be processed by the second communication processor 214. According to one embodiment, the third RFFE 236 may be formed as part of the third RFIC 226.

According to an embodiment, the electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 (e.g., a 5G network) through an antenna (e.g., the antenna 248) and be converted to an IF signal by the third RFIC 226. The fourth RFIC 228 may convert an IF signal to a baseband signal so as to be processed by the second communication processor 214.

According to one embodiment, the first RFIC 222 and the second RFIC 224 may be implemented into at least part of a single package or a single chip. According to one embodiment, the first RFFE 232 and the second RFFE 234 may be implemented into at least part of a single package or a single chip. According to one embodiment, at least one of the first antenna module 242 or the second antenna module 244 may be omitted or may be combined with another antenna module to process RF signals of a corresponding plurality of bands.

According to one embodiment, the third RFIC 226 and the antenna 248 may be disposed at the same substrate to form a third antenna module 246. For example, the wireless communication module 192 or the processor 120 may be disposed at a first substrate (e.g., main PCB). In this case, the third RFIC 226 is disposed in a partial area (e.g., lower surface) of the first substrate and a separate second substrate (e.g., sub PCB), and the antenna 248 is disposed in another partial area (e.g., upper surface) thereof; thus, the third antenna module 246 may be formed. By disposing the third RFIC 226 and the antenna 248 in the same substrate, a length of a transmission line therebetween can be reduced. This may reduce, for example, a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294 (e.g., 5G network).

According to one embodiment, the antenna 248 may be formed in an antenna array including a plurality of antenna elements that may be used for beamforming. In this case, the third RFIC 226 may include a plurality of phase shifters 238 corresponding to a plurality of antenna elements, for example, as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 (e.g., 5G network) may operate (e.g., stand-alone (SA)) independently of the first cellular network 292 (e.g., legacy network) or may be operated (e.g., non-stand alone (NSA)) in connection with the first cellular network 292. For example, the 5G network may have only an access network (e.g., 5G radio access network (RAN) or a next generation (NG) RAN and have no core network (e.g., next generation core (NGC)). In this case, after accessing to the access network of the 5G network, the electronic device 101 may access to an external network (e.g., Internet) under the control of a core network (e.g., an evolved packed core (EPC)) of the legacy network. Protocol information (e.g., LTE protocol information) for communication with a legacy network or protocol information (e.g., new radio (NR) protocol information) for communication with a 5G network may be stored in the memory 130 to be accessed by other components (e.g., the processor 120, the first communication processor 212, or the second communication processor 214).

Figure 3A:
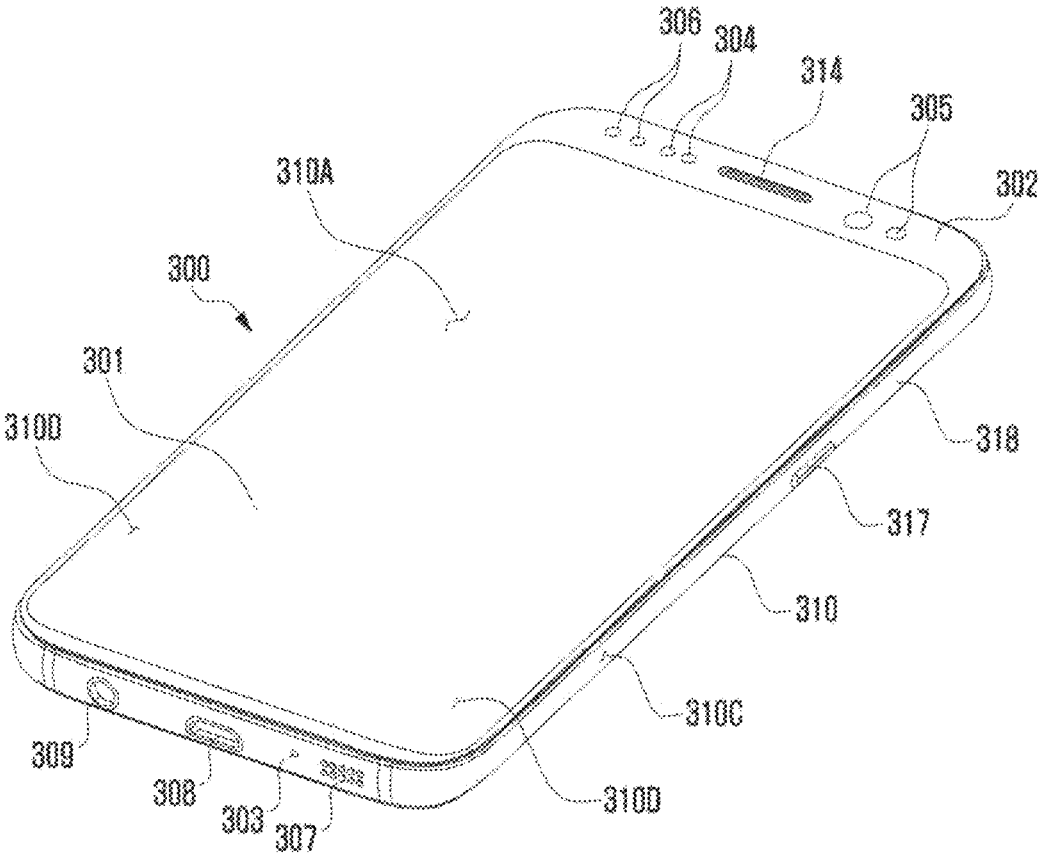
FIG. 3A is a perspective view of a mobile electronic device according to an embodiment of the disclosure.

FIG. 3A is a front perspective view illustrating a mobile electronic device according to an embodiment of the disclosure.

Figure 3B:
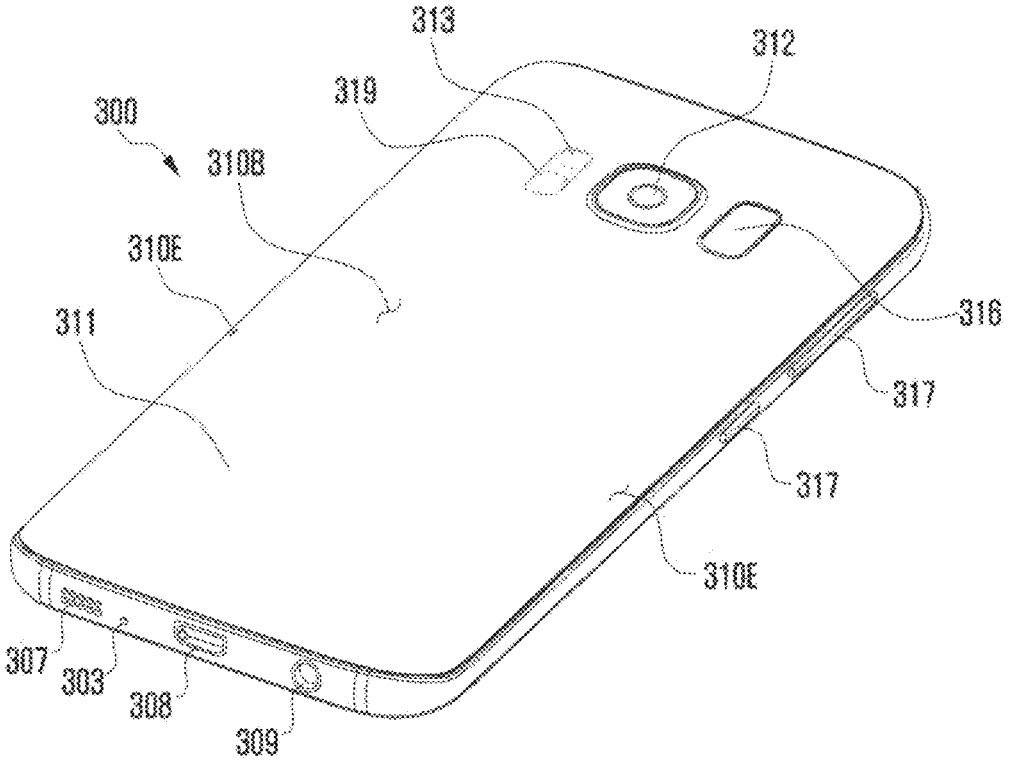
FIG. 3B is a perspective view of a rear side of a mobile electronic device according to an embodiment of the disclosure.

FIG. 3B is a rear perspective view illustrating a mobile electronic device according to an embodiment of the disclosure.

Referring to FIGS. 3A and 3B, the mobile electronic device 300 (e.g., the electronic device 101 of FIG. 1) according to various embodiments may include a housing 310 including a first surface (or front surface) 310A, a second surface (or rear surface) 310B, and a side surface 310C enclosing a space between the first surface 310A and the second surface 310B. In one embodiment (not illustrated), the housing may refer to a structure forming some of the first surface 310A, the second surface 310B, and the side surface 310C. According to one embodiment, the first surface 310A may be formed by an at least partially substantially transparent front plate 302 (e.g., a polymer plate or a glass plate including various coating layers). The second surface 310B may be formed by a substantially opaque rear plate 311. The rear plate 311 may be formed by, for example, coated or colored glass, ceramic, polymer, metal (e.g., aluminum, stainless steel (STS), or magnesium), or a combination of at least two of the above materials. The side surface 310C may be coupled to the front plate 302 and the rear plate 311 and be formed by a side bezel structure (or "side member") 318 including a metal and/or a polymer. In some embodiments, the rear plate 311 and the side bezel structure 318 may be integrally formed and include the same material (e.g., metal material such as aluminum).

In the illustrated embodiment, the front plate 302 may include two first regions 310D bent and extended seamlessly from the first surface 310A toward the rear plate 311 at both ends of a long edge of the front plate 302. In the illustrated embodiment (see FIG. 3B), the rear plate 311 may include two second regions 310E bent and extended seamlessly from the second surface 310B towards the front plate 302 at both ends of a long edge. In some embodiments, the front plate 302 (or the rear plate 311) may include only one of the first regions 310D (or the second regions 310E). In one embodiment, a portion of the first regions 310D or the second regions 310E may not be included. In the above embodiments, when viewed from the side surface of the mobile electronic device 300, the side bezel structure 318 may have a first thickness (or width) at a side surface in which the first region 310D or the second region 310E is not included and have a second thickness smaller than the first thickness at a side surface including the first region 310D or the second region 310E.

According to one embodiment, the mobile electronic device 300 may include at least one of a display 301; audio modules 303, 307, and 314; sensor modules 304, 316, and 319; camera modules 305, 312, and 313; key input device 317; light emitting element 306; and connector holes 308 and 309. In some embodiments, the mobile electronic device 300 may omit at least one (e.g., the key input device 317 or the light emitting element 306) of the components or may further include other components.

The display 301 may be exposed through, for example, a substantial portion of the front plate 302. In some embodiments, at least part of the display 301 may be exposed through the front plate 302 forming the first region 310D of the side surface 310C and the first surface 310A. In some embodiments, an edge of the display 301 may be formed to be substantially the same as an adjacent outer edge shape of the front plate 302. In one embodiment (not illustrated), in order to enlarge an area where the display 301 is exposed, a distance between an outer edge of the display 301 and an outer edge of the front plate 302 may be formed to be substantially the same.

In an embodiment (not illustrated), in a portion of a screen display area of the display 301, a recess or an opening may be formed, and at least one of the audio module 314 and the sensor module 304, the camera module 305, and the light emitting element 306 aligned with the recess or the opening may be included. In one embodiment (not illustrated), at a rear surface of a screen display area of the display 301, at least one of the audio module 314, the sensor module 304, the camera module 305, the fingerprint sensor module 316, and the light emitting element 306 may be included. In one embodiment (not illustrated), the display 301 may be coupled to or disposed adjacent to a touch detection circuit, a pressure sensor capable of measuring intensity (pressure) of the touch, and/or a digitizer for detecting a stylus pen of a magnetic field method. In some embodiments, at least part of the sensor modules 304 and 319 and/or at least part of the key input device 317 may be disposed in a first region 310D and/or a second region 310E.

The audio modules 303, 307, and 314 may include a microphone hole 303 and speaker holes 307 and 314. The microphone hole 303 may dispose a microphone for obtaining an external sound therein; and, in some embodiments, a plurality of microphones may be disposed to detect a direction of a sound. The speaker holes 307 and 314 may include an external speaker hole 307 and a call receiver hole 314. In some embodiments, the speaker holes 307 and 314 and the microphone hole 303 may be implemented into one hole, or the speaker may be included without the speaker holes 307 and 314 (e.g., piezo speaker).

The sensor modules 304, 316, and 319 may generate an electrical signal or a data value corresponding to an operating state inside the mobile electronic device 300 or an environment state outside the mobile electronic device 300. The sensor modules 304, 316, and 319 may include, for example, a first sensor module 304 (e.g., proximity sensor) and/or a second sensor module (not illustrated) (e.g., fingerprint sensor), disposed at the first surface 310A of the housing 310, and/or a third sensor module 319 (e.g., a heart rate monitor (HRM) sensor) and/or a fourth sensor module 316 (e.g., fingerprint sensor), disposed at the second surface 310B of the housing 310. The fingerprint sensor may be disposed at the second surface 310B as well as the first surface 310A (e.g., the display 301) of the housing 310. The mobile electronic device 300 may further include a sensor module (not illustrated), for example, at least one of a gesture sensor, gyro sensor, air pressure sensor, magnetic sensor, acceleration sensor, grip sensor, color sensor, IR sensor, biometric sensor, temperature sensor, humidity sensor, and illumination sensor.

The camera modules 305, 312, and 313 may include a first camera device 305 disposed at the first surface 310A of the mobile electronic device 300, a second camera device 312 disposed at the second surface 310B thereof, and/or a flash 313. The camera modules 305 and 312 may include one or a plurality of lenses, an image sensor, and/or an image signal processor. The flash 313 may include, for example, a light emitting diode or a xenon lamp. In some embodiments, two or more lenses (infrared camera, wide angle and telephoto lens) and image sensors may be disposed at one surface of the mobile electronic device 300.

The key input device 317 may be disposed at the side surface 310C of the housing 310. In one embodiment, the mobile electronic device 300 may not include some or all of the above-described key input devices 317, and the key input device 317 that is not included may be implemented in other forms such as a soft key on the display 301. In some embodiments, the key input device 317 may include a sensor module 316 disposed at the second surface 310B of the housing 310.

The light emitting element 306 may be disposed at, for example, the first surface 310A of the housing 310. The light emitting element 306 may provide, for example, status information of the mobile electronic device 300 in an optical form. In one embodiment, the light emitting element 306 may provide, for example, a light source interworking with an operation of the camera module 305. The light emitting element 306 may include, for example, a light emitting diode (LED), an IR LED, and a xenon lamp.

The connector ports 308 and 309 may include a first connector port 308 that may receive a connector (e.g., a USB connector) for transmitting and receiving power and/or data to and from an external electronic device and/or a second connector hole (e.g., earphone jack) 309 that can receive a connector for transmitting and receiving audio signals to and from an external electronic device.

Figure 3C:
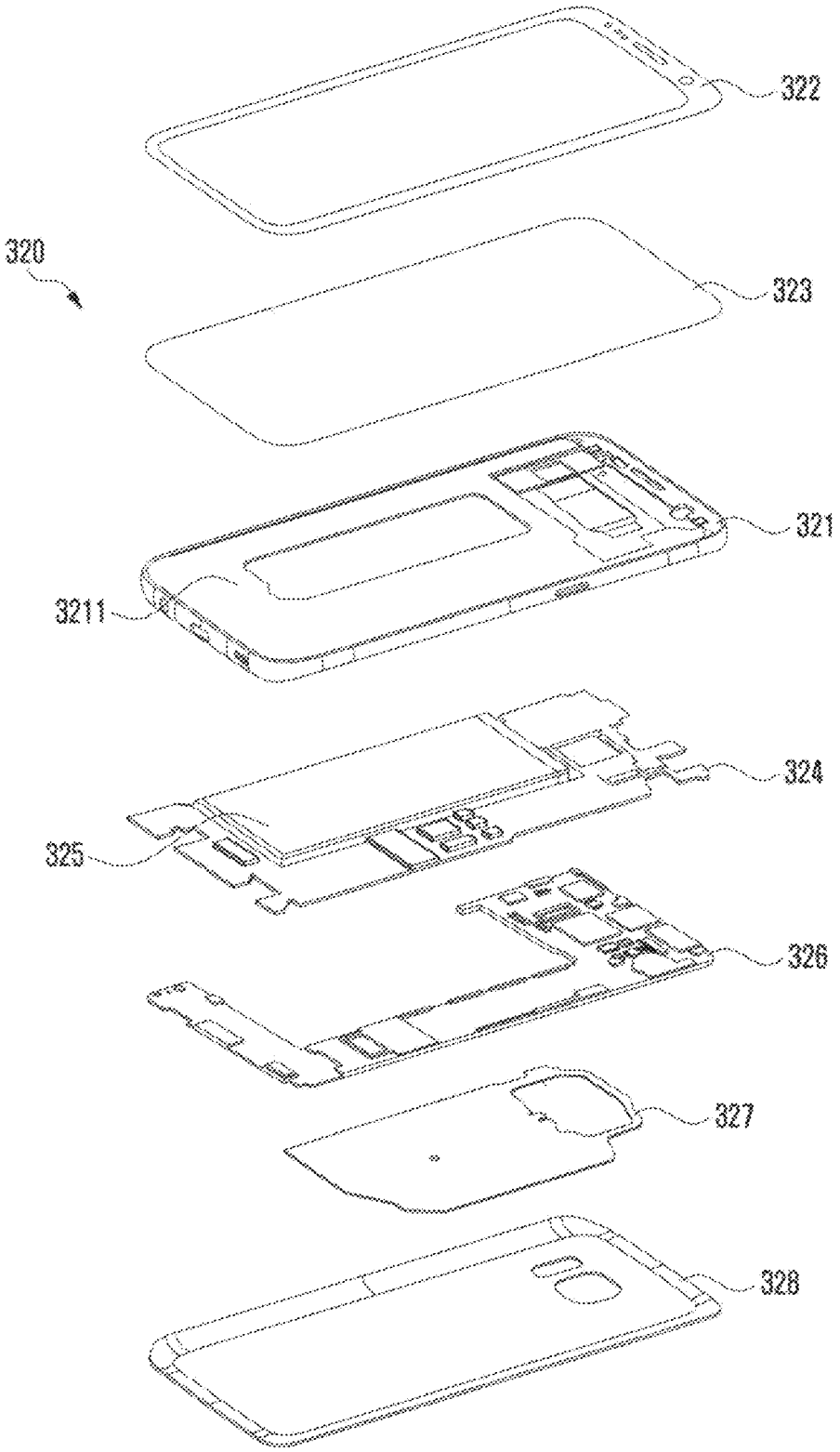
FIG. 3C is an exploded perspective view of a mobile electronic device according to an embodiment of the disclosure.

FIG. 3C is an exploded perspective view illustrating a mobile electronic device according to an embodiment of the disclosure.

Referring to FIG. 3C, the mobile electronic device 320 (e.g., the mobile electronic device 300 of FIG. 3A) may include a side bezel structure 321, first support member 3211 (e.g., bracket), front plate 322, display 323, printed circuit board 324, battery 325, second support member 326 (e.g., rear case), antenna 327, and rear plate 328. In some embodiments, the mobile electronic device 320 may omit at least one (e.g., the first support member 3211 or the second support member 326) of the components or may further include other components. At least one of the components of the mobile electronic device 320 may be the same as or similar to at least one of the components of the mobile electronic device 300 of FIG. 3A or 3B and a duplicated description is omitted below.

The first support member 3211 may be disposed inside the mobile electronic device 320 to be connected to the side bezel structure 321 or may be integrally formed with the side bezel structure 321. The first support member 3211 may be made of, for example, a metal material and/or a non-metal (e.g., polymer) material. In the first support member 3211, the display 323 may be coupled to one surface thereof, and the printed circuit board 324 may be coupled to the other surface thereof. In the printed circuit board 324, a processor, a memory, and/or an interface may be mounted. The processor may include, for example, one or more of a central processing unit, application processor, graphic processing unit, image signal processor, sensor hub processor, or communication processor.

The memory may include, for example, a volatile memory or a nonvolatile memory.

The interface may include, for example, a HDMI, USB interface, SD card interface, and/or audio interface. The interface may, for example, electrically or physically connect the mobile electronic device 320 to an external electronic device and include a USB connector, an SD card/multimedia card (MMC) connector, or an audio connector.

The battery 325 is a device for supplying power to at least one component of the mobile electronic device 320 and may include, for example, a non-rechargeable primary battery, a rechargeable secondary battery, or a fuel cell. At least part of the battery 325 may be disposed, for example, on substantially the same plane as that of the printed circuit board 324. The battery 325 may be integrally disposed inside the mobile electronic device 320 or may be detachably disposed in the mobile electronic device 320.

The antenna 327 may be disposed between the rear plate 328 and the battery 325. The antenna 327 may include, for example, a near field communication (NFC) antenna, wireless charging antenna, and/or magnetic secure transmission (MST) antenna. The antenna 327 may perform, for example, short range communication with an external device or may wirelessly transmit and receive power required for charging. In one embodiment, an antenna structure may be formed by some or a combination of the side bezel structure 321 and/or the first support member 3211.

FIGS. 4AA through 4AC are diagrams illustrating a structure of, for example, a third antenna module described with reference to FIG. 2 according to an embodiment of the disclosure.

Referring to FIGS. 4AA through 4AC, FIG. 4AA is a perspective view illustrating the third antenna module 246 viewed from one side, and FIG. 4AB is a perspective view illustrating the third antenna module 246 viewed from the other side. FIG. 4AC is a cross-sectional view illustrating the third antenna module 246 taken along line X-X' of FIGS. 4AA to 4AC.

Referring to FIGS. 4AA to 4AC, in one embodiment, the third antenna module 246 may include a printed circuit board 410, an antenna array 430, a RFIC 452, and a PMIC 454. Alternatively, the third antenna module 246 may further include a shield member 490. In other embodiments, at least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 (e.g., 248 of FIG. 2) may include a plurality of antenna elements 432, 434, 436, or 438 disposed to form a directional beam. As illustrated, the antenna elements 432, 434, 436, or 438 may be formed at a first surface of the printed circuit board 410. According to another embodiment, the antenna array 430 may be formed inside the printed circuit board 410. According to the embodiment, the antenna array 430 may include the same or a different shape or kind of a plurality of antenna arrays (e.g., dipole antenna array and/or patch antenna array).

The RFIC 452 (e.g., the third RFIC 226 of FIG. 2) may be disposed at another area (e.g., a second surface opposite to the first surface) of the printed circuit board 410 spaced apart from the antenna array. The RFIC 452 is configured to process signals of a selected frequency band transmitted/received through the antenna array 430. According to one embodiment, upon transmission, the RFIC 452 may convert a baseband signal obtained from a communication processor (not shown) to an RF signal of a designated band. Upon reception, the RFIC 452 may convert an RF signal received through the antenna array 430 to a baseband signal and transfer the baseband signal to the communication processor.

According to another embodiment, upon transmission, the RFIC 452 may up-convert an IF signal (e.g., about 9 GHz to about 11 GHz) obtained from an intermediate frequency integrated circuit (IFIC) (e.g., 228 of FIG. 2) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB (not illustrated) to provide power necessary for various components (e.g., the RFIC 452) on the antenna module.

The shield member 490 may be disposed at a portion (e.g., the second surface) of the printed circuit board 410 so as to electromagnetically shield at least one of the RFIC 452 or the PMIC 454. According to one embodiment, the shield member 490 may include a shield can.

Although not shown, in various embodiments, the third antenna module 246 may be electrically connected to another printed circuit board (e.g., main circuit board) through a module interface. The module interface may include a connecting member, for example, a coaxial cable connector, board to board connector, interposer, or flexible printed circuit board (FPCB). The RFIC 452 and/or the PMIC 454 of the antenna module may be electrically connected to the printed circuit board through the connection member.

Figure 4B:
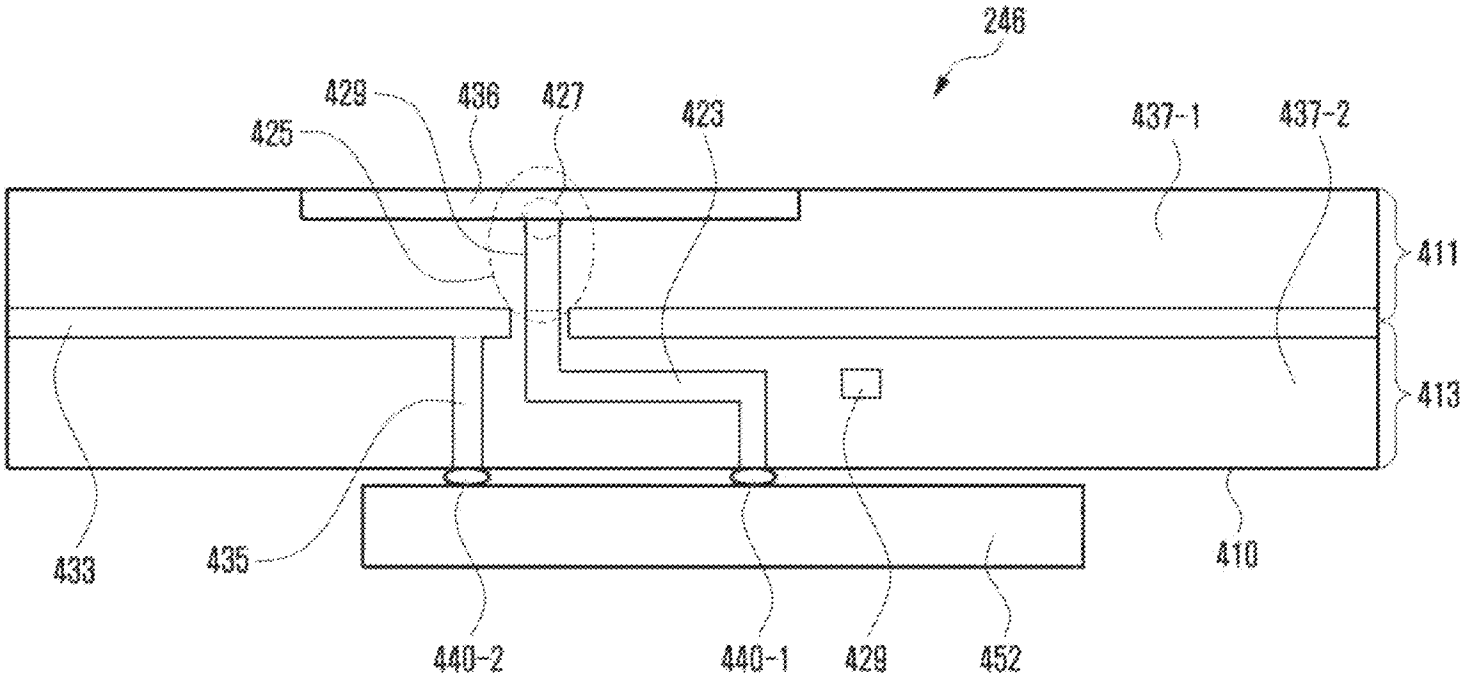
FIG. 4B is a view illustrating a cross-section of line Y-Y' of a third antenna module illustrated as in FIG. 4AA to 4AC according to an embodiment of the disclosure.

FIG. 4B is a cross-sectional view illustrating a third antenna module taken along line Y-Y' of FIG. 4AA according to an embodiment of the disclosure. Referring to FIG. 4B, the third antenna module may be third antenna module 246. The printed circuit board 410 of the illustrated embodiment may include an antenna layer 411 and a network layer 413.

Referring to FIG. 4B, the antenna layer 411 may include at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 may include at least one dielectric layer 437-2, at least one ground layer 433, at least one conductive via 435, a transmission line 423, and/or a power feeding line 429 formed on or inside an outer surface of the dielectric layer.

Further, in the illustrated embodiment, the RFIC 452 (e.g., the third RFIC 226 of FIG. 2) of FIG. 4AC may be electrically connected to the network layer 413 through, for example, first and second solder bumps 440-1 and 440-2. In other embodiments, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. Although not illustrated, the RFIC 452 may also be electrically connected to the above-described module interface through the power feeding line 429.

Figure 5A:
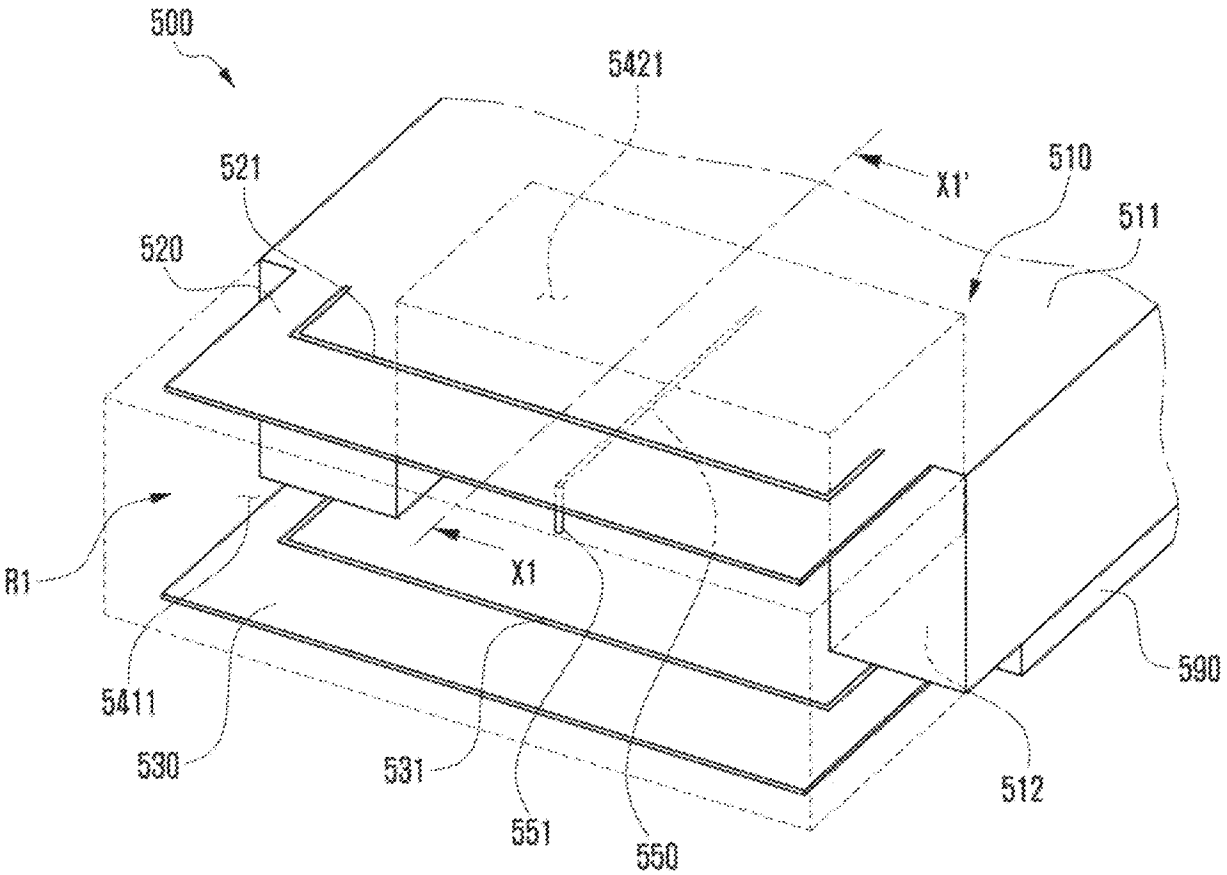
FIG. 5A is a perspective view of an antenna module according to an embodiment of the disclosure.

FIG. 5A is a perspective view of an antenna module according to an embodiment of the disclosure.

Figure 5B:
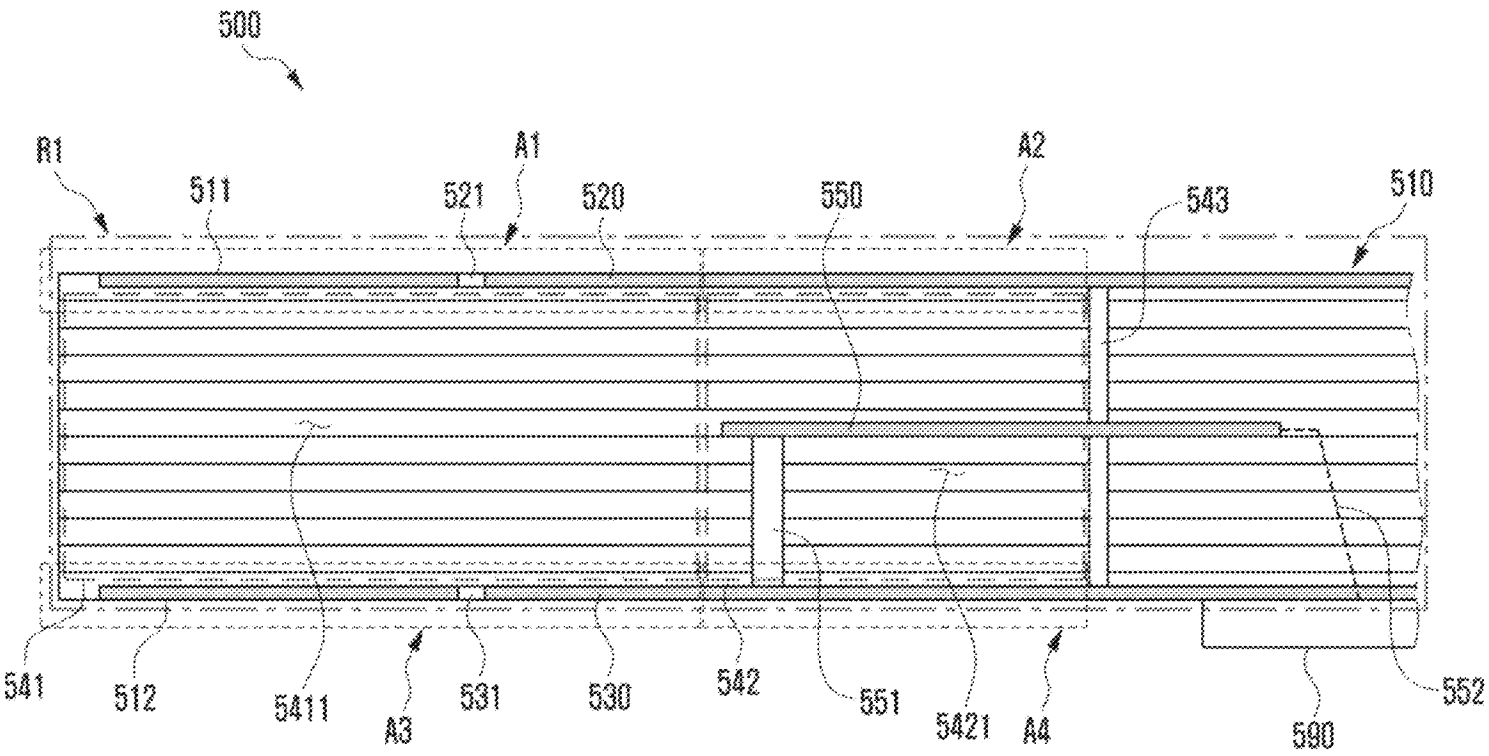
FIG. 5B is a cross-sectional view illustrating a laminated structure of an antenna module of FIG. 5A according to an embodiment of the disclosure.

FIG. 5B is a cross-sectional view illustrating a laminated structure of the antenna module of FIG. 5A according to an embodiment of the disclosure. FIG. 5B is a cross-sectional view taken along line X1-X1' of FIG. 5A.

The antenna module 500 of FIG. 5A may be at least partly similar to the third antenna module 246 of FIG. 2, or it may further include other embodiments of the antenna module.

Referring to FIG. 5A, the antenna module 500 may be deployed in an inner space of an electronic device. According to an embodiment, the antenna module 500 may be deployed to form a beam pattern in a direction of a side surface (e.g., side surface 310C of FIG. 3A) of the electronic device (e.g., mobile electronic device 300 of FIG. 3A). As another embodiment, the antenna module 500 may be deployed to form a beam pattern toward at least a part of a rear plate (e.g., rear plate 311 of FIG. 3B) (e.g., second plate) or a front plate (e.g., front plate 302 of FIG. 3A) (e.g., first plate) of the electronic device (e.g., mobile electronic device 300 of FIG. 3A). According to an embodiment, the antenna module 500 may include a printed circuit board 510 in which a plurality of insulating layers deployed in the inner space of the electronic device (e.g., mobile electronic device 300 of FIG. 3A) are laminated.

According to various embodiments, the antenna module 500 may include an antenna structure R1. According to an embodiment, the antenna structure R1 may be formed on the printed circuit board 510. According to an embodiment, the printed circuit board 510 may include a first surface 511 and a second surface 512 directed in an opposite direction to the first surface 511. According to an embodiment, the antenna structure R1 may include conductive layers 520 and 530 respectively deployed through at least two layers among the plurality of insulating layers. According to an embodiment, the antenna structure R1 may include a first conductive layer 520 deployed on the printed circuit board 510 and a second conductive layer 530 facing the first conductive layer 520 to be spaced apart from the first conductive layer 520. According to an embodiment, the first conductive layer 520 may be deployed to be exposed to the first surface 511 of the printed circuit board. As another embodiment, the first conductive layer 520 may be deployed through any one insulating layer inside the printed circuit board 510. According to an embodiment, the second conductive layer 530 may be deployed to be exposed to the second surface 512 of the printed circuit board 510. As another embodiment, the second conductive layer 530 may be deployed through any one insulating layer inside the printed circuit board 510.

According to various embodiments, the first conductive layer 520 may include a first region A1 including a first U-shaped slot 521 and a second region A2 coming in contact with the first region A1. According to an embodiment, the second conductive layer 530 may include a second U-shaped slot 531 facing the first U-shaped slot 521, and it may include a third region A3 facing the first region A1 and a fourth region A4 coming in contact with the third region A3 and facing the second region A2. According to an embodiment, the first U-shaped slot 521 and the second U-shaped slot 531 may be formed through a process, such as etching, from the respective conductive layers 520 and 530. According to an embodiment, the first U-shaped slot 521 and the second U-shaped slot 531 may be formed in the direction of the first region A1 from a boundary portion of the first region A1 and the second region A2. According to an embodiment, the first U-shaped slot 521 and the second U-shaped slot 531 may be formed to have the same shape and to overlap each other as seen from an upside of the first conductive layer 520.

According to various embodiments, the antenna structure R1 may include a first space 5411 formed between the first region A1 and the third region A3 and a second space 5421 formed between the second region A2 and the fourth region A4. According to an embodiment, the antenna structure R1 may include a first dielectric material 541 filling the first space 5411 between the first region A1 and the third region A3 and a second dielectric material 542 filling the second space 5421 between the second region A2 and the fourth region A4. According to an embodiment, the first dielectric material 541 and the second dielectric material 542 may include an insulating material or air deployed between the first conductive layer 520 and the second conductive layer 530. As another embodiment, the first dielectric material 541 and the second dielectric material 542 may include an insulating layer of the printed circuit board 510 deployed between the first conductive layer 520 and the second conductive layer 530.

According to various embodiments, the antenna structure R1 may include a first feeding line 550 deployed between the second region A2 and the fourth region A4 and electrically connected to a wireless communication circuitry 590 from at least a partial region of the second conductive layer 530. According to an embodiment, one end of the first feeding line 550 may be electrically connected to the second conductive layer 530 through a first feeding part (e.g., conductive via) 551. According to an embodiment, the other end of the first feeding line 550 may be electrically connected to the wireless communication circuitry 590 through a first feeder 552 deployed between the first conductive layer 520 and the second conductive layer 530. According to an embodiment, the wireless communication circuitry 590 may be deployed on the second surface 512 of the printed circuit board 510. As another embodiment, the wireless communication circuitry 590 may be deployed to be spaced apart from the printed circuit board 510 through a conductive cable (e.g., flexible printed circuit board (FPCB)) in the inner space of the electronic device (e.g., mobile electronic device 300 of FIG. 3A). As another embodiment, the wireless communication circuitry 590 may be deployed on a separate printed circuit board (e.g., substrate) spaced apart from the printed circuit board 510, and it may be electrically connected to the antenna structure R1 of the printed circuit board 510. According to an embodiment, the first feeding part 551 may be deployed to be electrically connected to the first feeding line 550 in the second space 5421. As another embodiment, the first feeding part 551 may be deployed to be electrically connected to the first feeding line 550 in the first space 5411. In this case, at least a part of the first feeding line 550 may be extended up to the first space 5411. According to an embodiment, the wireless communication circuitry 590 may be configured to transmit and/or receive a signal having a frequency in the range of 3 GHz to 100 GHz through the first region A1 of the first conductive layer 520 including the first U-shaped slot 521 and the third region A3 of the second conductive layer 530 including the second U-shaped slot 531. According to an embodiment, the first region A1 of the first conductive layer 520 including the first U-shaped slot 521 and the third region A3 of the second conductive layer 530 including the second U-shaped slot 531 may operate as a patch antenna (e.g., shorted patch antenna) forming vertical polarization.

According to various embodiments, the antenna structure R1 may operate in dual bands through the first region A1 of the first conductive layer 520 including the first U-shaped slot 521 and the third region A3 of the second conductive layer 530 including the second U-shaped slot 531. According to an embodiment, the antenna structure R1 may operate in a first frequency band (e.g., frequency band in the range of about 24 GHz to 34 GHz) (e.g., about 28 GHz band) and a second frequency band (e.g., frequency band in the range of about 37 GHz to 44 GHz) (e.g., about 39 GHz band) designated through the first region A1 of the first conductive layer 520 and the third region A3 of the second conductive layer 530 including the first U-shaped slot 521 and the second U-shaped slot 531.

Figure 5C:
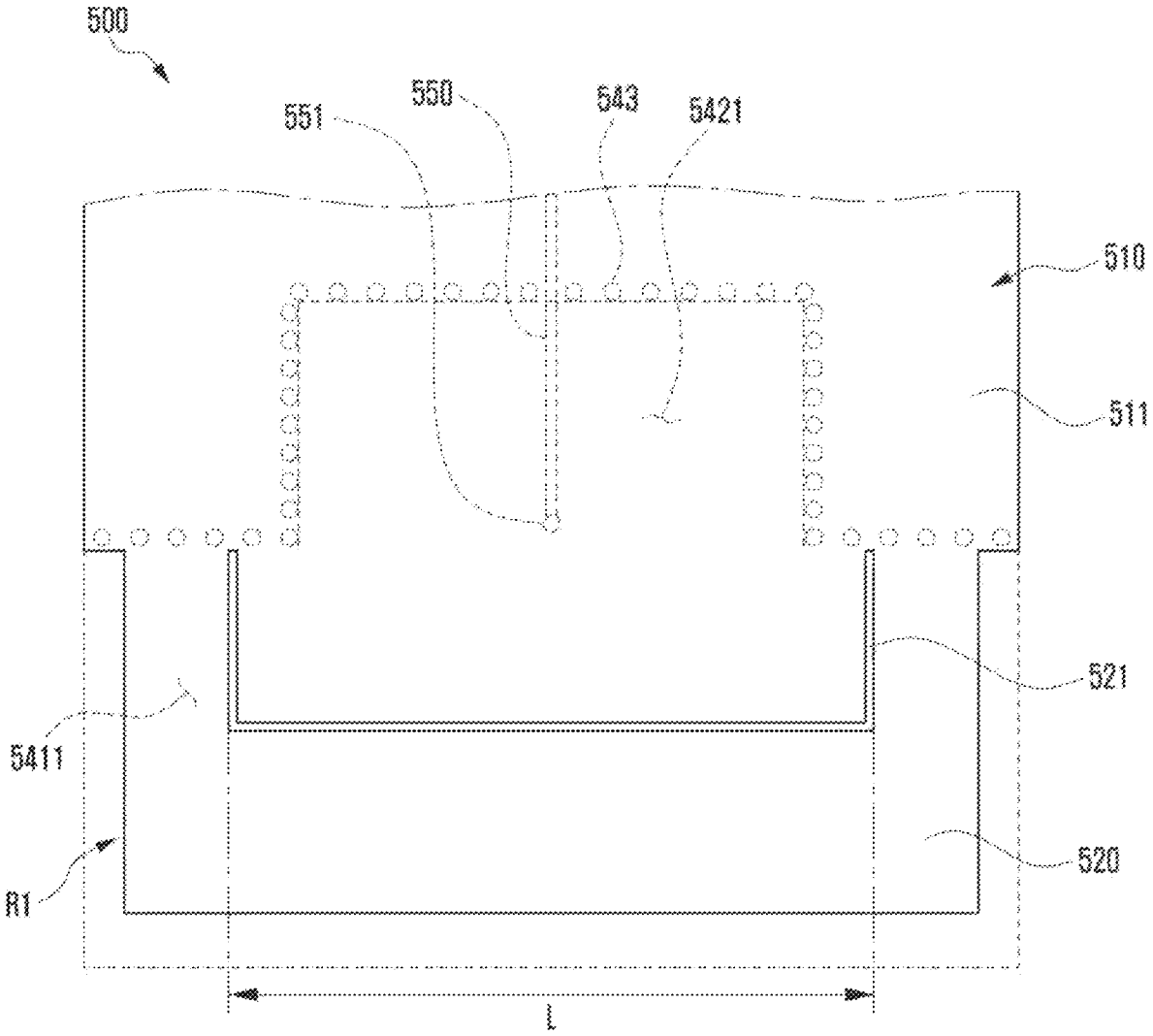
FIG. 5C is a plan view illustrating a state where an antenna module of FIG. 5A is partially projected according to an embodiment of the disclosure.

FIG. 5C is a plan view illustrating a state where an antenna module of FIG. 5A is partially projected according to an embodiment of the disclosure.

Referring to FIG. 5C, the antenna module may be antenna module 500 and the second space 5421 may include a cavity filled with a dielectric material between the second region A2 of the first conductive layer 520 and the fourth region A4 of the second conductive layer 530. According to an embodiment, the second space 5421 may be formed in a rectangular shape having a predetermined depth in the direction of the second region A2 from the boundary portion of the first region A1 and the second region A2. According to an embodiment, the second space 5421 may be formed to be electrically cut off through an electrical connection member 543 electrically connecting the first conductive layer 520 and the second conductive layer 530 in a vertical direction along the boundary line of the second space 5421. According to an embodiment, the electrical connection member 543 may include a plurality of conductive vias deployed from the first conductive layer 520 to the second conductive layer 530 along the boundary line of the second space 5421.

According to various embodiments, in the antenna structure R1, the first frequency band (e.g., low band) may be changed in accordance with the length L of the first U-shaped slot 521 and the second U-shaped slot 531. For example, for impedance matching of the first frequency band (e.g., low band), the change width of the second frequency band (e.g., high band) of the antenna structure R1 may be maintained to be small even if the length L of the first U-shaped slot 521 and the second U-shaped slot 531 is changed. Accordingly, the antenna structure R1 according to an embodiment of the disclosure may be advantageous in shifting the first frequency band (e.g., low band) in a state where the change width of the second frequency band (e.g., high band) is maintained to be small. As another embodiment, the basic resonance frequency may be determined in accordance with the size or the vertical interval of the first region A1 of the first conductive layer 520 and the third region A3 of the second conductive layer 530, or the location of the feeding part, and an additional frequency band may be determined by the total length L of the first U-shaped slot 521 and/or the second U-shaped slot 531, the width of the slot, or the projection length of the slot.

Figure 6A:
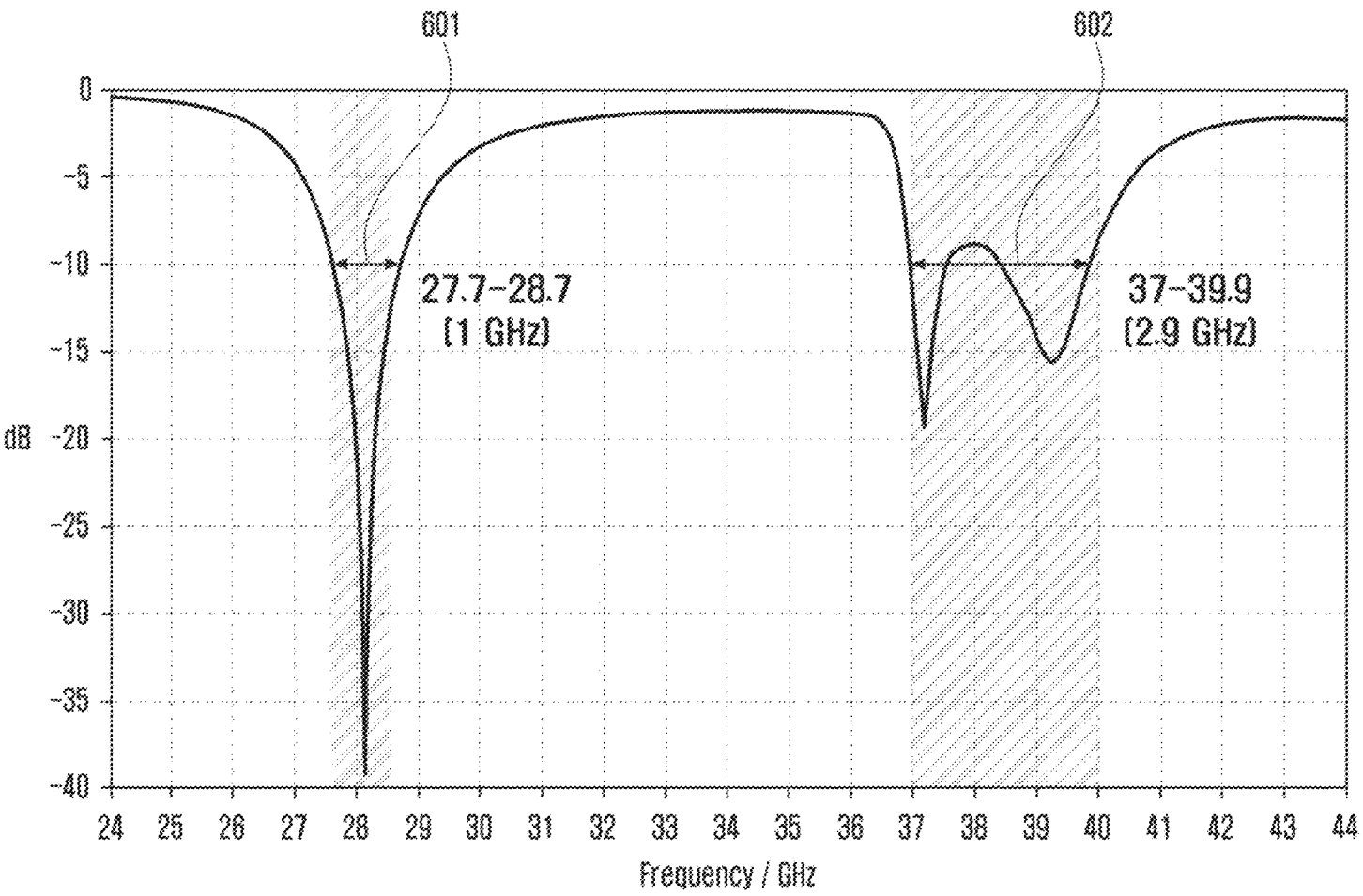
FIG. 6A is a graph illustrating a reflection coefficient and a gain of an antenna module of FIG. 5A according to an embodiment of the disclosure.
Figure 6B:
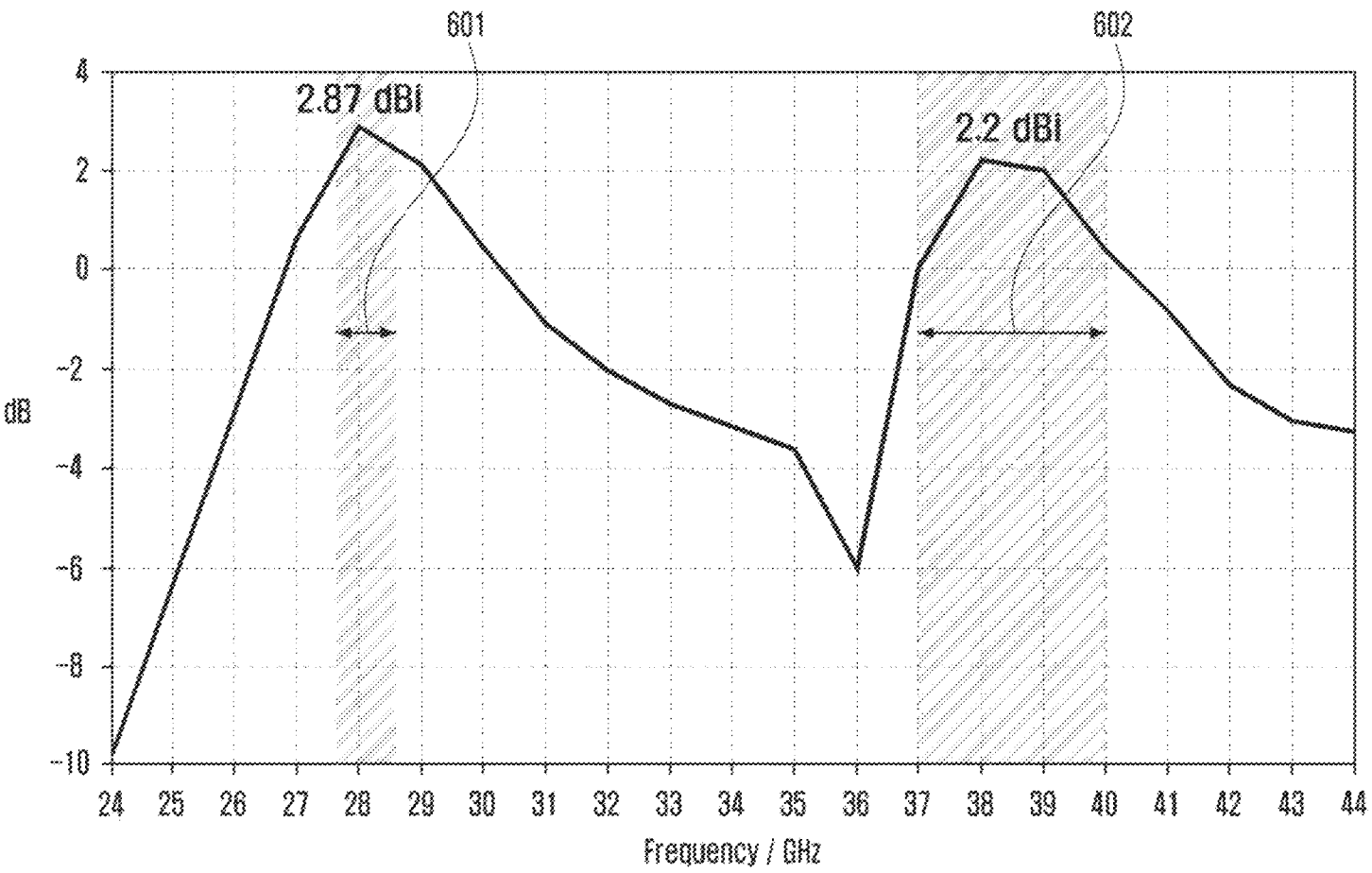
FIG. 6B is a graph illustrating a reflection coefficient and a gain of an antenna module of FIG. 5A according to an embodiment of the disclosure.

FIGS. 6A and 6B are graphs illustrating a reflection coefficient and a gain of an antenna module of FIG. 5A according to various embodiments of the disclosure.

Figure 6C:
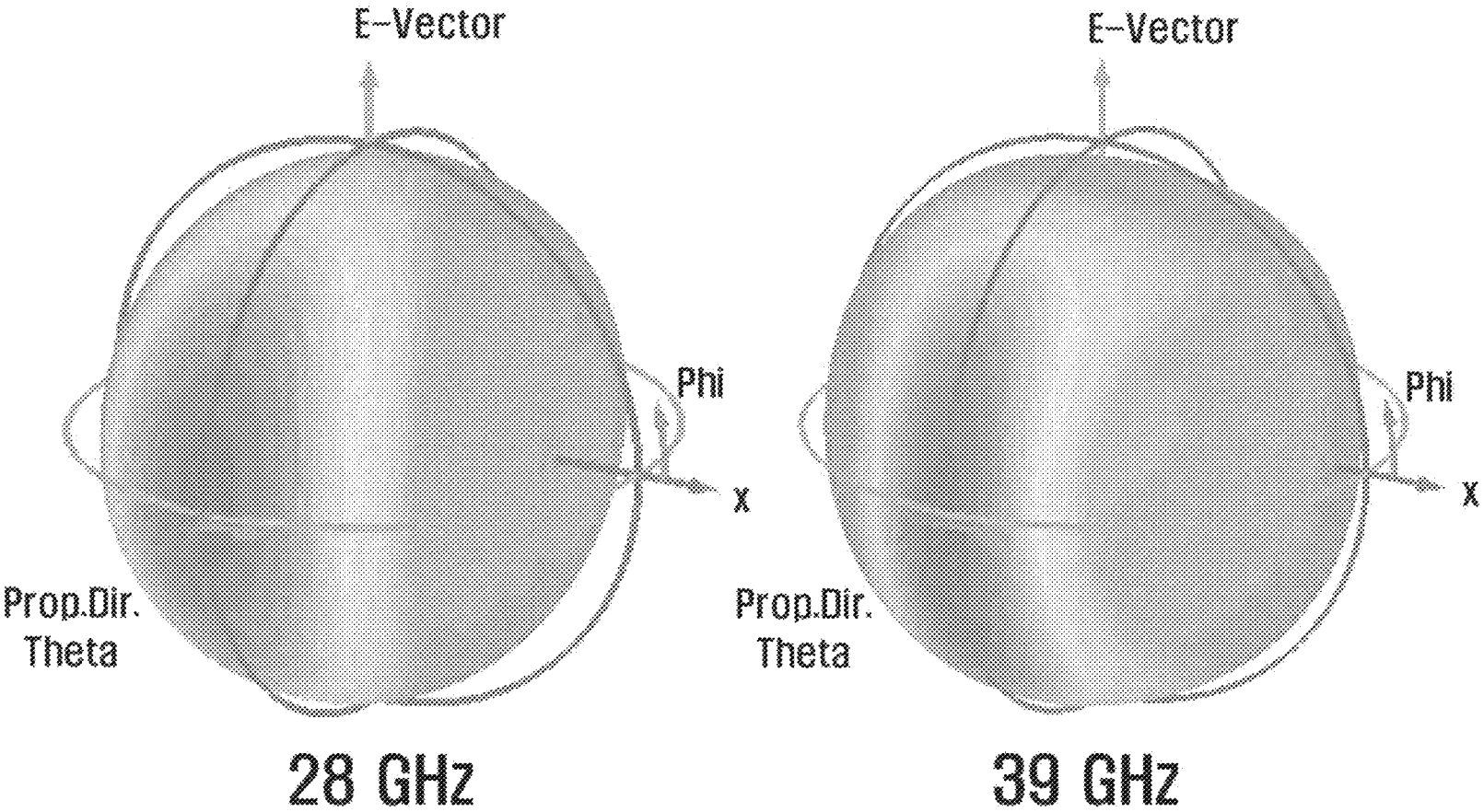
FIG. 6C is a diagram illustrating a radiation pattern for each frequency of an antenna module of FIG. 5A according to an embodiment of the disclosure.

FIG. 6C is a diagram illustrating a radiation pattern for each frequency of an antenna module of FIG. 5A according to an embodiment of the disclosure.

Referring to FIGS. 6A to 6C, the antenna module may be antenna module 500 and the antenna structure (e.g., antenna structure R1 of FIG. 5A) including the first U-shaped slot (e.g., first U-shaped slot 521 of FIG. 5A) and the second U-shaped slot (e.g., second U-shaped slot 531 of FIG. 5A) has a gain of about 2.87 dBi in the first frequency band (e.g., low band) having a bandwidth of about 1 GHz in the range of about 27.7 GHz to 28.7 GHz to be able to operate smoothly (e.g., region 601 of FIGS. 6A and 6B), and it has the gain of about 2.87 dBi in the second frequency band (e.g., high band) having a bandwidth of about 2.9 GHz in the range of about 37 GHz to 39.9 GHz to be able to operate smoothly (e.g., region 602 of FIGS. 6A and 6B).

Figure 7:
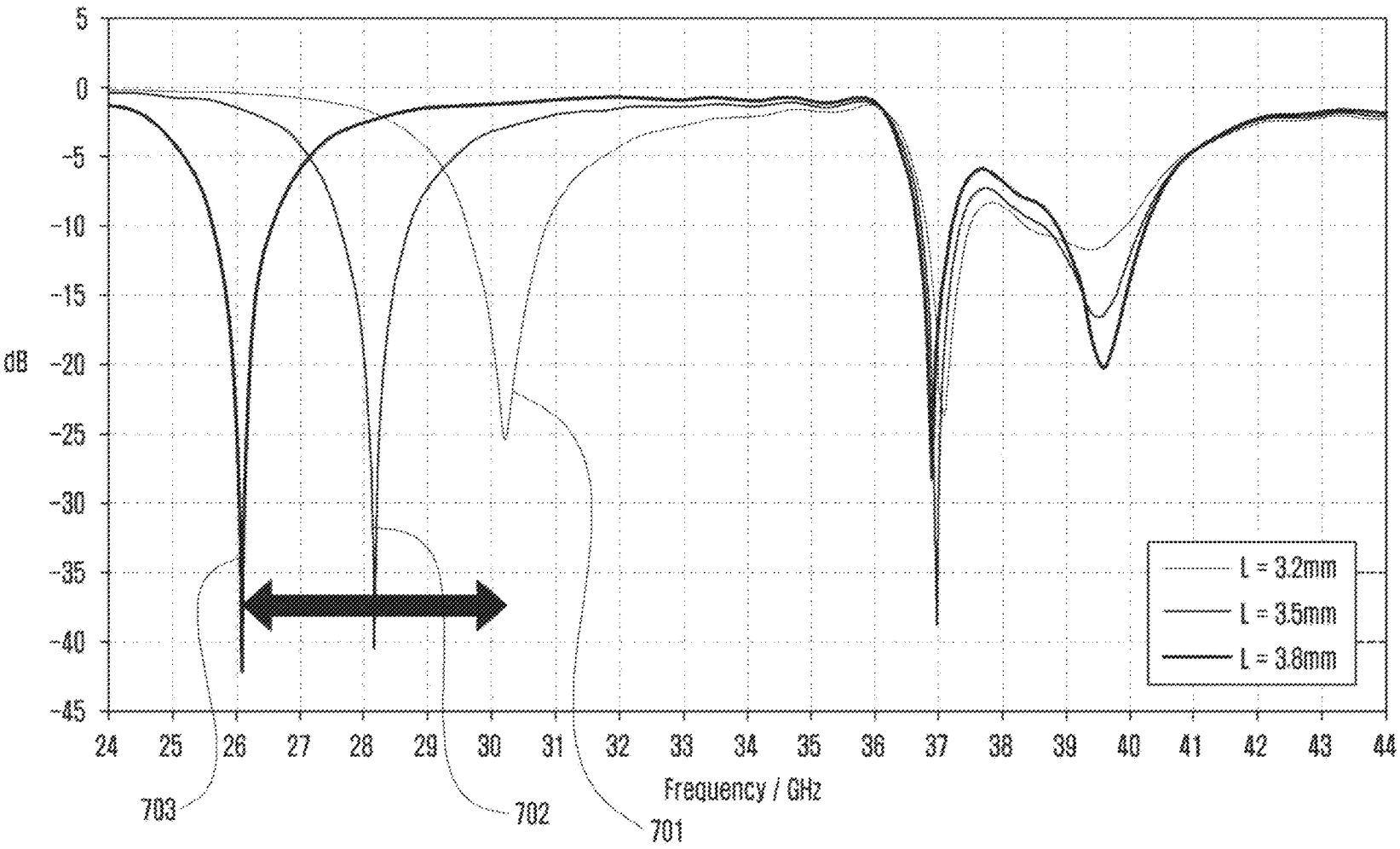
FIG. 7 is a graph illustrating reflection coefficients in accordance with the width change of U-shaped slots of an antenna module of FIG. 5A according to an embodiment of the disclosure.

FIG. 7 is a graph illustrating reflection coefficients in accordance with the width change of U-shaped slots 521 and 531 of an antenna module of FIG. 5A according to an embodiment of the disclosure.

Referring to FIG. 7, the antenna module may be antenna module 500 and the first frequency band (e.g., low band) may be shifted in accordance with the length (length L of FIG. 5C) of the first U-shaped slot (first U-shaped slot 521 of FIG. 5A) and the second U-shaped slot (e.g., second U-shaped slot 531 of FIG. 5A). In this case, the second frequency band (e.g., high band) has a low change width in a designated frequency band (e.g., about 39 GHz band). For example, if the length (e.g., length L of FIG. 5C) of the first U-shaped slot (e.g., first U-shaped slot 521 of FIG. 5A) and the second U-shaped slot (e.g., second U-shaped slot 531 of FIG. 5A) in the first frequency band (e.g., low band) is 3.2 mm (e.g., frequency band 701), the antenna structure (e.g., antenna structure R1 of FIG. 5C) can operate in the frequency band of about 30 GHz. If the length is 3.5 mm (e.g., frequency band 702), the antenna structure can operate in the frequency band of about 28 GHz, and if the length is 3.8 mm (e.g., frequency band 702), the antenna structure can operate in the frequency band of about 26 GHz. Accordingly, if the length (e.g., length L of FIG. 5C) of the first U-shaped slot (e.g., first U-shaped slot 521 of FIG. 5A) and the second U-shaped slot (e.g., second U-shaped slot 531 of FIG. 5A) is lengthened up to a predetermined level, the antenna structure (e.g., antenna structure R1 of FIG. 5C) is gradually shifted from the first frequency band (e.g., low band) to the low-frequency band while the change width of the second frequency band (e.g., high band) is maintained to be small.

Figure 8A:
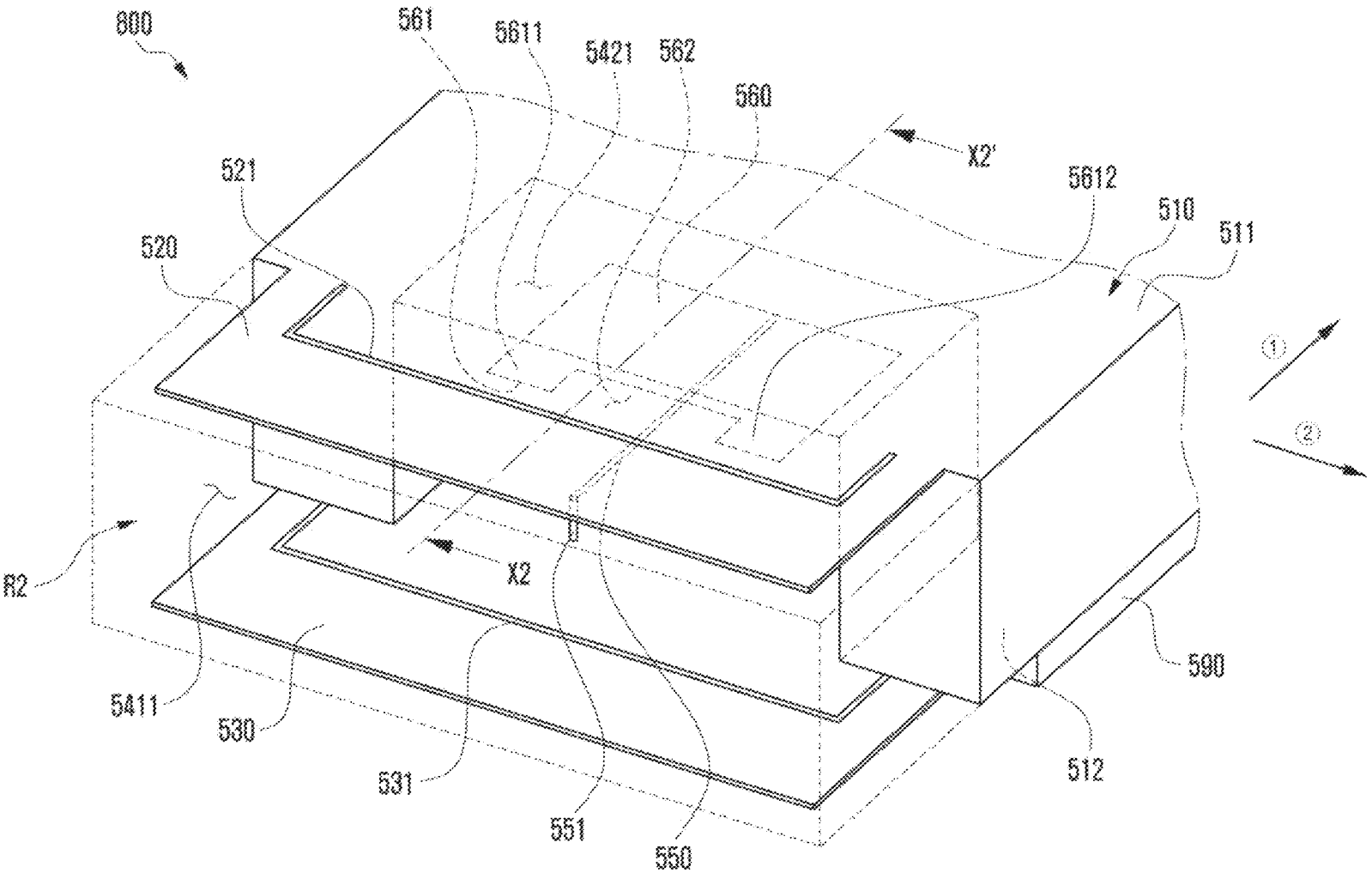
FIG. 8A is a perspective view of an antenna module according to an embodiment of the disclosure.

FIG. 8A is a perspective view of an antenna module according to an embodiment of the disclosure.

Figure 8B:
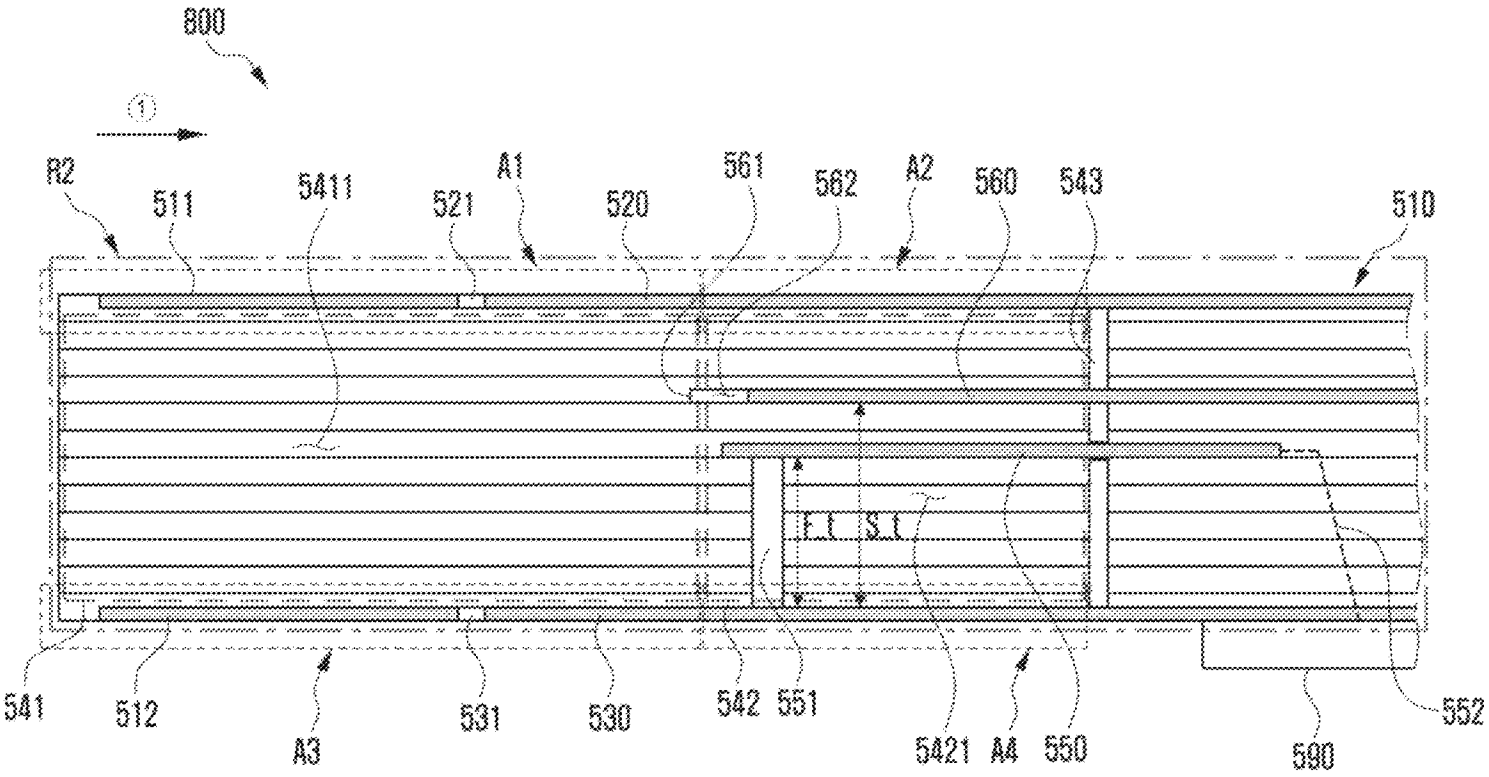
FIG. 8B is a cross-sectional view illustrating a laminated structure of an antenna module of FIG. 8A according to an embodiment of the disclosure.

FIG. 8B is a cross-sectional view illustrating a laminated structure of the antenna module of FIG. 8A according to an embodiment of the disclosure. FIG. 8B is a cross-sectional view taken along line X2-X2' of FIG. 8A.

In describing various embodiments of the disclosure, the same reference numerals are used for the same constituent elements as the above-described constituent elements, and the detailed explanation thereof may be omitted.

The antenna module 800 of FIG. 8A may be at least partly similar to the third antenna module 246 of FIG. 2, or it may further include other embodiments of the antenna module.

Referring to FIG. 8A, the antenna module 800 may include an antenna structure R2. According to an embodiment, the antenna structure R2 may include a first conductive layer 520 including a first U-shaped slot 521 and a second conductive layer 530 including a second U-shaped slot 531. According to an embodiment, in at least a second dielectric material 542 between the first conductive layer 520 and the second conductive layer 530, a third conductive layer 560 may be deployed substantially in parallel to the first conductive layer 520, and it may be deployed to have a smaller area than the area of the first conductive layer 520 as seen from the upside of the first conductive layer 520. According to an embodiment, the third conductive layer 560 may be deployed in parallel to the first conductive layer 520 and the second conductive layer 530. According to an embodiment, the third conductive layer 560 may be deployed to extend from a ground layer (e.g., conductive layer) deployed between the first conductive layer 520 and the second conductive layer 530 among the insulating layers of the printed circuit board with a predetermined area. According to an embodiment, the third conductive layer 560 may be electrically connected to the electrical connection member 543 electrically connecting the first conductive layer 520 and the second conductive layer 530 to each other. According to an embodiment, the wireless communication circuitry 590 may be configured to transmit and/or receive a signal having the frequency in the range of 3 GHz to 100 GHz through the antenna structure R2. According to an embodiment, the third conductive layer 560 may be deployed between the first conductive layer 520 and the first feeding line 550. According to an embodiment, the third conductive layer 560 may be deployed in a capacitively coupled location with the first feeding line 550. According to an embodiment, the third conductive layer 560 may be deployed substantially in the second dielectric material 542. As another embodiment, at least a part of the third conductive layer 560 may be deployed to extend into the first dielectric material 541. According to an embodiment, the third conductive layer 560 may include a first edge 561 extending along the second direction (② direction) that is vertical to the first direction (① direction) directed from the first space 5411 to the second space 5421 as seen from the upside of the first conductive layer 520. According to an embodiment, the third conductive layer 560 may be deployed at the first edge 561, and it may include a recess (e.g., groove) 562 formed in the first direction (① direction). According to an embodiment, the recess 562 may be formed to have a predetermined depth in the center of the first edge 561 as seen from the upside of the first conductive layer 520. Accordingly, the third conductive layer 560 may include a first projection part 5611 and a second projection part 5612 formed to project from both ends based on the recess 562.

According to various embodiments, the antenna structure R2 may extend the bandwidth of the second frequency band (e.g., high band) through the third conductive layer deployed spaced apart from the first feeding line 550 at a predetermined interval between the first conductive layer 520 and the second conductive layer 530.

Figure 8C:
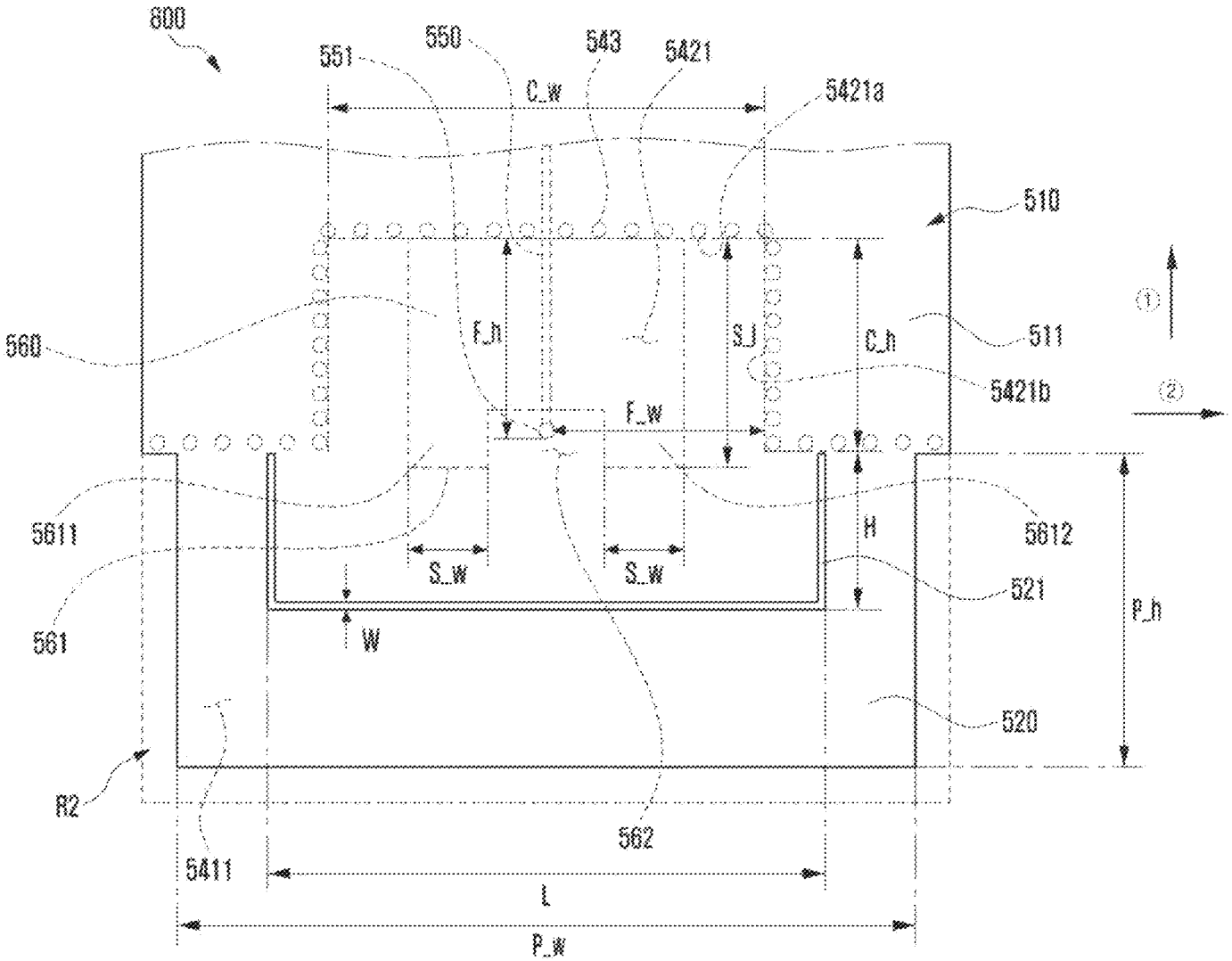
FIG. 8C is a plan view illustrating a state where an antenna module of FIG. 8A is partially projected according to an embodiment of the disclosure.

FIG. 8C is a plan view illustrating a state where an antenna module of FIG. 8A is partially projected according to an embodiment of the disclosure.

Referring to FIG. 8C, the antenna module may be antenna module 800 and the third conductive layer 560 may be deployed substantially in the center of the second space 5421 as seen from the upside of the first conductive layer 520. According to an embodiment, the recess 562 may be deployed substantially in the center of the first edge 561 as seen from the upside of the first conductive layer 520. According to an embodiment, the third conductive layer 560 may include the first projection part 5611 and the second projection part 5612 formed to project at the both ends by the recess 562 deployed at the first edge 561. According to an embodiment, the first projection part 5611 and the second projection part 5612 may be formed to have substantially the same shape and size. According to an embodiment, the first feeding line 550 may be deployed substantially to cross the center of the third conductive layer 560 in the first direction (① direction) as seen from the upside of the first conductive layer 520. According to an embodiment, the first feeding part 551 electrically connected to the first feeding line 550 may be deployed in a location that overlaps or does not overlap the recess 562 as seen from the upside of the first conductive layer 520. According to an embodiment, the third conductive layer 560 may be deployed so that the recess 562 substantially overlaps at least a part of the second space 5421 as seen from the upside of the first conductive layer 520. As another embodiment, the third conductive layer 560 may be deployed so that at least a part of the recess 562 overlaps at least a part of the first space 5411.

According to various embodiments, the bandwidth of the second frequency band (e.g., high band) may be changed in accordance with the change of the width S_w of the first projection part 5611 and the second projection part 5612 in the antenna structure R2. For example, in the antenna structure R2, the bandwidth of the second frequency band (e.g., high band) may be changed in accordance with the change of the length from the recess 562 to the first projection part 5611 and the second projection part 5612. According to an embodiment, the antenna structure R2 may operate in the second frequency band (e.g., about 28 GHz band) designated through the first region A1 of the first conductive layer 520 including the first U-shaped slot 521 and the third region A3 of the second conductive layer 530 including the second U-shaped slot 531, and it may extend the bandwidth of the second frequency band (e.g., about 39 GHz band) designated through the third conductive layer 560 serving as a conductive stub.

FIGS. 9A to 9L are diagrams illustrating frequency change relationships in accordance with a change of a partial structure of an antenna structure according to various embodiments of the disclosure. The numerical unit of a corresponding portion in accordance with the change of an antenna structure as illustrated in FIGS. 9A to 9L may be mm.

Figure 9A:
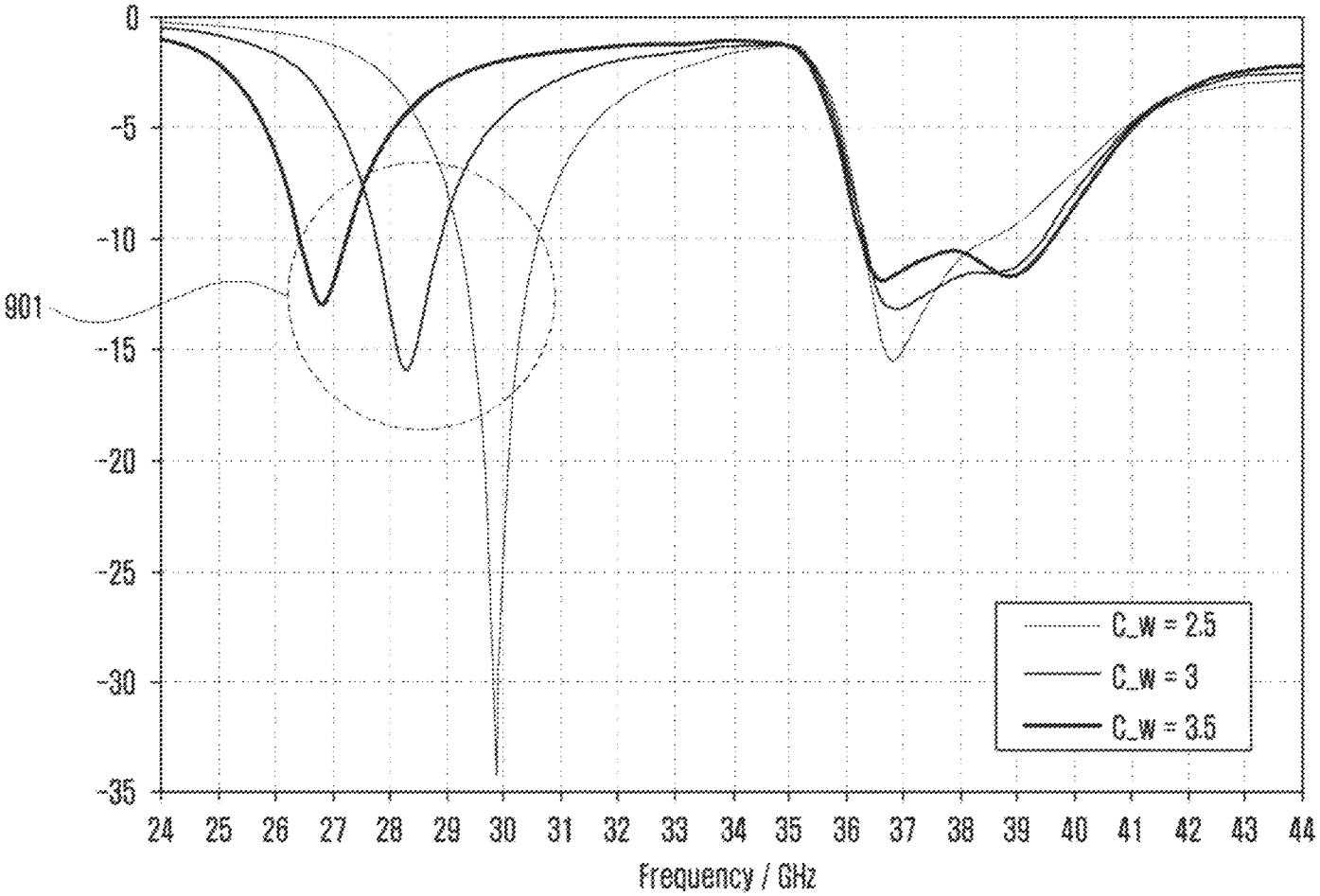
FIG. 9A is a graph illustrating frequency change relationships in accordance with a change of a partial structure of an antenna structure according to an embodiment of the disclosure.
Figure 9B:
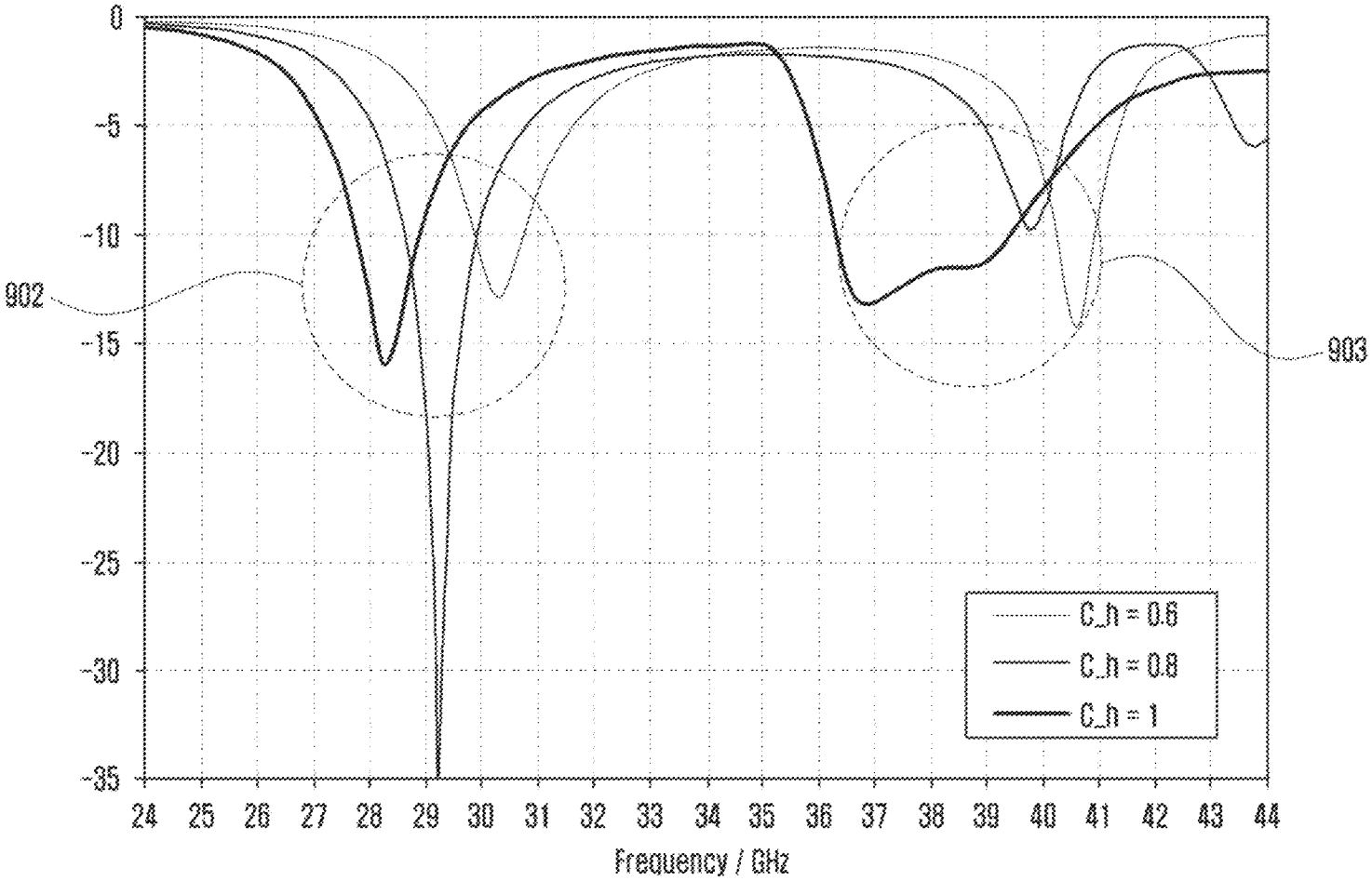
FIG. 9B is a graph illustrating frequency change relationships in accordance with a change of a partial structure of an antenna structure according to an embodiment of the disclosure.

Referring to FIGS. 9A and 9B, they are graphs illustrating a reflection coefficient of an antenna structure (e.g., antenna structure R2 of FIG. 8C) in accordance with the change of the width (e.g., width C_w of FIG. 8C) and the depth (e.g., depth C_h of FIG. 8C) of the second space (e.g., second space 5421 of FIG. 8C) (e.g., cavity).

Referring to FIG. 9A, according to the antenna structure R2, the second frequency band (e.g., high band) has a small change width in accordance with the change of the width C_w of the second space 5421, and the first frequency band (e.g., low band) is shifted to the designated frequency band. For example, as the width C_w of the second space 5421 becomes larger, the first frequency band is shifted to the low frequency band (region 901).

Referring to FIG. 9B, it can be known that according to the antenna structure R2, the first frequency band (e.g., low band) and the second frequency band (e.g., high band) are changed together in accordance with the change of the depth C_h of the second space 5421. For example, the first frequency band and the second frequency band are shifted to the low frequency band as the depth of the second space 5421 becomes larger (regions 902 and 903).

Figure 9C:
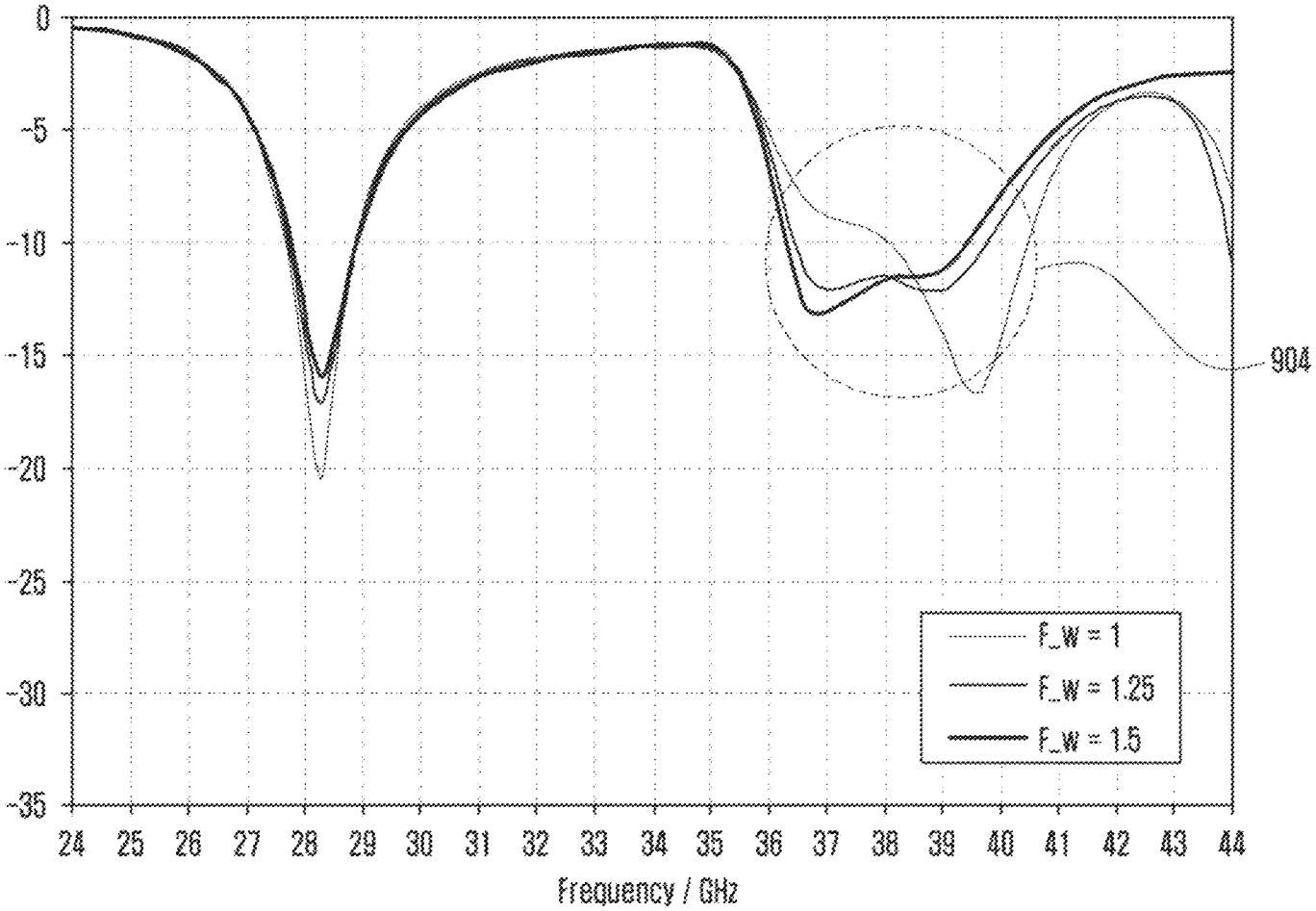
FIG. 9C is a graph illustrating frequency change relationships in accordance with a change of a partial structure of an antenna structure according to an embodiment of the disclosure.
Figure 9D:
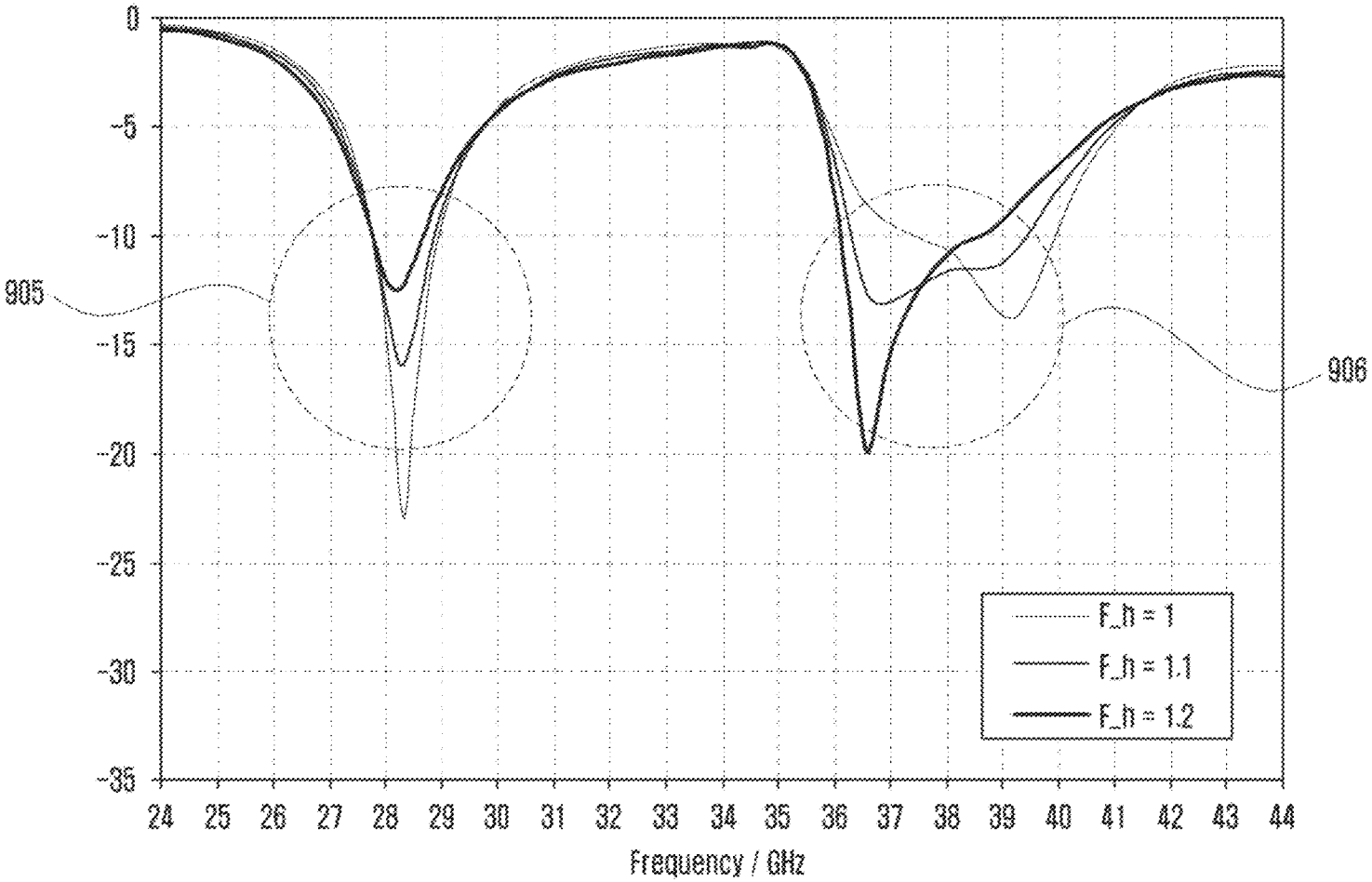
FIG. 9D is a graph illustrating frequency change relationships in accordance with a change of a partial structure of an antenna structure according to an embodiment of the disclosure.
Figure 9E:
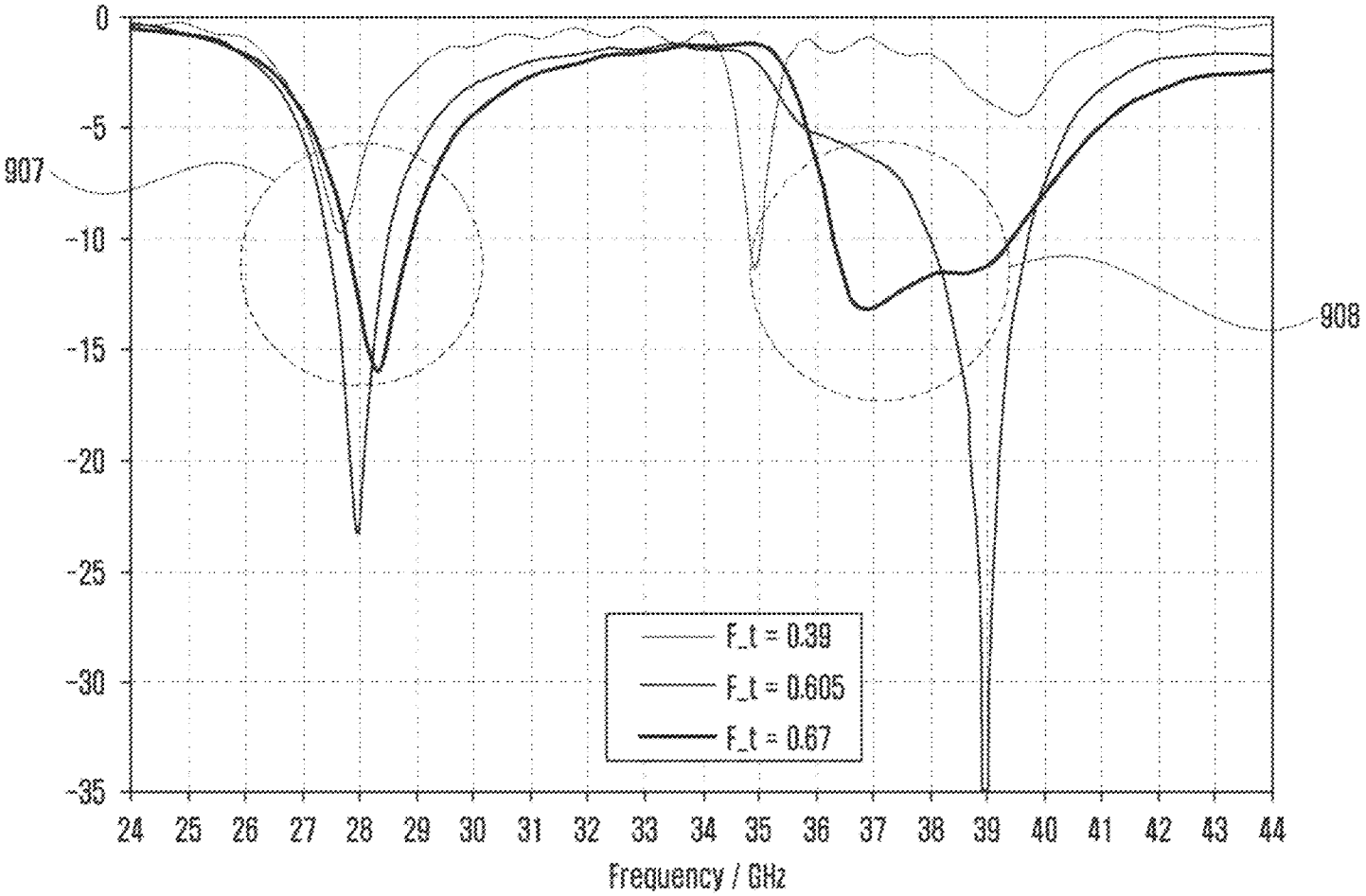
FIG. 9E is a graph illustrating frequency change relationships in accordance with a change of a partial structure of an antenna structure according to an embodiment of the disclosure.

Referring to FIGS. 9C to 9E, they are graphs illustrating a reflection coefficient of an antenna structure (e.g., antenna structure R2 of FIG. 8C) in accordance with the change of the location of the first feeding part (first feeding part 551 of FIG. 8C) in the second space (e.g., second space 5421 of FIG. 8C).

Referring to FIG. 9C, according to the antenna structure R2, the impedance characteristic is changed in the second frequency band (e.g., high band) in accordance with the change of the distance (e.g., distance F_w of FIG. 8C) between the first feeding part 551 and the inner side surface (e.g., inner side surface 5421*b* of FIG. 8C) of the second space 5421 (region 904).

Referring to FIG. 9D, according to the antenna structure R2, the impedance characteristics are changed together in the first frequency band (e.g., low band) and the second frequency band (e.g., high band) in accordance with the change of the distance (e.g., distance F_h of FIG. 8C) between the first feeding part 551 and the inner surface (e.g., inner surface 5421*a* of FIG. 8C) of the second space 5421 (regions 905 and 906).

Referring to FIG. 9E, according to the antenna structure R2, the impedance characteristic and the operating frequency band are changed together in the first frequency band (e.g., low band) and the second frequency band (e.g., high band) in accordance with the change of the height (e.g., height F_t of FIG. 8B) from the second conductive layer (e.g., second conductive layer 530 of FIG. 8B) to the first feeding part 551 (regions 907 and 908).

Figure 9F:
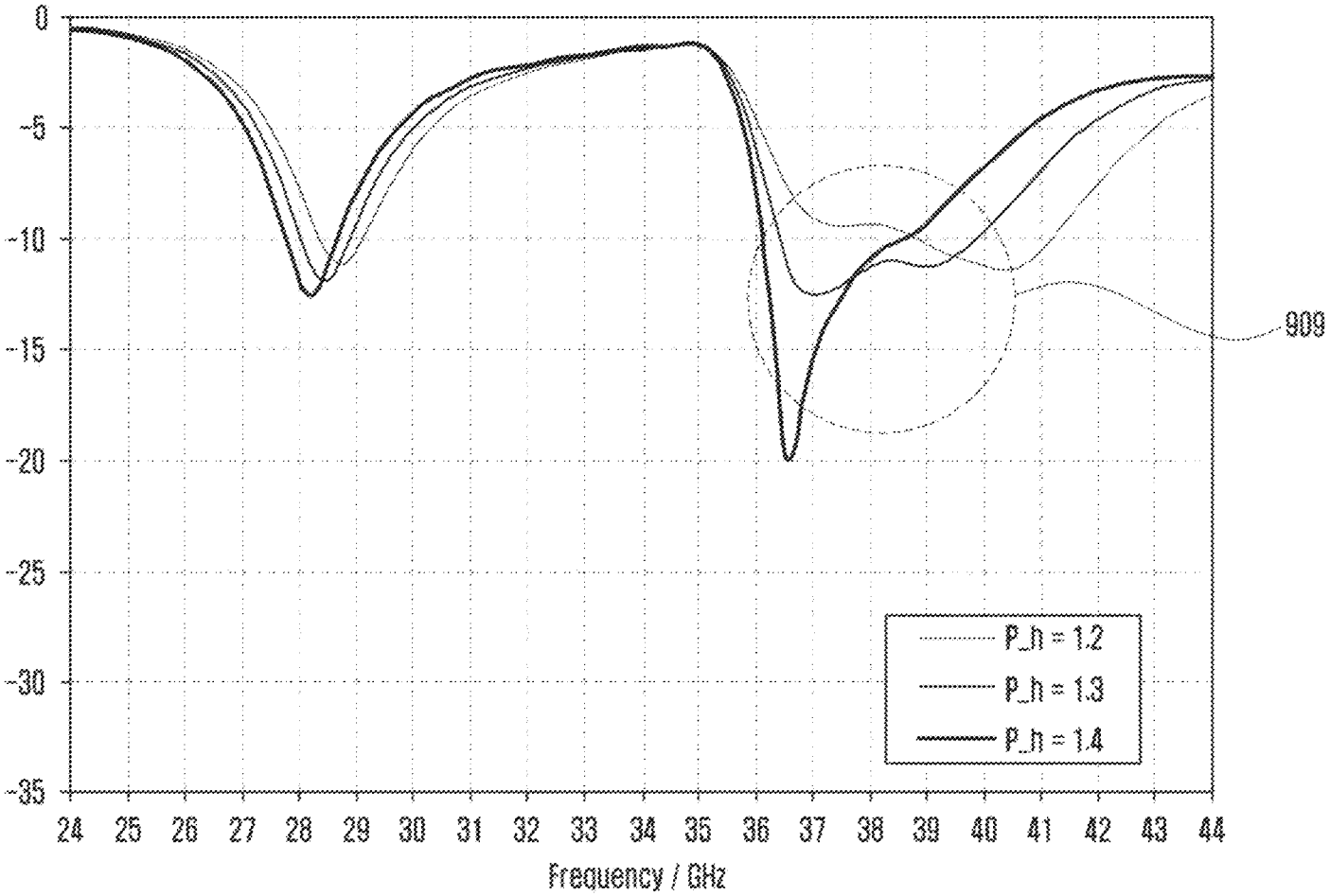
FIG. 9F is a graph illustrating frequency change relationships in accordance with a change of a partial structure of an antenna structure according to an embodiment of the disclosure.
Figure 9G:
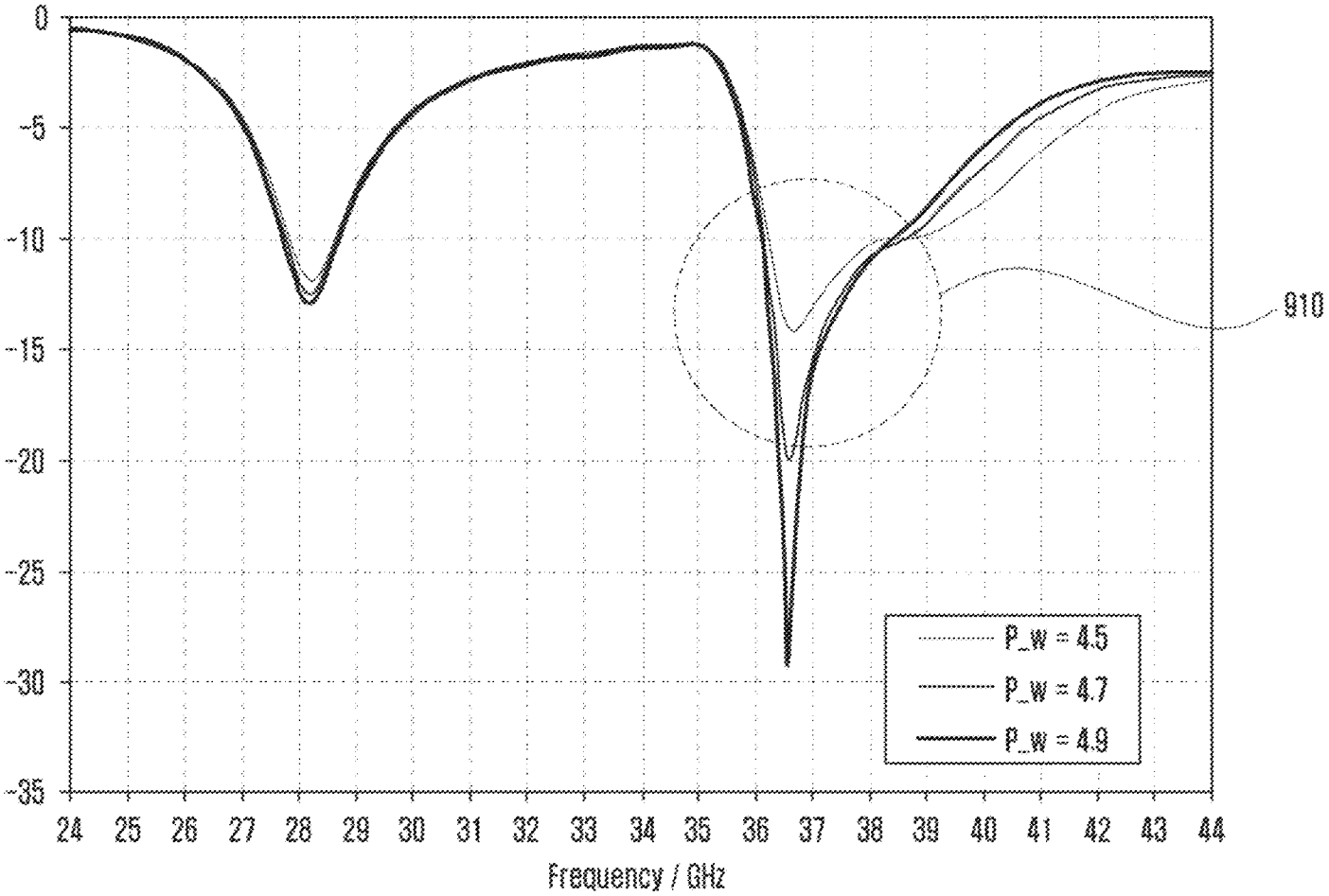
FIG. 9G is a graph illustrating frequency change relationships in accordance with a change of a partial structure of an antenna structure according to an embodiment of the disclosure.
Figure 911:
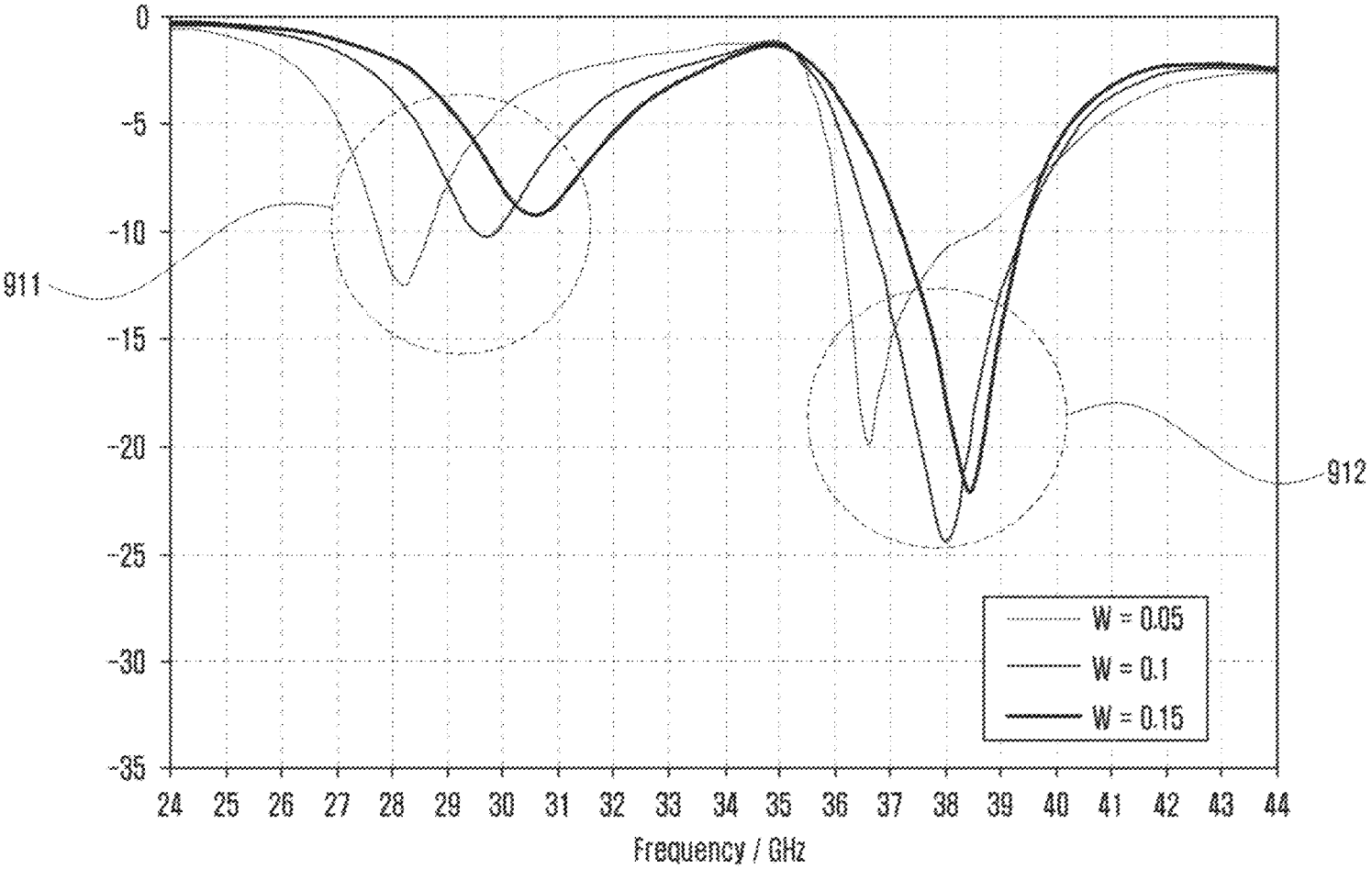

Referring to FIGS. 9F and 9G, they are graphs illustrating a reflection coefficient of an antenna structure (e.g., antenna structure R2 of FIG. 8C) in accordance with the changes of the projection length (e.g., projection length P_h of FIG. 8C) and the width (e.g., width P_w of FIG. 8C) of the first conductive layer (e.g., first conductive layer 520 of FIG. 8C). For example, the second conductive layer (e.g., second conductive layer 530 of FIG. 8B) may also be changed corresponding to the first conductive layer 520.

Referring to FIG. 9F, according to the antenna structure R2, the first frequency band (e.g., low band) has a small change width in accordance with the projection length P_h of the first conductive layer 520, and the second frequency band (e.g., high band) is shifted to the designated frequency band. For example, as the projection length P_h of the first conductive layer 520 becomes larger, the operating frequency band is shifted to the low frequency band (region 909).

Referring to FIG. 9G, according to the antenna structure R2, the impedance characteristic for the bandwidth change of the second frequency band (e.g., high band) is changed in accordance with the change of the width P_w of the first conductive layer 520 (region 910).

Figure 9I:
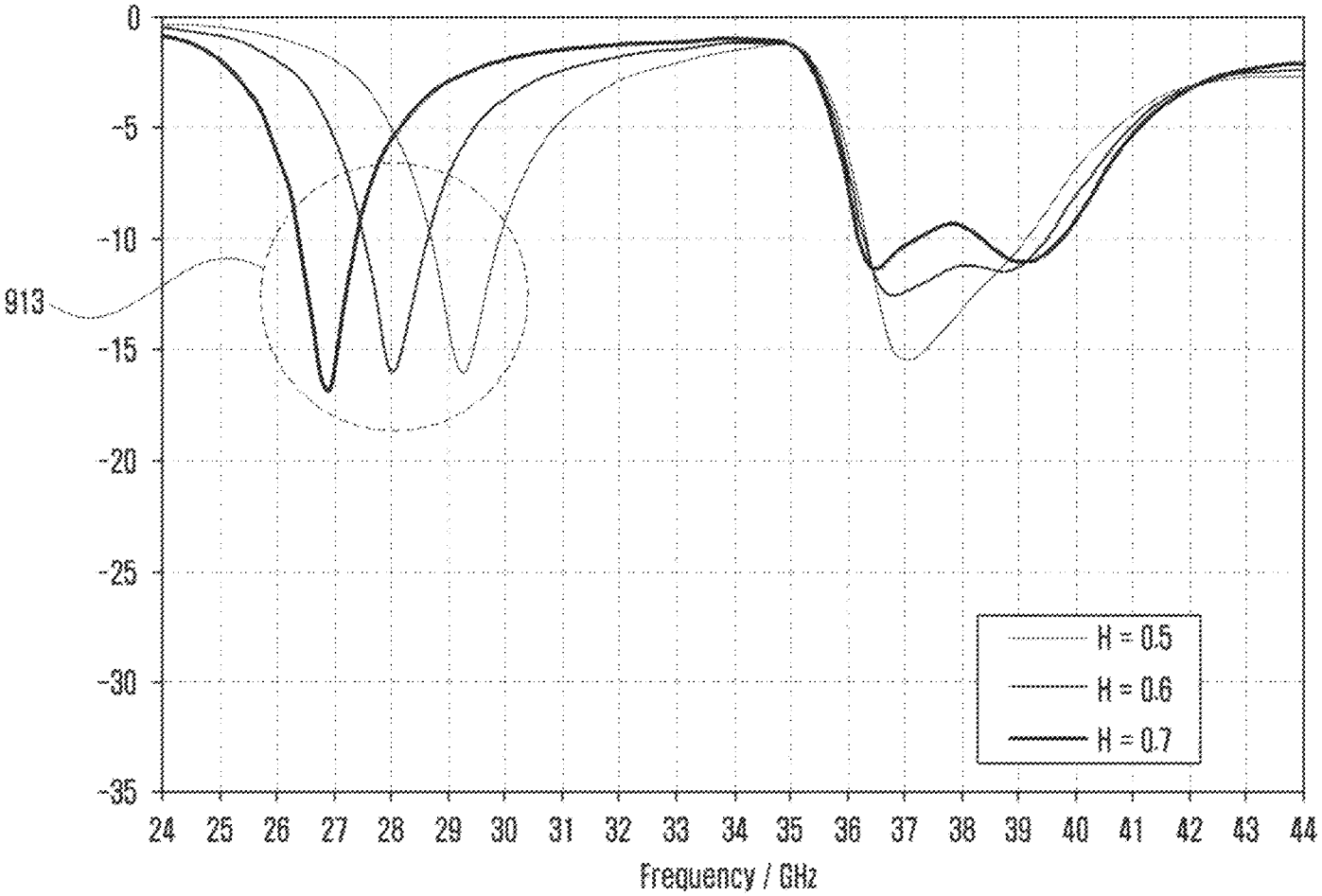
FIG. 9I is a graph illustrating frequency change relationships in accordance with a change of a partial structure of an antenna structure according to an embodiment of the disclosure.

Referring to FIGS. 9H and 9I, they are graphs illustrating a reflection coefficient of an antenna structure (e.g., antenna structure R2 of FIG. 8C) in accordance with the changes of the interval (e.g., interval W of FIG. 8C) and the projection length (e.g., projection length H of FIG. 8C) of the first U-shaped slot 521. For example, the second U-shaped slot (e.g., second U-shaped slot 531 of FIG. 8B) may also be changed corresponding to the first U-shaped slot 521.

Although not illustrated, because the change of the first frequency band and the second frequency band in accordance with the change of the width (e.g., width L of FIG. 8C) of the first U-shaped slot 521 has been unprepared, the corresponding graph has been omitted.

Referring to FIG. 9H, according to the antenna structure R2, the operating frequency bands of the first frequency band (e.g., low band) and the second frequency band (e.g., high band) are changed together in accordance with the change of the interval W of the first U-shaped slot 521. For example, as the interval W of the first U-shaped slot 521 becomes larger, the antenna structure R2 is shifted from the first frequency band and the second frequency band to the high frequency band (regions 911 and 912).

Referring to FIG. 9I, according to the antenna structure R2, the second frequency band (e.g., high band) has a small change width in accordance with the change of the projection length H of the first U-shaped slot 521, and the first frequency band (e.g., low band) is shifted to the designated frequency band. For example, as the projection length H is lengthened, the first frequency band is shifted to the low frequency band (region 913).

Figure 9J:
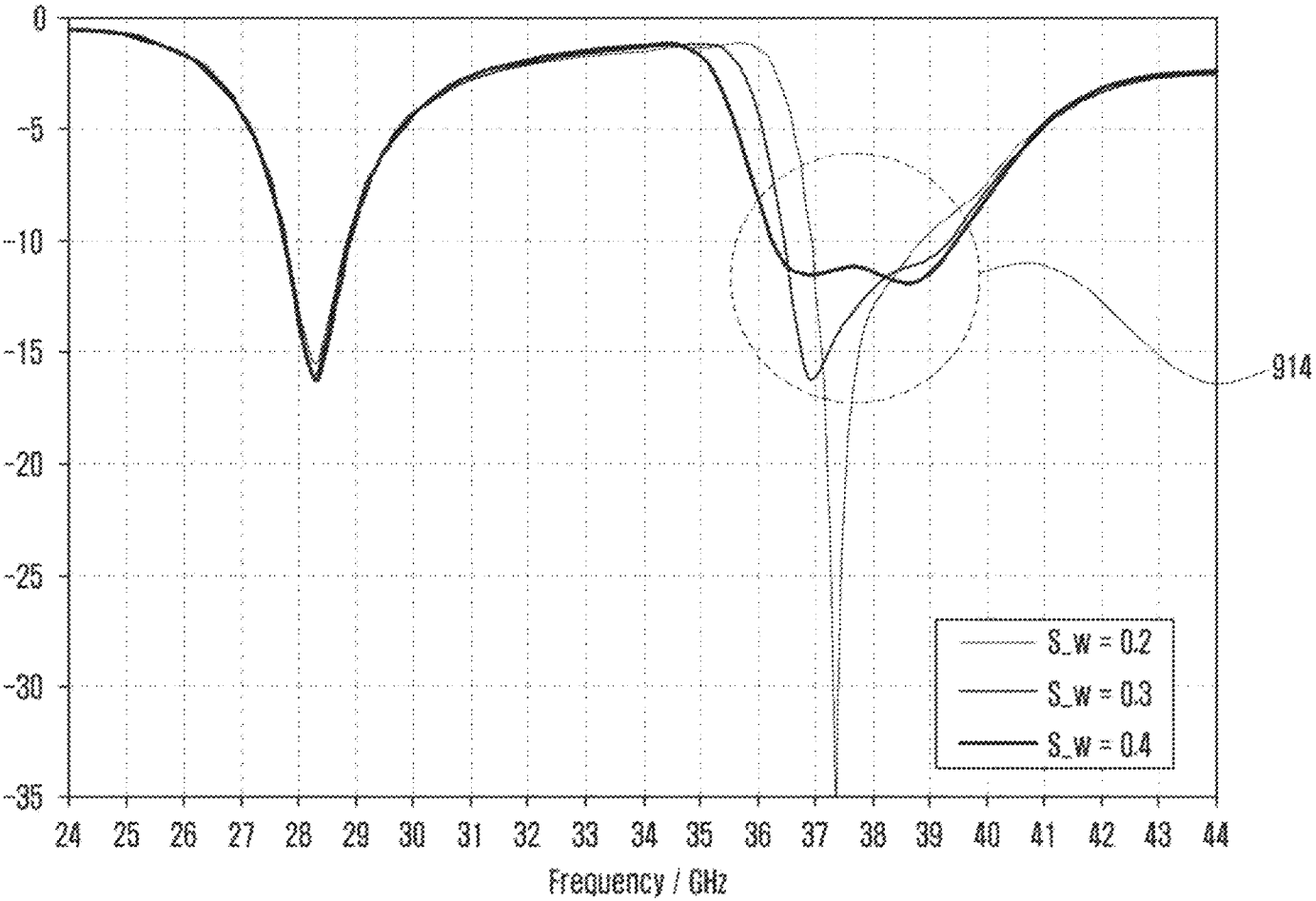
FIG. 9J is a graph illustrating frequency change relationships in accordance with a change of a partial structure of an antenna structure according to an embodiment of the disclosure.
Figure 9K:
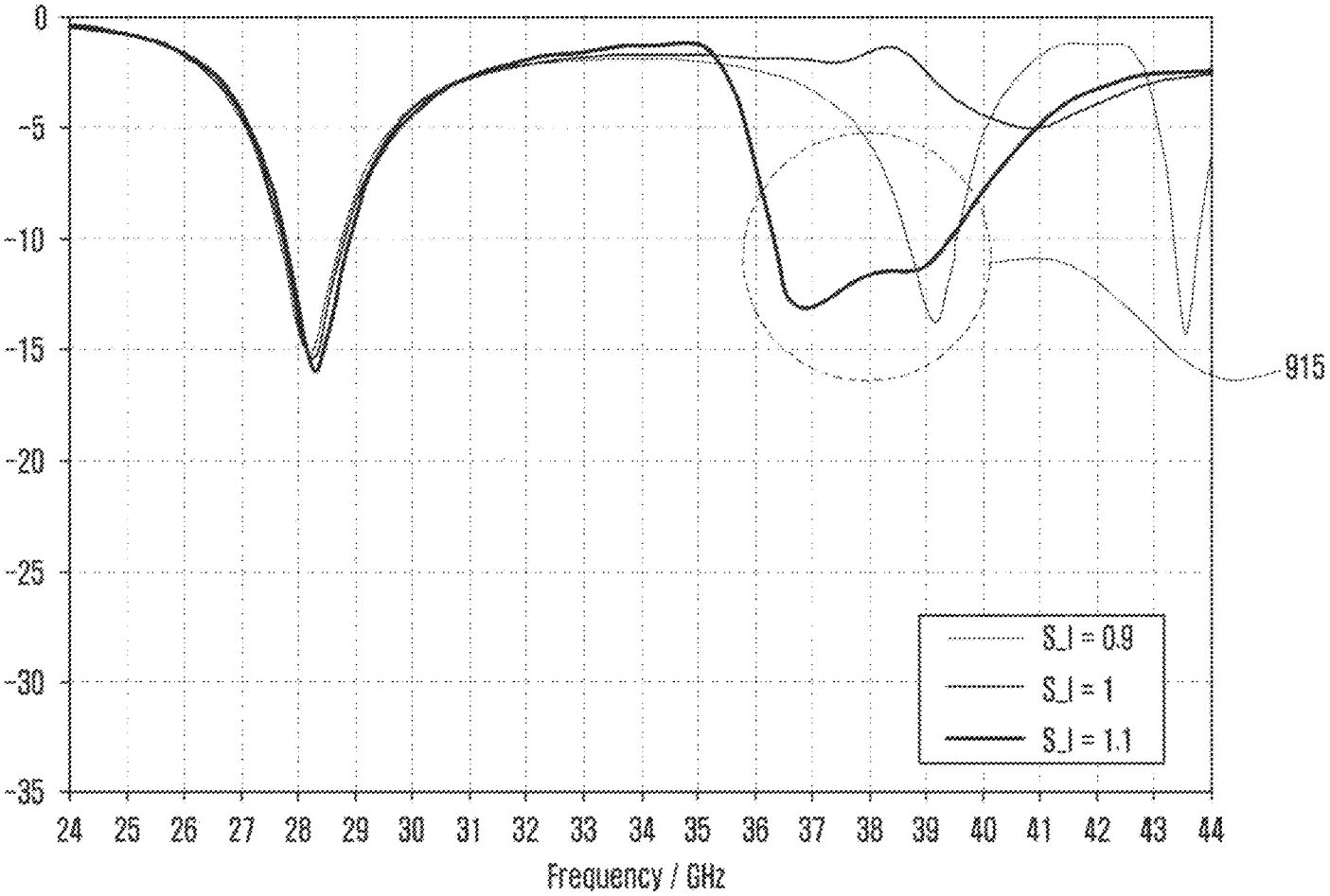
FIG. 9K is a graph illustrating frequency change relationships in accordance with a change of a partial structure of an antenna structure according to an embodiment of the disclosure.
Figure 9L:
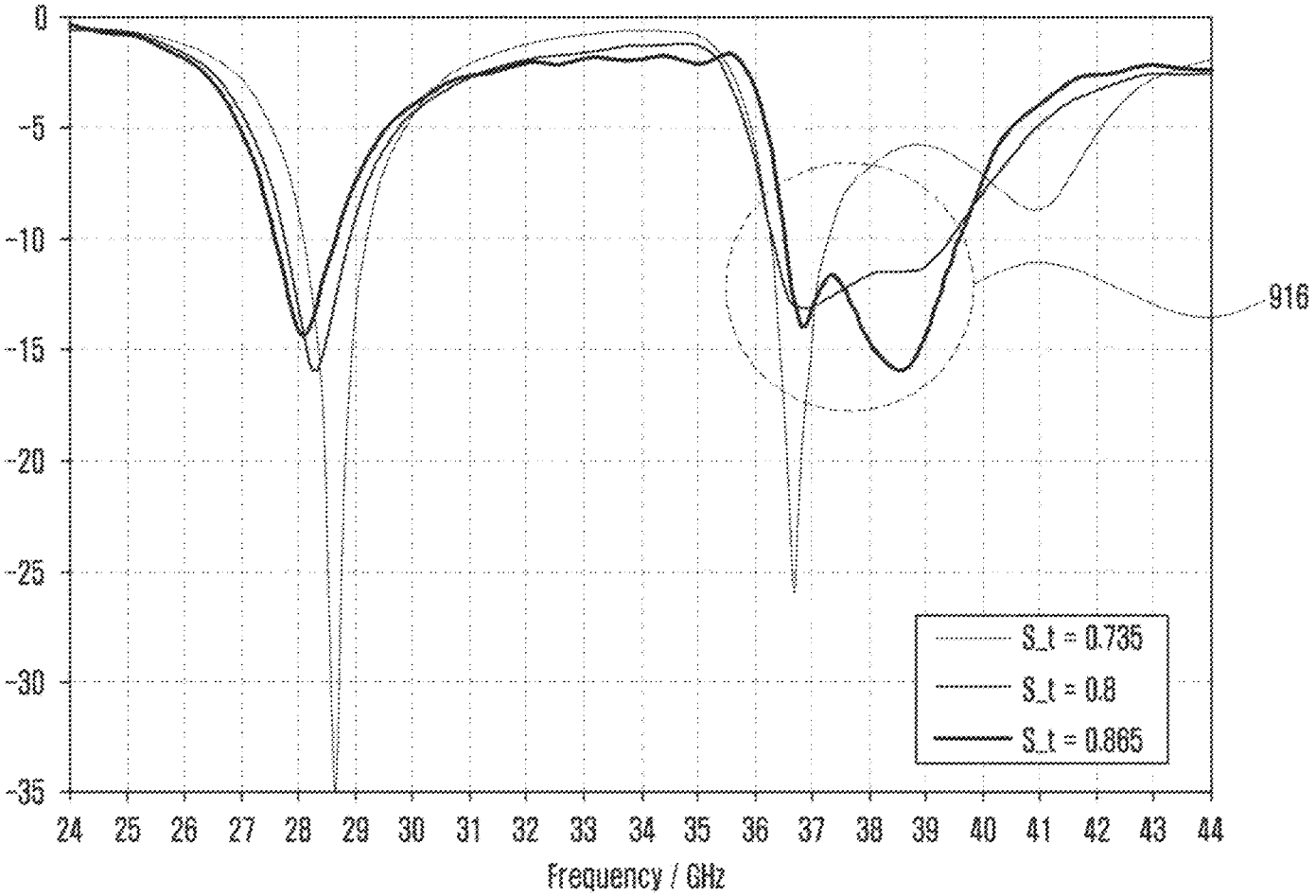
FIG. 9L is a graph illustrating frequency change relationships in accordance with a change of a partial structure of an antenna structure according to an embodiment of the disclosure.

Referring to FIGS. 9J to 9L, they are graphs illustrating a reflection coefficient of an antenna structure (e.g., antenna structure R2 of FIG. 8C) in accordance with the change of the structure of the third conductive layer (e.g., third conductive layer 560 of FIG. 8C).

Referring to FIG. 9J, according to the antenna structure R2, the first frequency band (e.g., low band) has a small change width in accordance with the width (e.g., width S_w of FIG. 8C) of the first projection part (e.g., first projection part 5611 of FIG. 8C) and the second projection part (e.g., second projection part 5612 of FIG. 8C) of the third conductive layer 560, and the bandwidth of the second frequency band (e.g., high band) may be changed (region 914).

Referring to FIG. 9K, according to the antenna structure R2, the impedance characteristic in the second frequency band (e.g., high band) and the frequency band may be changed in accordance with the change of the distance (e.g., distance S_1 of FIG. 8C) from the first edge (e.g., first edge 561 of FIG. 8C) of the third conductive layer 560 and the inner surface (e.g., inner surface 5421*a* of FIG. 8C) of the second space (e.g., second space 5421 of FIG. 8C) (region 915).

Referring to FIG. 9L, according to the antenna structure R2, the impedance characteristic in the second frequency band (e.g., high band) and the frequency band may be changed in accordance with the change of the height (e.g., height S_t of FIG. 8B) of the third conductive layer (e.g., third conductive layer 560 of FIG. 8B) from the first feeding line (first feeding line 550 of FIG. 8B) (region 916).

Figure 10A:
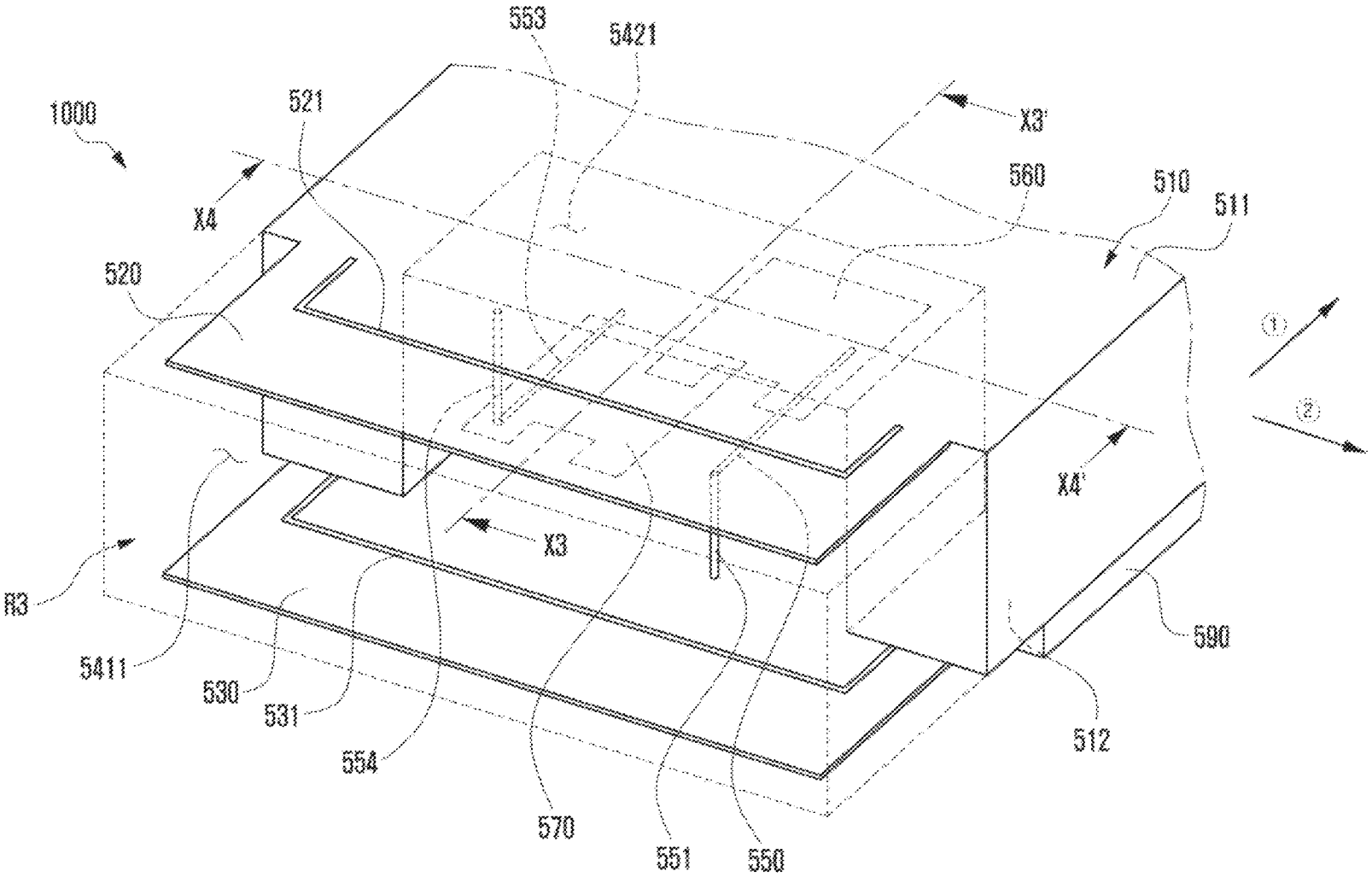
FIG. 10A is a perspective view of an antenna module according to an embodiment of the disclosure.

FIG. 10A is a perspective view of an antenna module according to an embodiment of the disclosure.

Figure 10B:
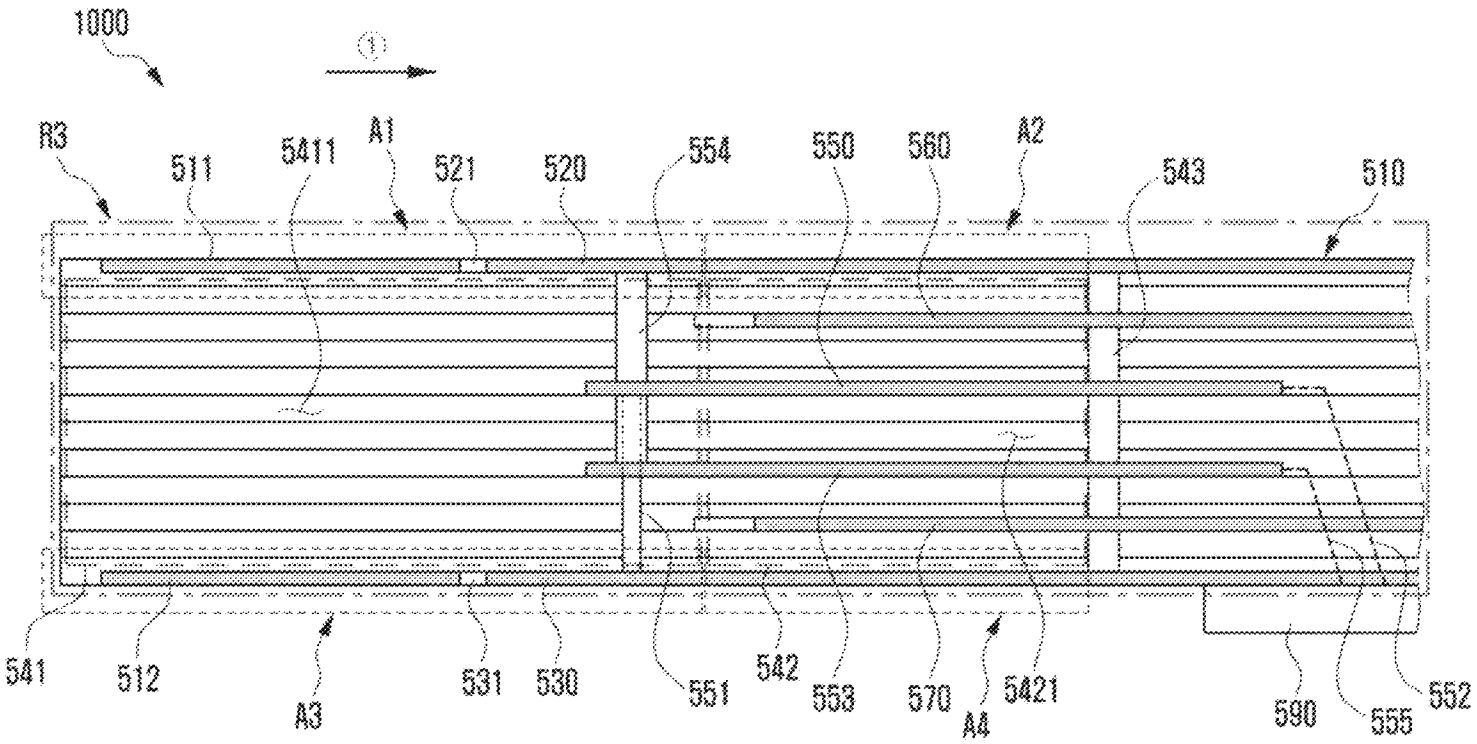
FIG. 10B is a cross-sectional view illustrating a laminated structure of an antenna module of FIG. 10A according to an embodiment of the disclosure.

FIG. 10B is a cross-sectional view illustrating a laminated structure of an antenna module of FIG. 10A according to an embodiment of the disclosure.

Figure 10C:
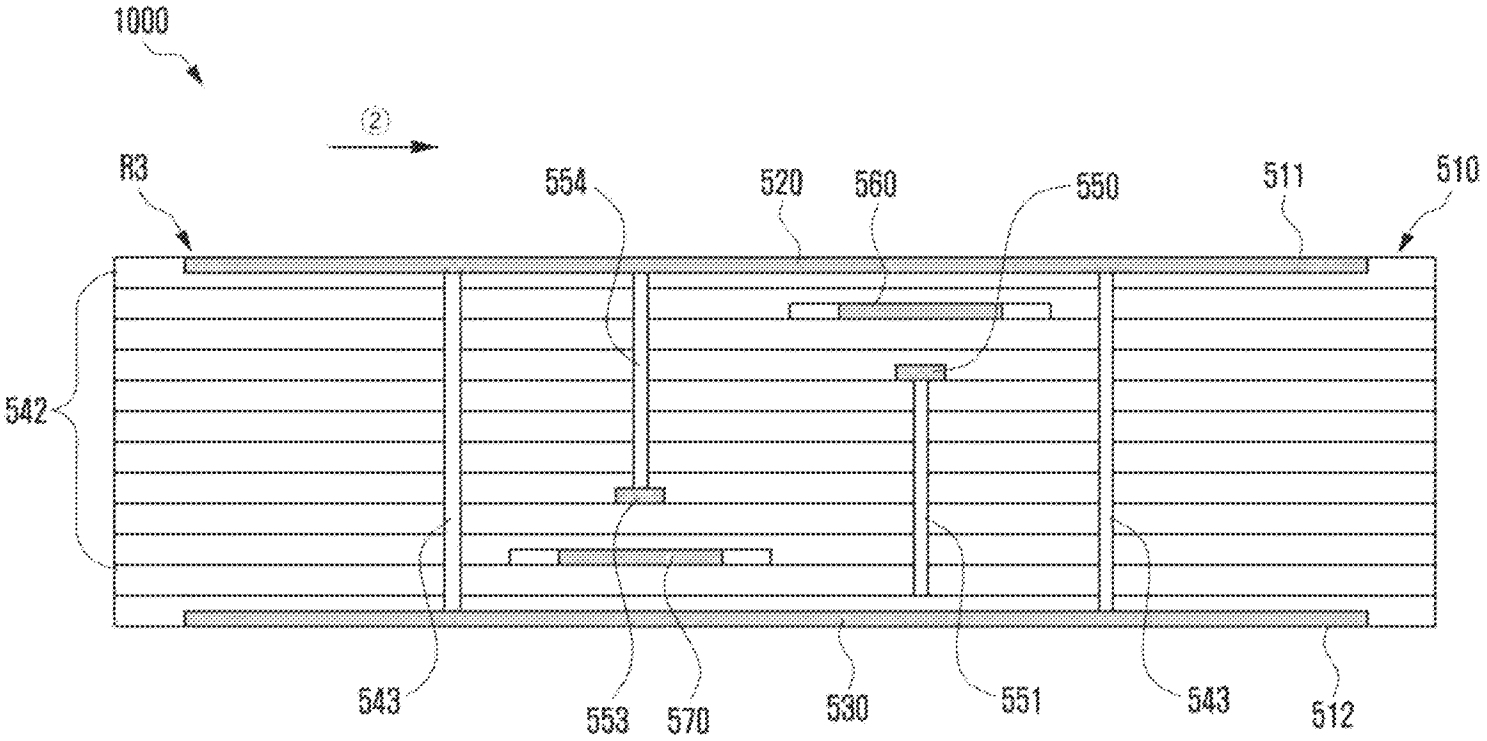
FIG. 10C is a cross-sectional view of a laminated structure of an antenna module of FIG. 10A as seen in another direction according to an embodiment of the disclosure.

FIG. 10C is a cross-sectional view of a laminated structure of an antenna module of FIG. 10A as seen in another direction according to an embodiment of the disclosure. FIG. 10B is a cross-sectional view through partial projection of a primary structure of the antenna module 1000 as seen in the direction of a line X3-X3' of FIG. 10A, and FIG. 10C is a cross-sectional view through partial projection of a primary structure of the antenna module 1000 as seen in the direction of a line X4-X4' of FIG. 10 OA.

In describing various embodiments of the disclosure, the same reference numerals are used for the same constituent elements as the above-described constituent elements, and the detailed explanation thereof may be omitted.

The antenna module 1000 of FIG. 10A may be at least partly similar to the third antenna module 246 of FIG. 2, or it may further include other embodiments of the antenna module.

Referring to FIGS. 10A to 10C, the antenna module 1000 may include an antenna structure R3. According to an embodiment, the antenna structure R3 may include a first conductive layer 520 including a first U-shaped slot 521 and a second conductive layer 530 including a second U-shaped slot 531. According to an embodiment, between the first conductive layer 520 and the second conductive layer 530, a third conductive layer 560 may be deployed substantially in parallel to the first conductive layer 520, and it may be deployed to have a smaller area than the area of the first conductive layer 520 as seen from the upside of the first conductive layer 520. According to an embodiment, in a layer that is not equal to the third conductive layer 560 between the first conductive layer 520 and the second conductive layer 530, a fourth conductive layer 570 may be deployed substantially in parallel to the first conductive layer 520, may have a smaller area than the area of the first conductive layer 520 as seen from the upside of the first conductive layer 520, and may be deployed in a location that does not overlap the third conductive layer 560. According to an embodiment, the third conductive layer 560 and the fourth conductive layer 570 may be deployed in line with each other without overlapping each other as seen from the upside of the first conductive layer 520. According to an embodiment, at least a part of the third conductive layer 560 and/or the fourth conductive layer 570 may be formed within the second space 5421. According to an embodiment, the fourth conductive layer 570 may be formed to have substantially the same size and shape as those of the third conductive layer 560. As another embodiment, the third conductive layer 560 and the fourth conductive layer 570 may be deployed to at least partly overlap each other as seen from the upside of the first conductive layer 520. According to an embodiment, the wireless communication circuitry 590 may be configured to transmit and/or receive a signal having the frequency in the range of 3 GHz to 100 GHz through the antenna structure R3.

According to various embodiments, the antenna structure R3 may include the first feeding line 550 at least partly deployed between the third conductive layer 560 and the second conductive layer 530. According to an embodiment, one end of the first feeding line 550 may be electrically connected to the second conductive layer 520 through the first feeding part (e.g., conductive via) 551, and the other end thereof may be electrically connected to the wireless communication circuitry 590 through the first feeder 552. According to an embodiment, the antenna structure R3 may include the second feeding line 553 at least partly deployed between the first conductive layer 520 and the fourth conductive layer 570. According to an embodiment, one end of the second feeding line 553 may be electrically connected to the first conductive layer 520 through the second feeding part (e.g., conductive via) 554, and the other end thereof may be electrically connected to the wireless communication circuitry 590 through the second feeder 555.

According to various embodiments, the third conductive layer 560 may be deployed between the second region A2 of the first conductive layer 520 and the first feeding line 550. According to an embodiment, the third conductive layer 560 may be deployed in a capacitively coupled location with the first feeding line 550. According to an embodiment, the third conductive layer 560 may be deployed substantially in the second dielectric material 542. As another embodiment, at least a part of the third conductive layer 560 may be deployed to extend into the first dielectric material 541.

According to various embodiments, the fourth conductive layer 570 may be deployed between the fourth region A4 of the second conductive layer 530 and the second feeding line 553. According to an embodiment, the fourth conductive layer 570 may be deployed in a capacitively coupled location with the second feeding line 553. According to an embodiment, the fourth conductive layer 570 may be deployed substantially in the second dielectric material 542. As another embodiment, at least a part of the fourth conductive layer 570 may be deployed to extend into the first dielectric material 541.

According to various embodiments, the antenna structure R3 may increase a radiation output of the antenna module corresponding to the frequency input by the third conductive layer 560 deployed between the first conductive layer 520 and the first feeding line 550, the fourth conductive layer 570 deployed in symmetry with the third conductive layer 560 and deployed between the second conductive layer 530 and the second feeding line 553, and the first feeding line 550 and the second feeding line 553 being fed in symmetry with each other.

Figure 10D:
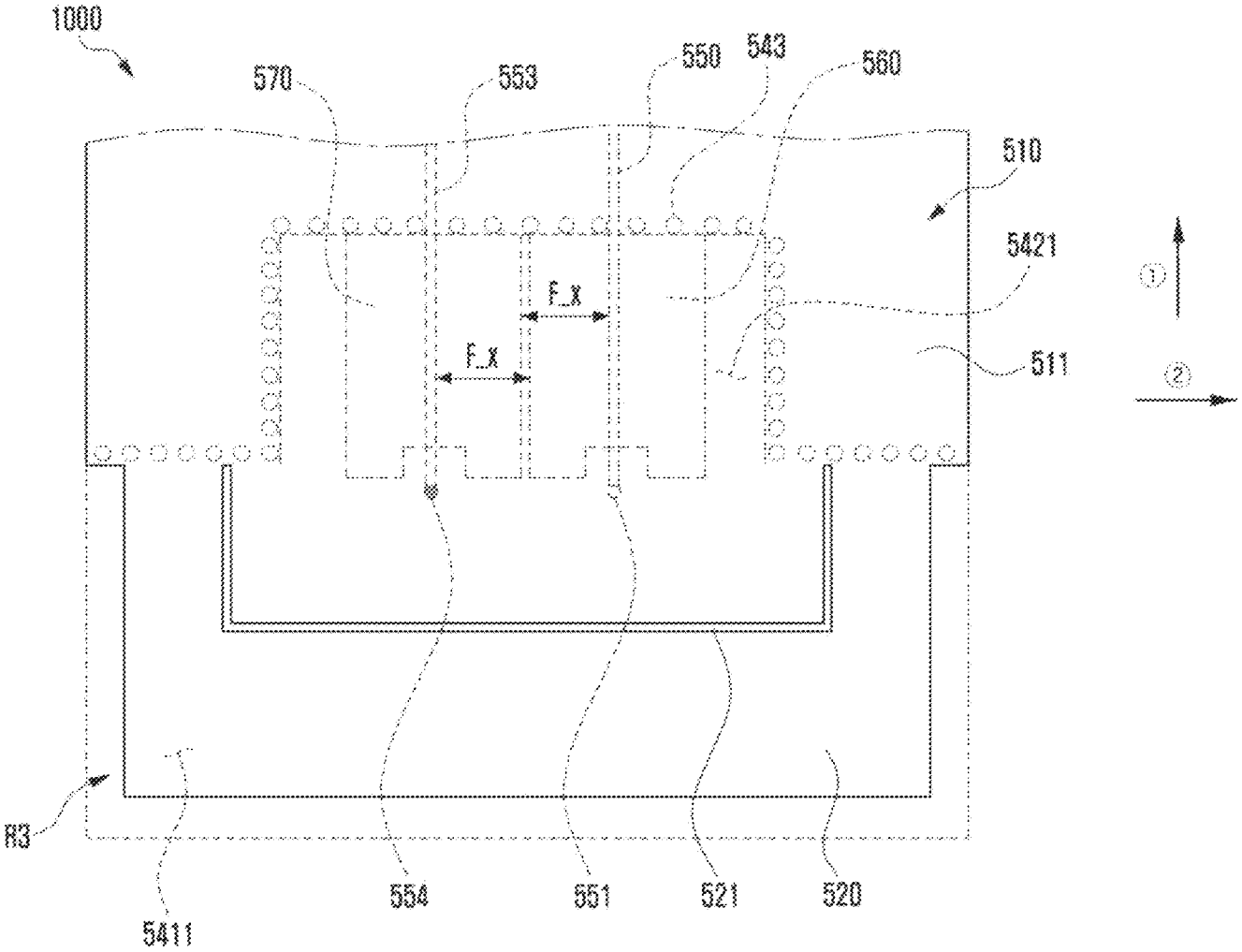
FIG. 10D is a plan view illustrating a state where an antenna module of FIG. 10A is partially projected according to an embodiment of the disclosure.

FIG. 10D is a plan view illustrating a state where an antenna module of FIG. 10A is partially projected according to an embodiment of the disclosure.

Referring to FIG. 10D, the antenna module may be antenna module 1000 and the third conductive layer 560 and the fourth conductive layer 570 may be deployed in line with each other without overlapping each other as seen from the upside of the first conductive layer 520. According to an embodiment, the first feeding line 550 may be deployed substantially to cross the center of the third conductive layer 560 in the first direction (① direction) as seen from the upside of the first conductive layer 520. According to an embodiment, the second feeding part 553 may be deployed substantially to cross the center of the fourth conductive layer 570 in the first direction (① direction) as seen from the upside of the first conductive layer 520.

According to various embodiments, the antenna structure R3 may have a differential feeding structure deployed in symmetry with the two feeding lines 550 and 553, and because dual feeding is performed through the two feeding lines 550 and 553, the number of input ports is increased twice to increase an input power being applied to the antenna structure R3, and thus the output power of the antenna module may be increased.

Figure 11A:
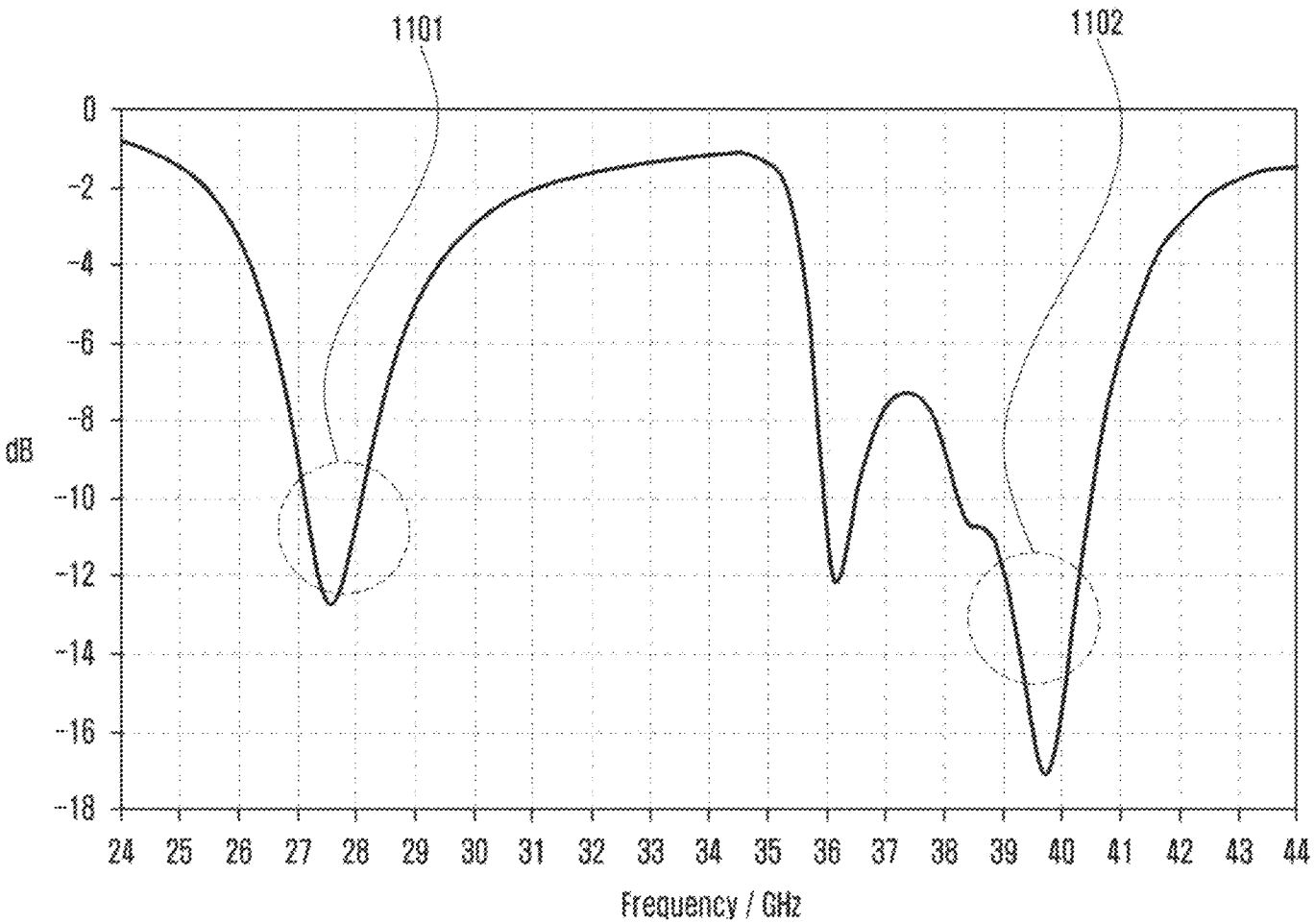
FIG. 11A is a graph illustrating a reflection coefficient of an antenna module of FIG. 10A according to an embodiment of the disclosure.

FIG. 11A is a graph illustrating a reflection coefficient of an antenna module of FIG. 10A according to an embodiment of the disclosure.

FIG. 11B is a diagram illustrating a radiation pattern for each frequency of an antenna module of FIG. 10A according to an embodiment of the disclosure.

Referring to FIGS. 11A and 11B, the antenna module may be antenna module 1000 and the antenna structure (e.g., antenna structure R3 of FIG. 10A) may include the first U-shaped slot (e.g., first U-shaped slot 521 of FIG. 10A), the second U-shaped slot (e.g., second U-shaped slot 531 of FIG. 10A), the third conductive layer (e.g., third conductive layer 560 of FIG. 10A), and the fourth conductive layer (e.g., fourth conductive layer 570 of FIG. 10A), and the antenna structure may have a differential structure capable of smoothly operating in the first frequency band (e.g., about 28 GHz frequency band) (e.g., region 1101) and the second frequency band (e.g., about 39 GHz frequency band) (e.g., region 1102) even in the case of dual feeding.

Figure 11C:
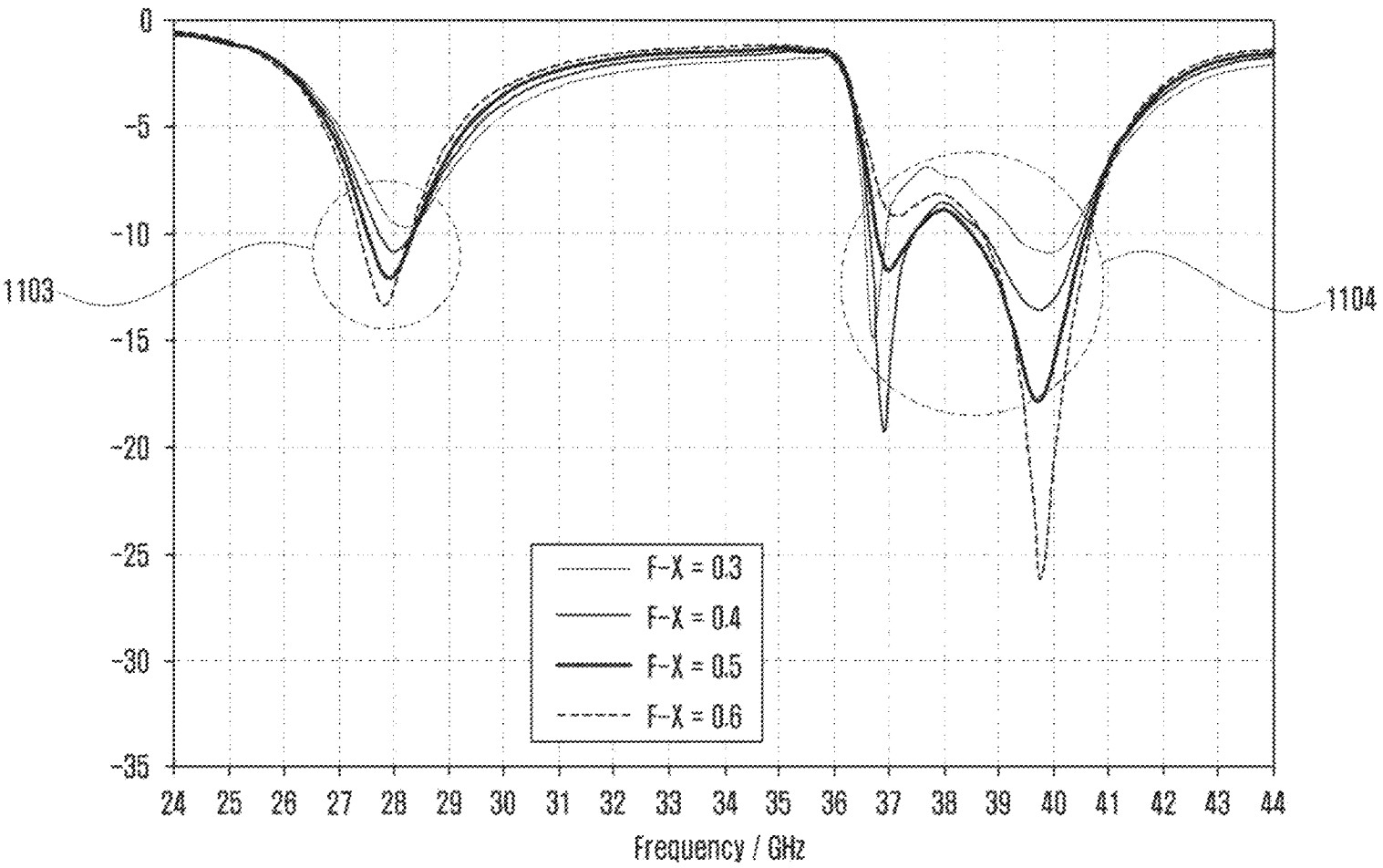
FIG. 11C is a graph illustrating a reflection coefficient of an antenna module in accordance with a deployment relationship between a third conductive layer and a fourth conductive layer according to an embodiment of the disclosure.

FIG. 11C is a graph illustrating a reflection coefficient of an antenna module 1000 in accordance with a deployment relationship between a third conductive layer 560 and a fourth conductive layer 570 according to an embodiment of the disclosure.

Referring to FIGS. 10D and 11C, the performance change of the antenna module 1000 may occur in accordance with the distance F_x between the first feeding line 550 and the fourth conductive layer 570 and/or the change of the distance F_x between the second feeding line 553 and the third conductive layer 560 as seen from the upside of the first conductive layer 520. For example, as the distance F_x between the first feeding line 550 and the fourth conductive layer 570 and/or the distance F_x between the second feeding line 553 and the third conductive layer 560 become closer, the performance of the antenna module is deteriorated in the first frequency band (e.g., low band) and the second frequency band (e.g., high band) (regions 1103 and 1104). Accordingly, it may be advantageous in the performance of the antenna module to separate the third conductive layer 560 and the fourth conductive layer 570 from each other as far as possible.

Figure 12A:
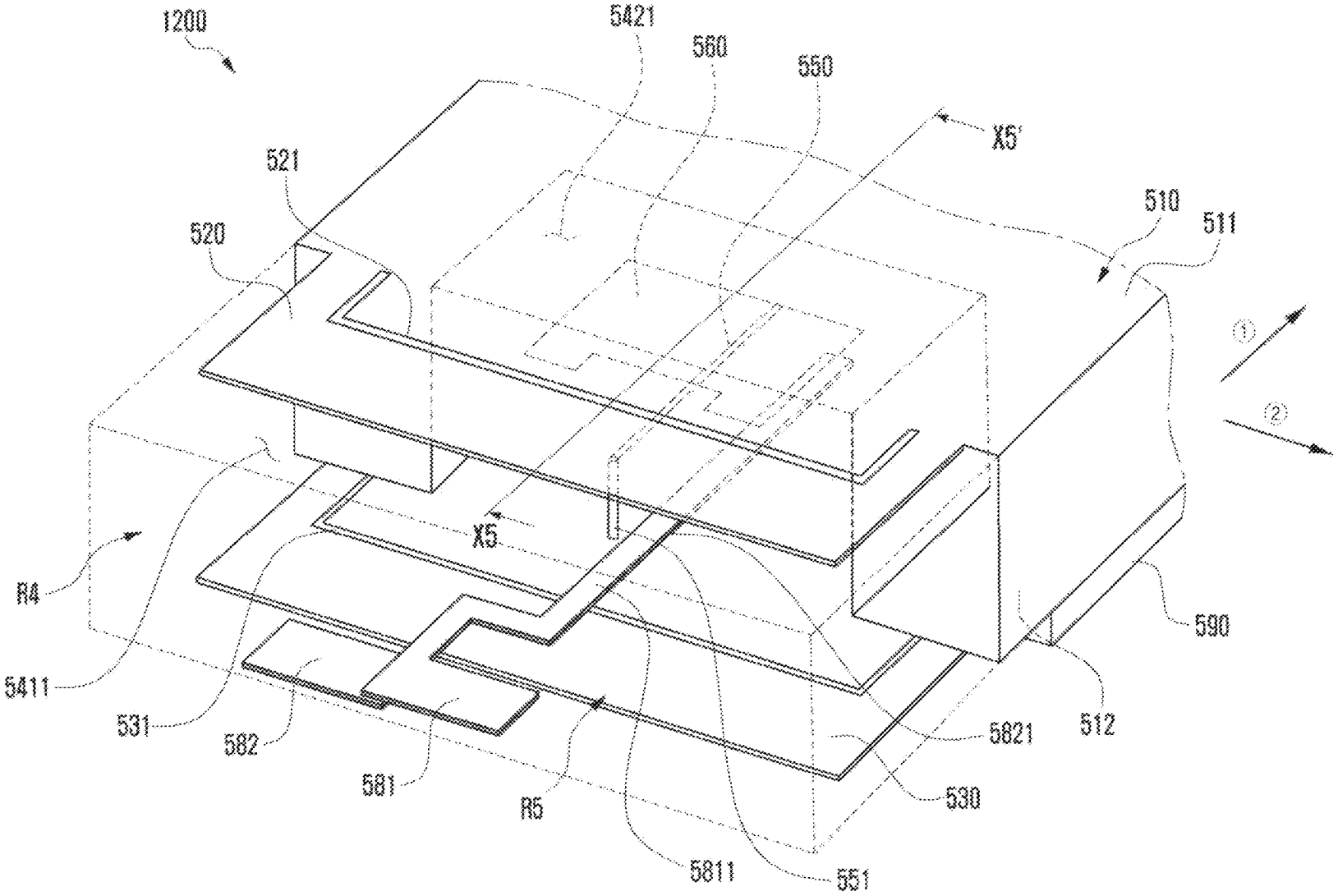
FIG. 12A is a perspective view of an antenna module according to an embodiment of the disclosure.

FIG. 12A is a perspective view of an antenna module according to an embodiment of the disclosure. The antenna module may be antenna module 1200.

Figure 12B:
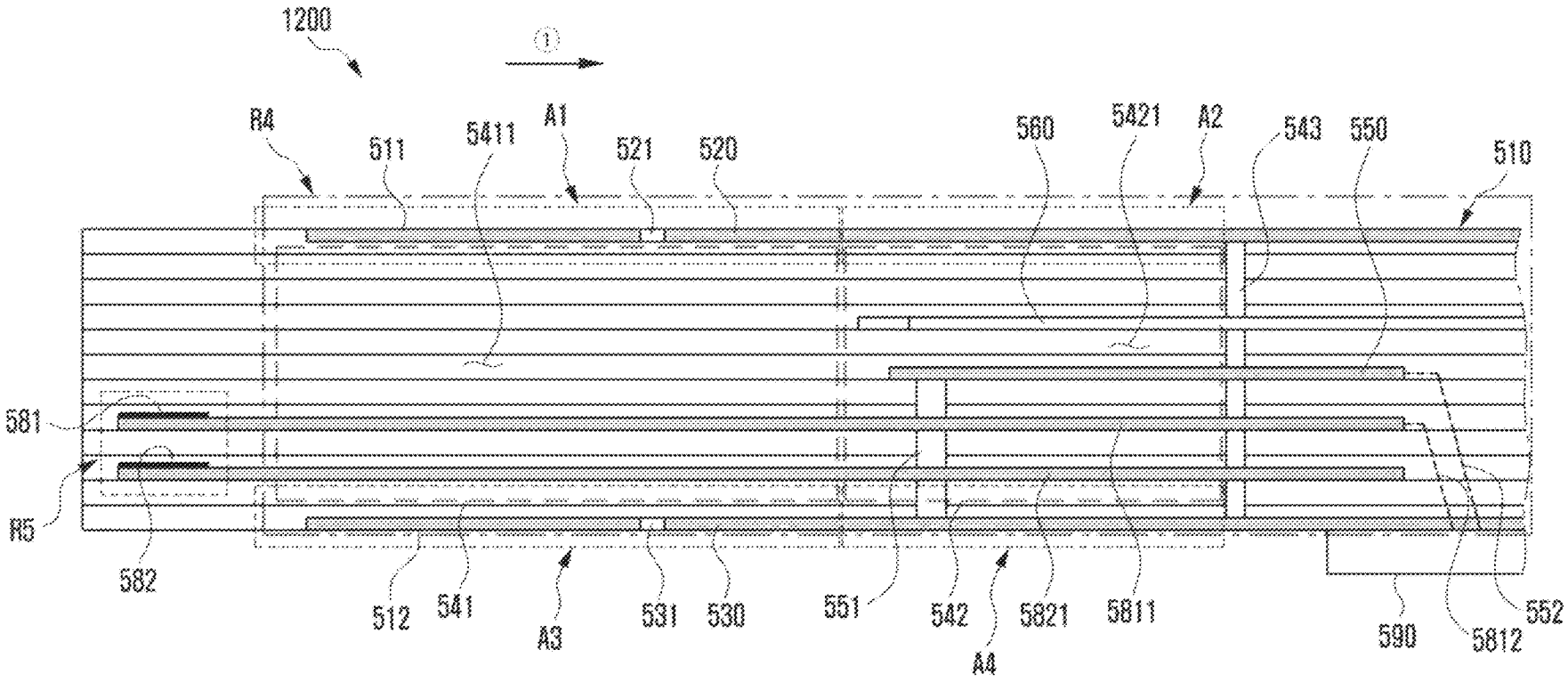
FIG. 12B is a cross-sectional view illustrating a laminated structure of an antenna module of FIG. 12A according to an embodiment of the disclosure.

FIG. 12B is a cross-sectional view illustrating a laminated structure of an antenna module 1200 of FIG. 12A according to an embodiment of the disclosure. FIG. 12B is a cross-sectional view through partial projection of the primary structure of the antenna module 1200 as seen in the direction of line X5-Z5' of FIG. 12A.

In describing various embodiments of the disclosure, the same reference numerals are used for the same constituent elements as the above-described constituent elements, and the detailed explanation thereof may be omitted.

The antenna module 1200 of FIG. 12A may be at least partly similar to the third antenna modules 246 of FIG. 2, or it may further include other embodiments of the antenna module.

Referring to FIG. 12A, the antenna module 1200 may include a first antenna structure R4 and a second antenna structure R5 deployed in the first antenna structure R4. According to an embodiment, the first antenna structure R4 may form vertical polarization by the first conductive layer 520 and the second conductive layer 530 deployed spaced apart from the first conductive layer 520. According to an embodiment, the second antenna structure R5 may include a dipole antenna deployed between the first conductive layer 520 and the second conductive layer 530 to form horizontal polarization. According to an embodiment, the wireless communication circuitry 590 may be configured to transmit and/or receive a signal having the frequency in the range of 3 GHz to 100 GHz through the first antenna structure R4 and the second antenna structure R5.

According to various embodiments, the first antenna structure R4 may include the first conductive layer 520 including the first U-shaped slot 521 and the second conductive layer 530 including the second U-shaped slot 531. According to an embodiment, the third conductive layer 560 may be deployed substantially in parallel to the first conductive layer 520 between the first conductive layer 520 and the second conductive layer 530, and it may be deployed to have a smaller area than the area of the first conductive layer 520 as seen from the upside of the first conductive layer 520. According to an embodiment, the third conductive layer 560 may be deployed between the second region A2 of the first conductive layer 520 and the first feeding line 550. According to an embodiment, the third conductive layer 560 may be deployed in a capacitively coupled location with the first feeding line 550.

According to various embodiments, the second antenna structure R5 may include a pair of conductive patterns 581 and 582 deployed on different layers that are close to the second conductive layer 530 rather than the first feeding line 550. According to an embodiment, the pair of conductive patterns 581 and 582 may be deployed substantially in parallel to the first conductive layer 520. According to an embodiment, the second antenna structure R5 may include the first conductive pattern 581 formed at an end portion of the first conductive line 5811 extending from the second space 5421 to at least a part of the first space 5411. According to an embodiment, the second antenna structure R5 may include the second conductive line 5821 deployed to overlap the first conductive line 5811 as seen from the upside of the first conductive layer 520, and at an end portion of the second conductive line 5821, the second conductive pattern 582 may be deployed to at least partly overlap the first conductive pattern 581. According to an embodiment, the first conductive line 5811 may be electrically connected to the wireless communication circuitry 590 through the third feeder 5812 in the second space 5421. According to an embodiment, the first conductive pattern 581 and the second conductive pattern 582 may be deployed in an extended location to pass through the first U-shaped slit 521 of the first conductive layer 520 in the direction of the first region A1 from the second region A2 in the first space 5411 as seen from the upside of the first conductive layer 520.

According to various embodiments, the first antenna structure R4 may operate in the first frequency band and the second frequency band through the first conductive layer 520 and the second conductive layer 530 deployed spaced apart from each other between the first feeding line 550 and the third conductive layer 560. According to an embodiment, the second antenna structure R5 may operate in the first frequency band and the second frequency band through the conductive patterns 581 and 582 deployed at each end portion of a pair of conductive lines 5811 and 5821 deployed between the first feeding line 550 and the second conductive layer 530.

According to various embodiments, the first conductive pattern 581 and the second conductive pattern 582 of the second antenna structure R5 may be deployed not to overlap the first conductive layer 520 and the second conductive layer 530 of the first antenna structure R4 as seen from the upside of the first conductive layer 520.

Figure 12C:
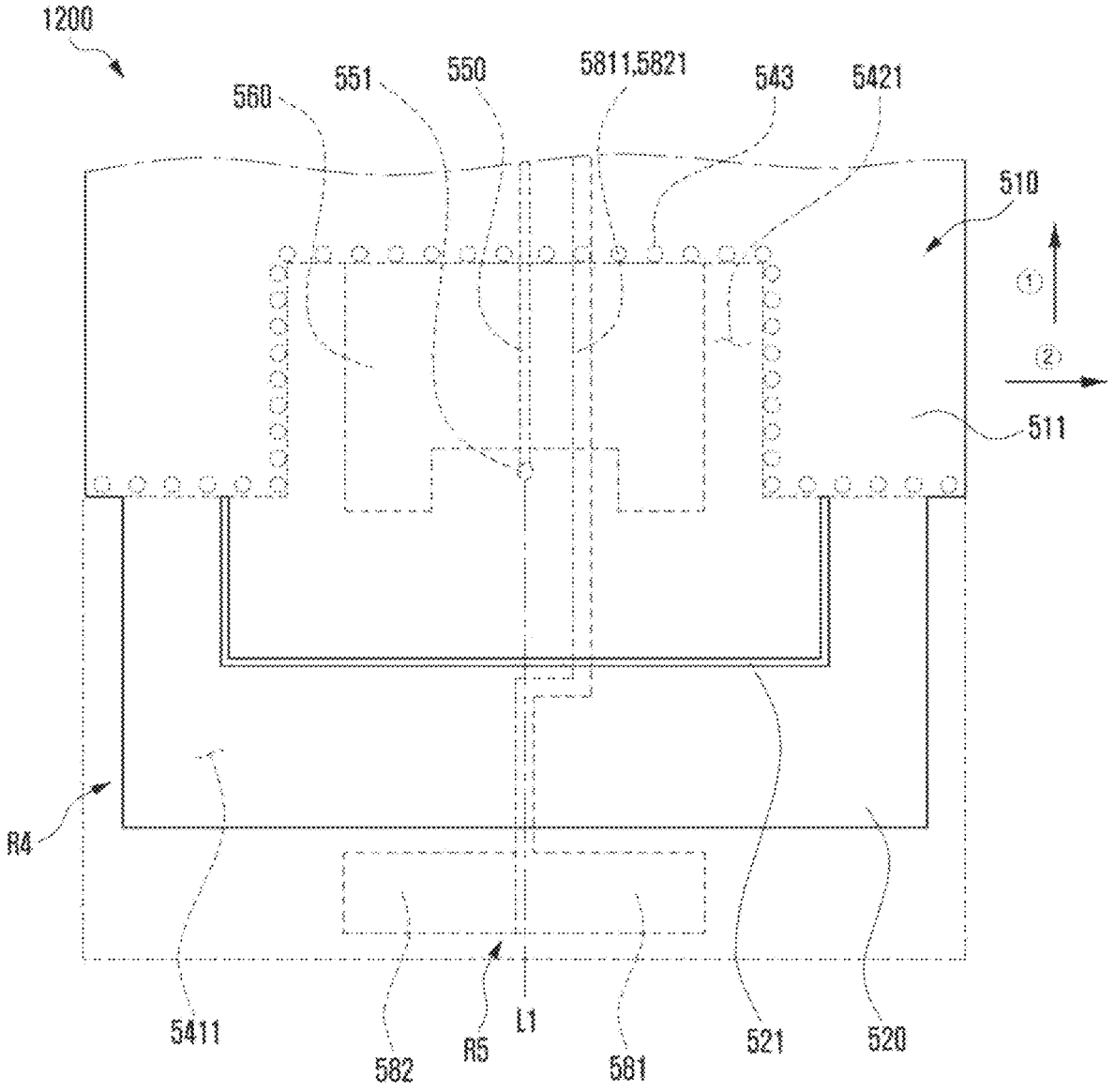
FIG. 12C is a plan view illustrating a state where an antenna module of FIG. 12A is partially projected according to an embodiment of the disclosure.

FIG. 12C is a plan view illustrating a state where an antenna module of FIG. 12A is partially projected according to an embodiment of the disclosure.

Referring to FIG. 12C, the antenna module may be antenna module 1200 and the third conductive layer 560 may be deployed substantially in the center of the second space 5421 as seen from the upside of the first conductive layer 520. According to an embodiment, the first feeding line 550 may be deployed substantially to cross the center of the third conductive layer 560 in the first direction (① direction) as seen from the upside of the first conductive layer 520. According to an embodiment, the pair of conductive lines 5811 and 5821 of the second antenna structure R5 may be deployed to bypass the first feeding line 550 in order to avoid interference with the first feeding line 550. For example, the pair of conductive lines 5811 and 5821 may be formed to be longer than the first feeding line 550, and after bypassing the first feeding line 550, they may go again to a virtual line L1 through which the first feeding line 550 passes. Accordingly, the first conductive pattern 581 and the second conductive pattern 582 may be deployed in symmetric locations based on the virtual line L1 through which the first feeding line 550 passes. As another embodiment, the second antenna structure R5 may be included in the same manner in the antenna structure (e.g., antenna structure R1 of FIG. 5A) including only the first U-shaped slot 521 and the second U-shaped slot 531 in which the third conductive layer 560 is not included.

Figure 13A:
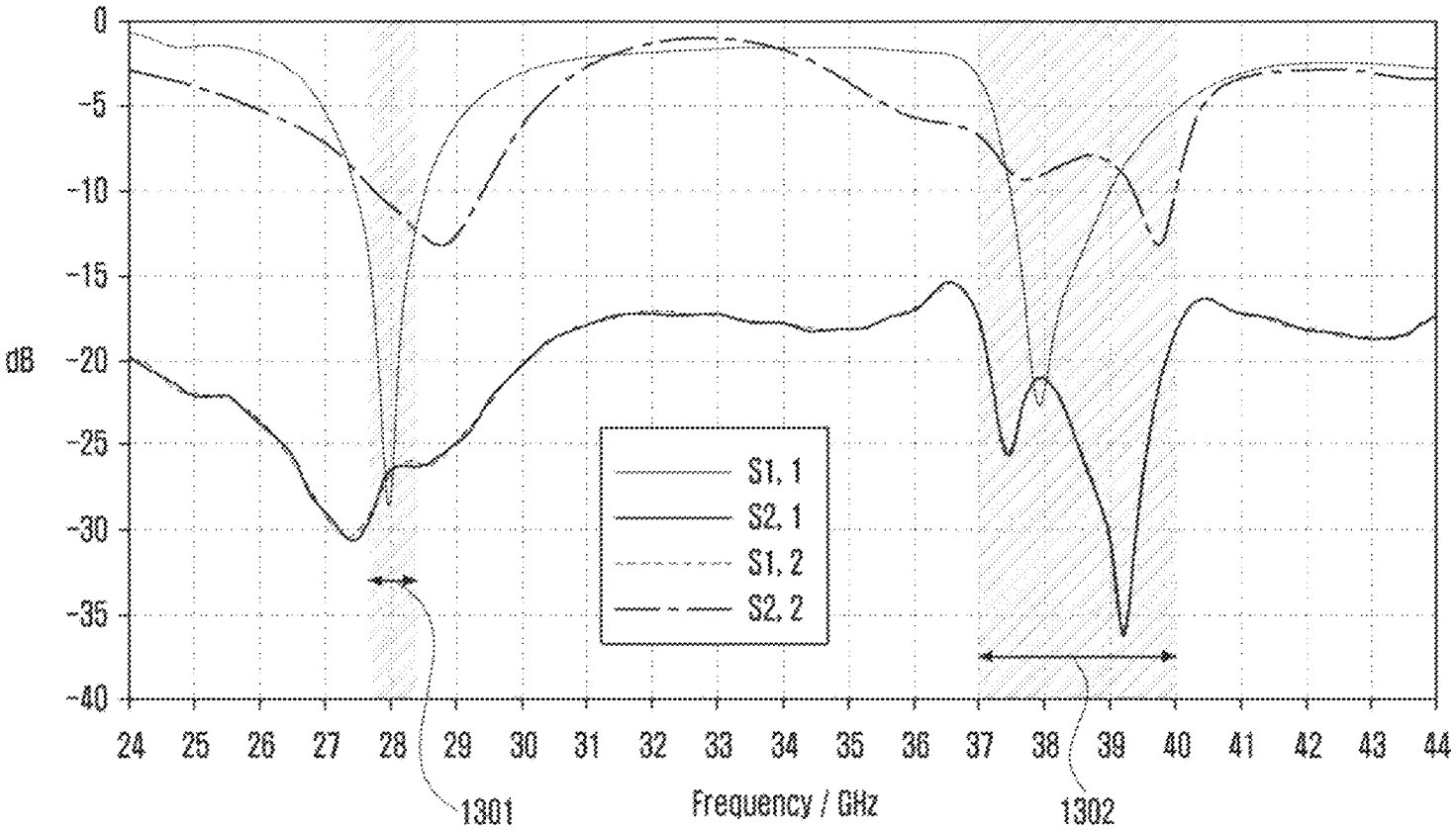
FIG. 13A is a graph illustrating a reflection coefficient of an antenna module of FIG. 12A according to an embodiment of the disclosure.

FIG. 13A is a graph illustrating a reflection coefficient of an antenna module of FIG. 12A according to an embodiment of the disclosure.

Figure 13B:
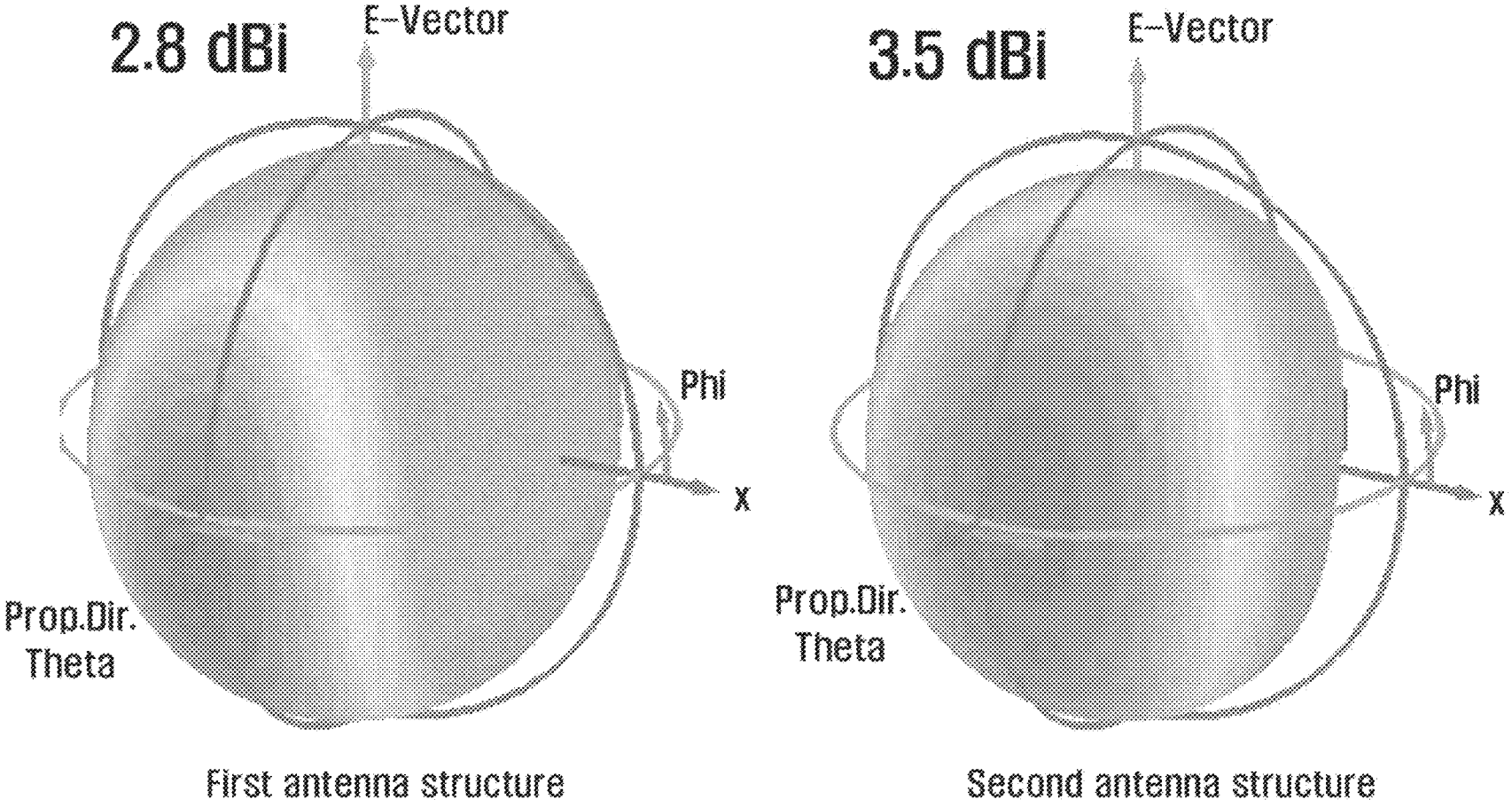
FIG. 13B is a diagram illustrating a radiation pattern for each frequency of an antenna module of FIG. 12A according to an embodiment of the disclosure.

FIG. 13B is a diagram illustrating a radiation pattern for each frequency of an antenna module of FIG. 12A according to an embodiment of the disclosure. The antenna module of FIGS. 13A and 13B may be antenna module 1200.

Referring to FIGS. 13A and 13B, the antenna module including the first antenna structure R4 and the second antenna structure R5 can operate smoothly in the first frequency band having the bandwidth in the range of about 27.5 GHz to 28.5 GHz (e.g., region 1301 of FIG. 13A), and it can operate smoothly in the second frequency band having the bandwidth in the range of about 37 GHz to 39.9 GHz (e.g., region 1302 of FIG. 13A)

Figure 14:
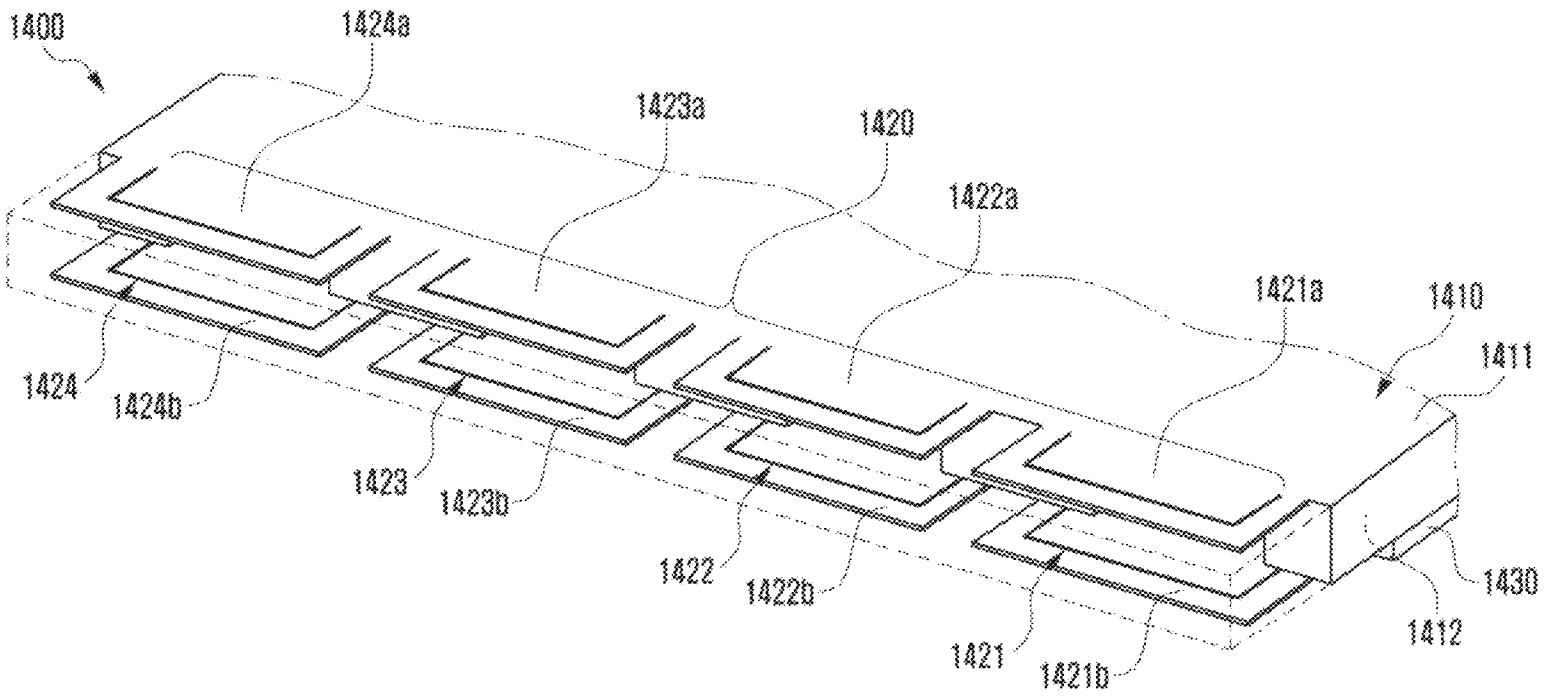
FIG. 14 is a perspective view of an antenna module according to an embodiment of the disclosure.

FIG. 14 is a perspective view of an antenna module according to an embodiment of the disclosure.

The antenna module 1400 of FIG. 14 may be at least partly similar to the third antenna module 246 of FIG. 2, or it may further include other embodiments of the antenna module.

Referring to FIG. 14, the antenna module 1400 may include a printed circuit board 1410, and a first antenna array 1420 including a plurality of antenna structures 1421, 1422, 1423, and 1424 deployed on the printed circuit board 1410. According to an embodiment, the first antenna array 1420 of the antenna module 1400 may include the antenna structures 1421, 1422, 1423, and 1424 having a 1×4 array structure, but it is not limited thereto. For example, the antenna module 1400 may include an antenna array having various numbers of antenna structures and arrays.

According to various embodiments, the printed circuit board 1410 may include a first surface 1411 and a second surface 1412 directed in an opposite direction to the first surface 1411. According to an embodiment, the antenna array 1420 may include a first antenna structure 1421 successively deployed in line with the printed circuit board 1410 and including a first conductive layer 1421*a* and a second conductive layer 1421*b*, a second antenna structure 1422 including a third conductive layer 1422*a* and a fourth conductive layer 1422*b*, a third antenna structure 1423 including a fifth conductive layer 1423*a* and a sixth conductive layer 1423*b*, and/or a fourth antenna structure 1424 including a seventh conductive layer 1424*a* and an eighth conductive layer 1424*b*. According to an embodiment, the first antenna structure 1421, the second antenna structure 1422, the third antenna structure 1423, and the fourth antenna structure 1424 may have substantially the same configuration as the configuration of at least one of the above-described antenna structure R1 of FIG. 5A, the antenna structure R2 of FIG. 8A, the antenna structure R3 of FIG. 10A, or the antenna structure R4 or R5 of FIG. 12A. According to an embodiment, the antenna module 1400 may include a wireless communication circuitry 1430 deployed on the second surface 1412 of the printed circuit board 1410 and electrically connected to the antenna array 1420. As another embodiment, the wireless communication circuitry 1430 may be deployed in a location spaced apart from the printed circuit board 1410 through a conductive cable (e.g., flexible printed circuit board (FPCB)). According to an embodiment, the wireless communication circuitry 1430 may be configured to transmit and/or receive a signal having a frequency in the range of 3 GHz to 100 GHz through the first antenna array 1420.

According to the antenna module 1400 according to various embodiments, the direction of a beam pattern of the antenna array 1420 may be adjusted through a phase shifter deployed on an RF chain to which the respective antenna structures and the wireless communication circuitry are electrically connected to each other to have a specific phase, or a beam coverage having a specific scanning range may be secured.

Figure 15:
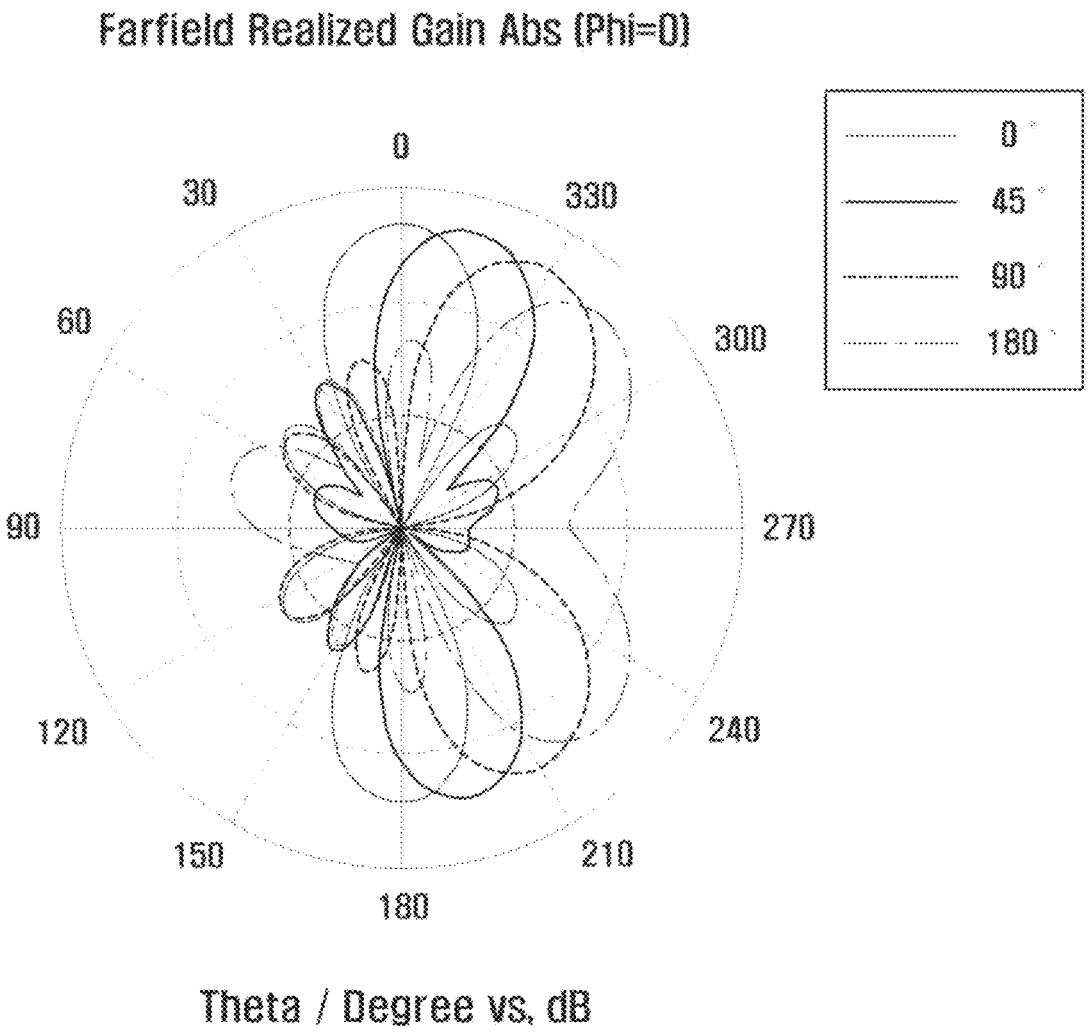
FIG. 15 is a diagram illustrating a radiation pattern of an antenna module of FIG. 14 according to an embodiment of the disclosure.
Figure 16A:
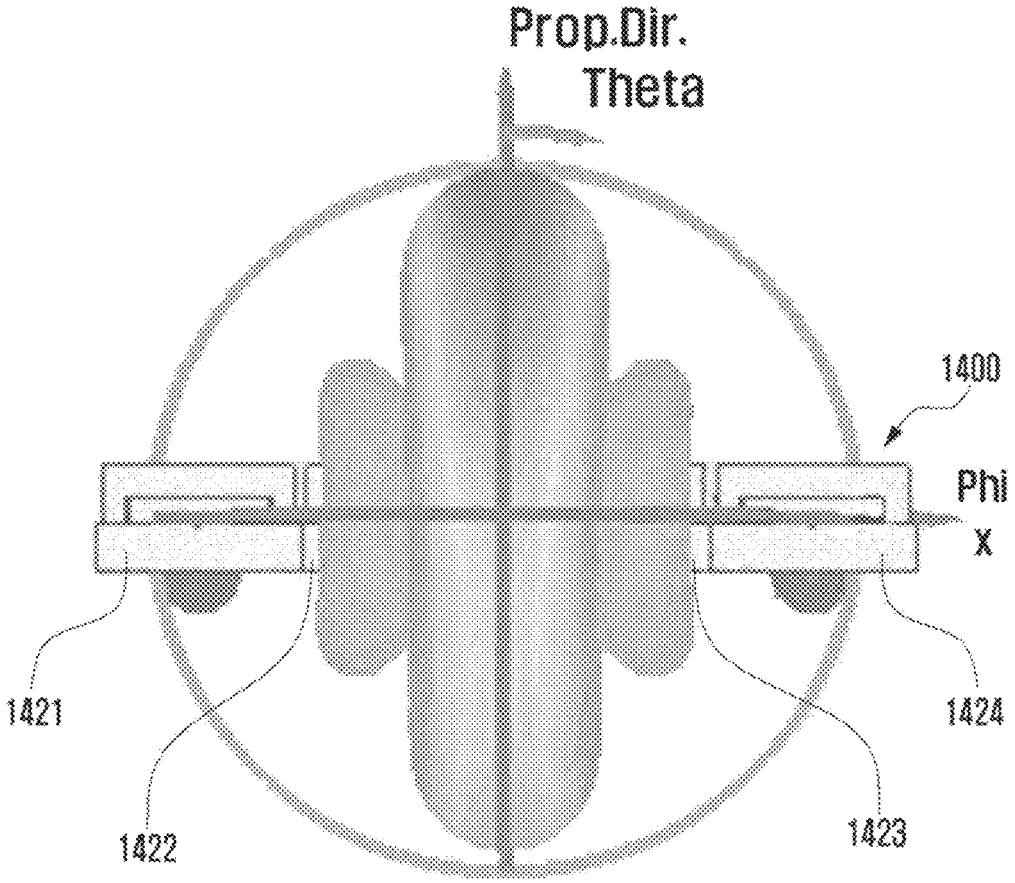
FIG. 16A is a diagram illustrating beam scanning performances in accordance with phase differences of an antenna module of FIG. 14 according to an embodiment of the disclosure.
Figure 16B:
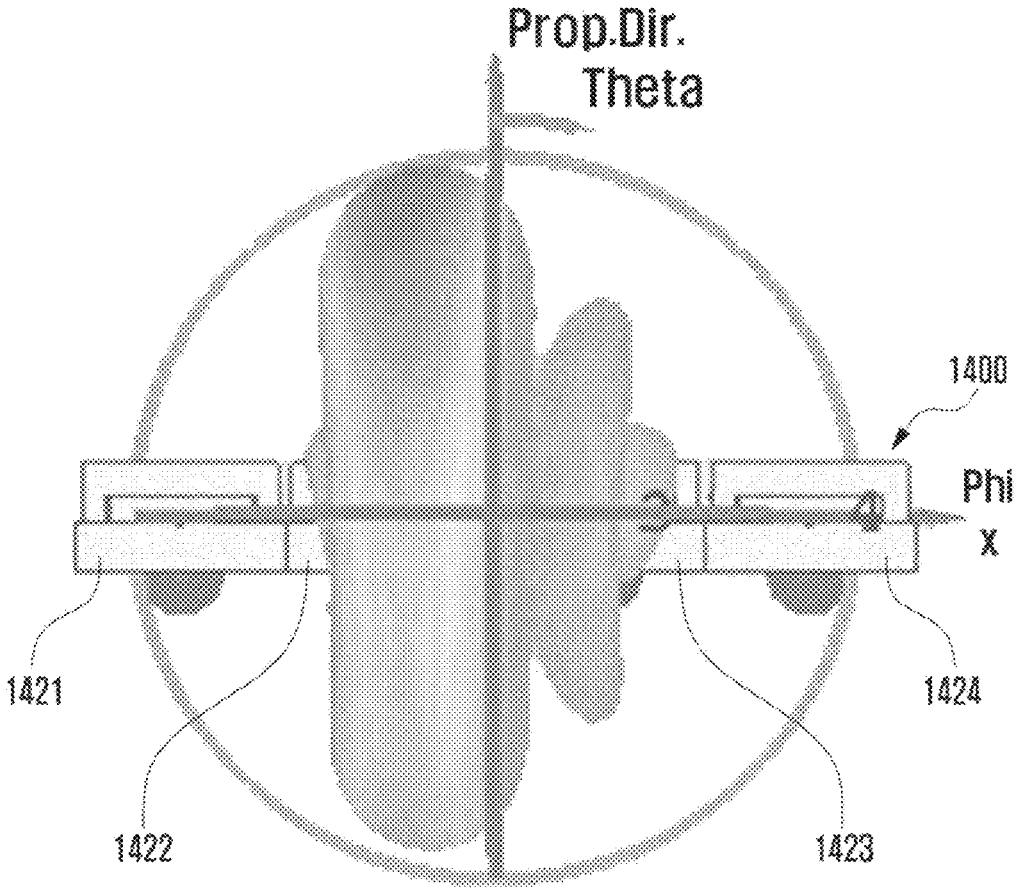
FIG. 16B is a diagram illustrating beam scanning performances in accordance with phase differences of an antenna module of FIG. 14 according to an embodiment of the disclosure.
Figure 16C:
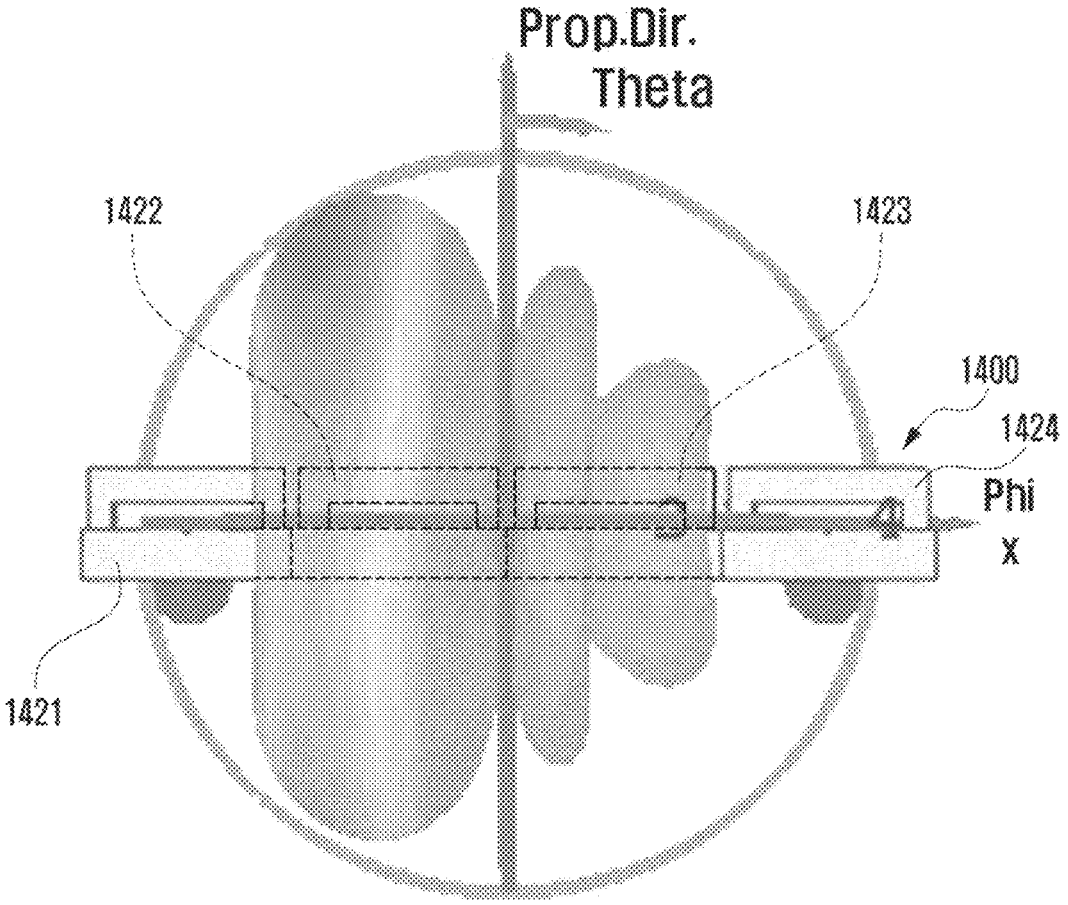
FIG. 16C is a diagram illustrating beam scanning performances in accordance with phase differences of an antenna module of FIG. 14 according to an embodiment of the disclosure.
Figure 16D:
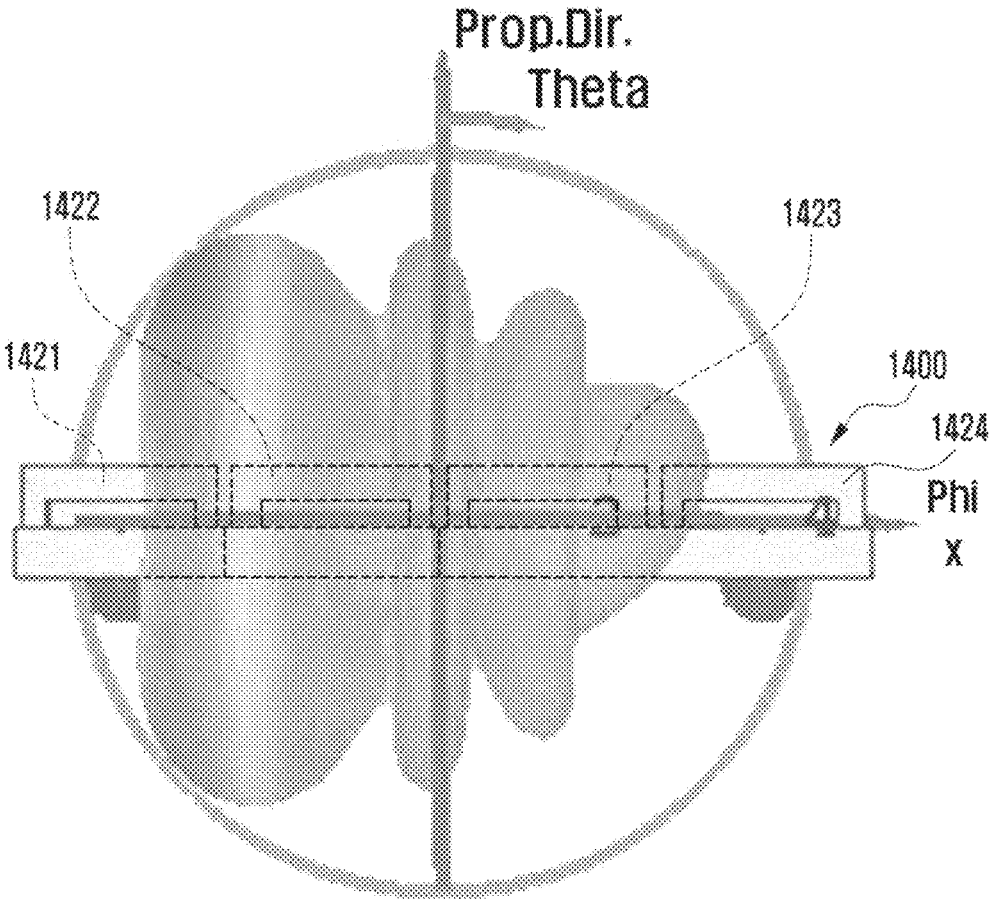
FIG. 16D is a diagram illustrating beam scanning performances in accordance with phase differences of an antenna module of FIG. 14 according to an embodiment of the disclosure.

FIG. 15 is a diagram illustrating a radiation pattern of an antenna module of FIG. 14 according to an embodiment of the disclosure. The antenna module may be antenna module 1400.

FIGS. 16A to 16D are diagrams illustrating beam scanning performances in accordance with phase differences of an antenna module of FIG. 14 according to various embodiments of the disclosure. The antenna module may be antenna module 1400.

Referring to FIGS. 15 and 16A to 16D, if phases are successively input in the unit of 45° using a phase shifter (e.g., 3-bit phase shifter) in the 28 GHz frequency band, the direction of the beam pattern is gradually changed, and based on this, beam scanning of ±30° (total coverage of 60°) becomes possible.

Figure 17:
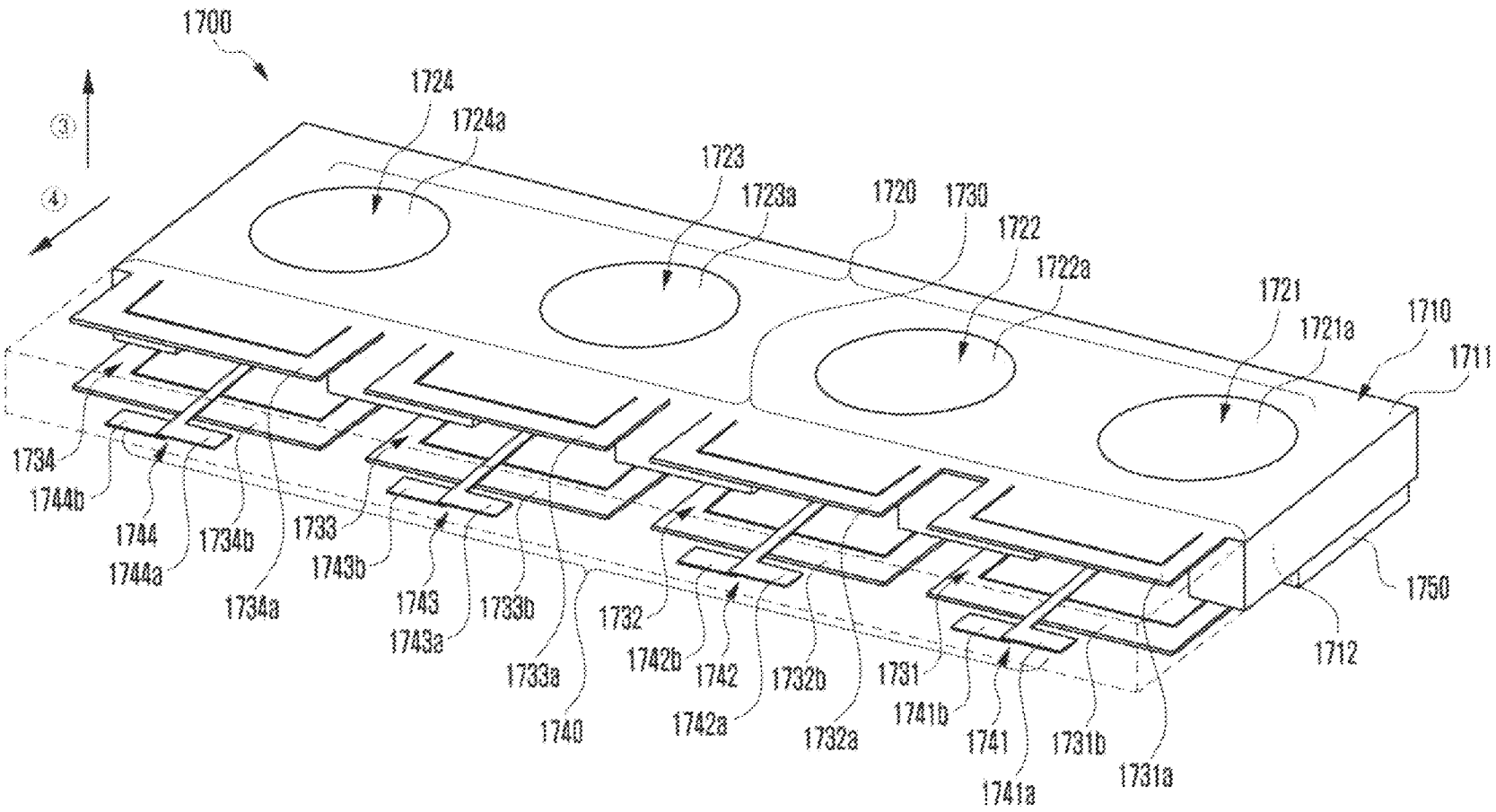
FIG. 17 is a perspective view of an antenna module according to an embodiment of the disclosure.

FIG. 17 is a perspective view of an antenna module according to an embodiment of the disclosure.

An antenna module 1700 of FIG. 17 may be at least partly similar to the third antenna module 246 of FIG. 2, or it may further include other embodiments of the antenna module.

Referring to FIG. 17, the antenna module 1700 may include a printed circuit board 1710, and a plurality of antenna arrays 1720, 1730, and 1740 deployed on the printed circuit board 1710. According to an embodiment, the printed circuit board 1710 may include a first surface 1711 and a second surface 1712 directed in an opposite direction to the first surface 1711. According to an embodiment, the antenna module 1700 may include a first antenna array 1720 including a plurality of antennas 1721, 1722, 1723, and 1724 successively deployed at predetermined intervals on the first surface 1711 of the printed circuit board 1710, a second antenna array 1730 including a plurality of first antenna structures 1731, 1732, 1733, and 1734 deployed in an edge region of the printed circuit board 1710, and/or a third antenna array 1740 including a plurality of second antenna structures 1741, 1742, 1743, and 1744 deployed in locations corresponding to the plurality of first antenna structures 1731, 1732, 1733, and 1734. According to the antenna module 1700 according to an embodiment, the plurality of antennas 1721, 1722, 1723, and 1724 of the first antenna array 1720, the plurality of first antenna structures 1731, 1732, 1733, and 1734 of the second antenna array 1730, and the second antenna structures 1741, 1742, 1743, and 1744 of the third antenna array 1740 are deployed on the printed circuit board 1710 to have a 1×4 array structure, but antenna module 1700 is not limited thereto. For example, the antenna module 1700 may include various numbers of antennas, antenna structures, and antenna arrays having various arrays.

According to the first antenna array 1720 according to various embodiments, the first antenna including a first conductive patch 1721*a*, the second antenna 1722 including a second conductive patch 1722*a*, the third antenna 1723 including a third conductive patch 1723*a*, and/or the fourth antenna 1724 including a fourth conductive patch 1724*a* may be deployed on the first surface 1711 of the printed circuit board 1710. According to the first antenna array 1720 according to various embodiments, a beam pattern may be formed in a third direction (e.g., ③ direction of FIG. 17) to which the first surface 1711 of the printed circuit board 1710 is directed. According to an embodiment, the third direction (e.g., ③ direction of FIG. 17) may include a direction to which a rear plate (e.g., rear plate 311 of FIG. 3B) of the electronic device (e.g., mobile electronic device 300 of FIG. 2B) is directed.

According to various embodiments, the second antenna array 1730 may include the first antenna structure 1731 including a first conductive layer 1731*a* and a second conductive layer 1731*b* deployed in an one-side edge region of the printed circuit board 1710, the second antenna structure 1732 including a third conductive layer 1732*a* and a fourth conductive layer 1732*b*, the third antenna structure 1733 including a fifth conductive layer 1733*a* and a sixth conductive layer 1733*b*, and/or the fourth antenna structure 1734 including a seventh conductive layer 1734*a* and an eighth conductive layer 1734*b*. According to an embodiment, the first antenna structure 1731, the second antenna structure 1732, the third antenna structure 1733, and the fourth antenna structure 1734 may be deployed as a structure at least partly similar to the structure of at least one of the above-described antenna structure R1 of FIG. 5A, the antenna structure R2 of FIG. 8A, the antenna structure R3 of FIG. 10A, or the first antenna structure R4 of FIG. 12A.

According to various embodiments, the third antenna array 1740 may include the fifth antenna structure 1741 deployed between a pair of conductive layers and including a first conductive pattern 1741*a* and a second conductive pattern 1741*b*, the sixth antenna structure 1742 including a third conductive pattern 1742*a* and a fourth conductive pattern 1742*b*, the seventh antenna structure 1743 including a fifth conductive pattern 1743*a* and a sixth conductive pattern 1743*b*, and/or the eighth antenna structure 1744 including a seventh conductive pattern 1744*a* and an eighth conductive pattern 1744*b*. According to an embodiment, the fifth antenna structure 1741, the sixth antenna structure 1742, the seventh antenna structure 1743, and/or the eighth antenna structure 1744 may be deployed as a structure at least partly similar to the above-described second antenna structure R5 of FIG. 12A.

According to various embodiments, the second antenna array 1730 may operate as a vertical polarization antenna (e.g., patch antenna) for forming a beam pattern in a fourth direction (e.g., direction of FIG. 17) that is vertical to a third direction. The third antenna array 1740 may operate as a horizontal polarization antenna (e.g., dipole antenna) for forming a beam pattern in the fourth direction (e.g., ④ direction of FIG. 17). Accordingly, the second antenna array 1730 and the third antenna array 1740 may operate as a dual-polarization antenna for forming a beam pattern in the same direction. According to an embodiment, the fourth direction (e.g., ④ direction of FIG. 17) may include a direction to which the side surface (e.g., side surface 310E of FIG. 3B) of the electronic device (e.g., mobile electronic device 300 of FIG. 3B) is directed.

According to various embodiments, the antenna module 1700 may include a wireless communication circuitry 1750 deployed on the second surface 1712 of the printed circuit board 1710 and electrically connected to the first antenna array 1720, the second antenna array 1730, and the third antenna array 1740. As another embodiment, the wireless communication circuitry 1750 may be deployed in a location spaced apart from the printed circuit board 1710 through a conductive cable (e.g., flexible printed circuit board (FPCB)). According to an embodiment, the wireless communication circuitry 1750 may be configured to transmit and/or receive a signal having a frequency in the range of 3 GHz to 100 GHz through the first antenna array 1720, the second antenna array 1730, and the third antenna array 1740.

According to the antenna module 1700 according to various embodiments, the direction of the beam pattern of the antenna arrays 1720, 1730, and 1740 may be adjusted through a phase shifter deployed on an RF chain to which the antenna arrays 1720, 1730, and 1740 and the wireless communication circuitry 1750 are electrically connected to have a specific phase, or a beam coverage having a specific scanning range can be secured.

Because the antenna module (e.g., antenna module 800 of FIG. 8A) according to various embodiments includes U-shaped slots (e.g., first U-shaped slot 521 and second U-shaped slot 531 of FIG. 8A) respectively deployed to face a pair of conductive layers spaced apart from each other (e.g., first conductive layer 520 and second conductive layer 530 of FIG. 8A), the first frequency band (e.g., low band) can be shifted while the change width in the second frequency band (e.g., high band) is maintained to be small. Further, because another conductive layer (e.g., third conductive layer 560 of FIG. 8A) (e.g., conductive stub) is provided to be deployed between a pair of conductive layers (e.g., first conductive layer 520 and second conductive layer 530 of FIG. 8A), the change width of the first frequency band (e.g., low band) is maintained to be small, and the bandwidth of the second frequency band (e.g., high band) can be extended.

Figure 18A:
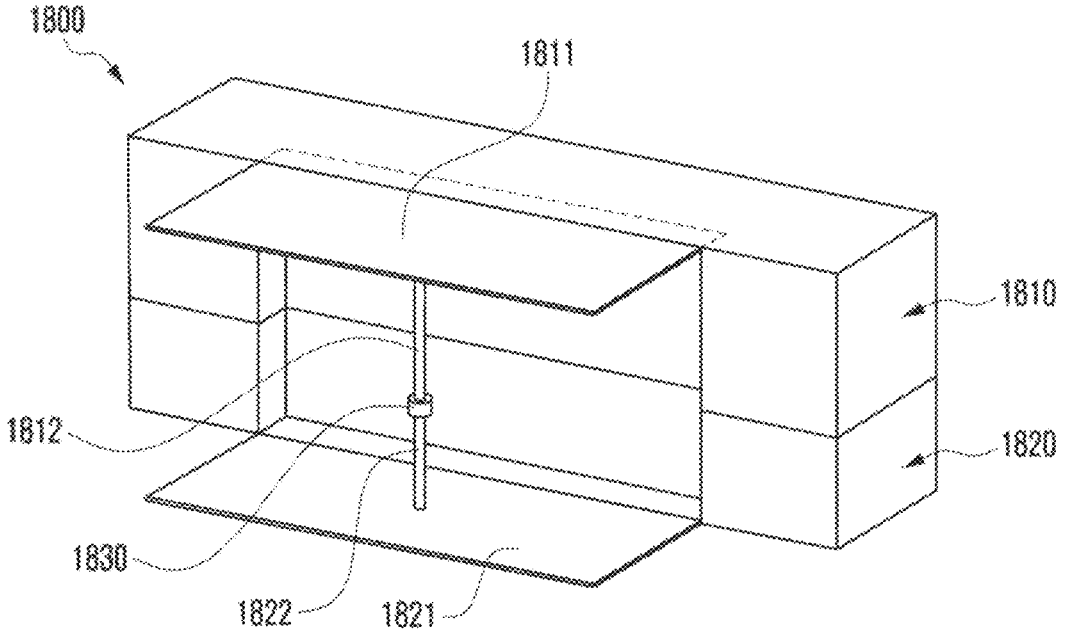
FIG. 18A is a perspective view of an antenna module having a dual-board laminated structure according to an embodiment of the disclosure.
Figure 18B:
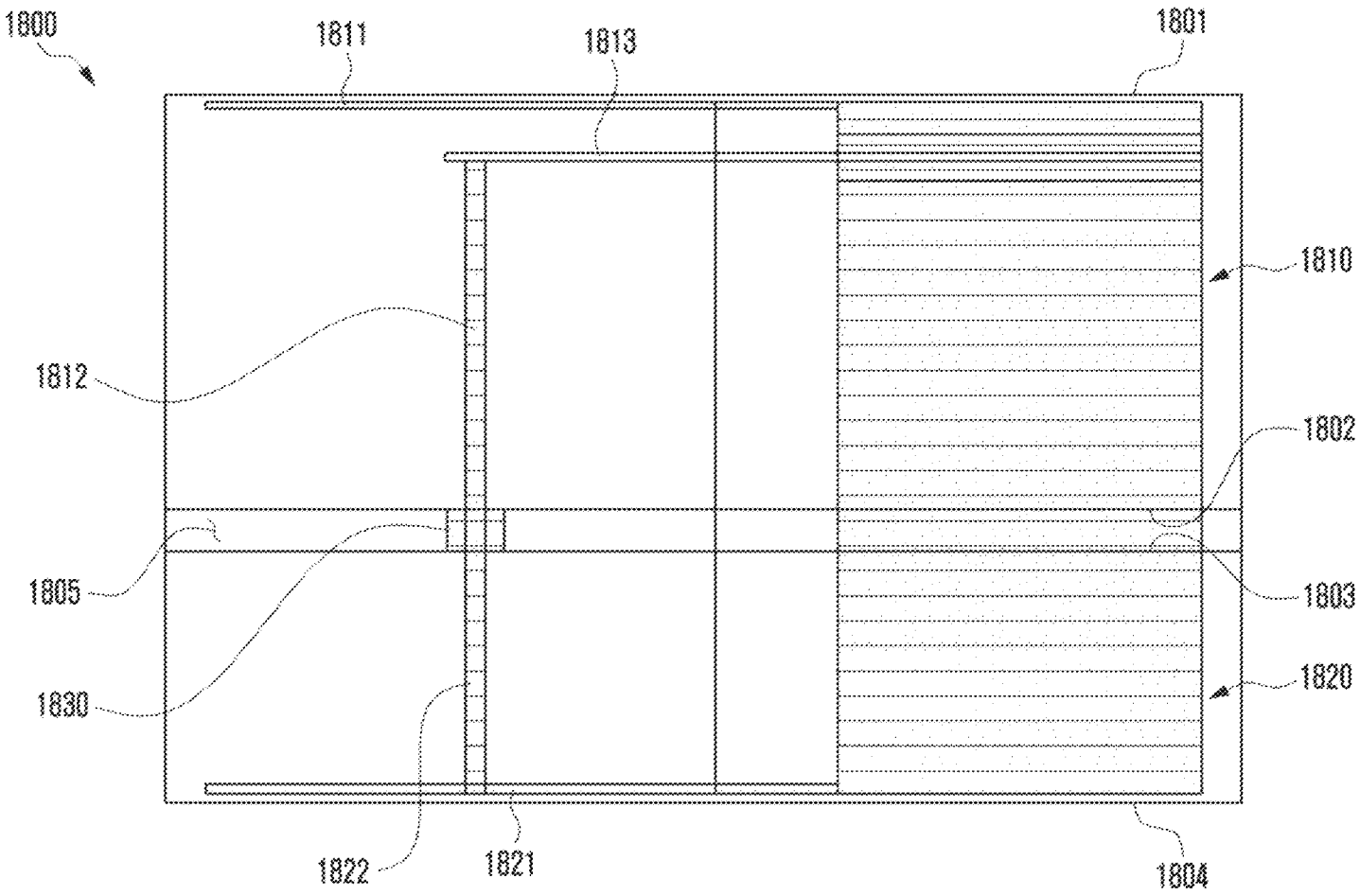
FIG. 18B is a cross-sectional view of an antenna module having a dual-board laminated structure according to an embodiment of the disclosure.

FIGS. 18A and 18B are a perspective view and a cross-sectional view of an antenna module 1800 having a dual-board laminated structure according to various embodiments of the disclosure.

Referring to FIGS. 18A and 18B, an antenna module using a conductive patch according to an embodiment of the disclosure may be formed through lamination of two printed circuit board. The antenna module may be antenna module 1800.

The antenna module 1800 of FIG. 18A may be at least partly similar to the third antenna module 246 of FIG. 2, or it may further include other embodiments of the antenna module.

According to various embodiments, the antenna module 1800 may include a first printed circuit board 1810 and a second printed circuit board 1820 deployed to be at least partly laminated on the first printed circuit board 1810. According to an embodiment, the first printed circuit board 1810 may include a first surface 1801 and a second surface 1802 directed in an opposite direction to the first surface 1801. According to an embodiment, the second printed circuit board 1820 may include a third surface 1803 facing the second surface 1802 and a fourth surface 1804 directed in an opposite direction to the third surface 1803. According to an embodiment, the first printed circuit board 1810 may be exposed to the first surface 1801, or it may include a first conductive layer 1811 deployed in a location that is close to the first surface 1801 rather than the second surface 1802 inside the first printed circuit board 1810. According to an embodiment, the second printed circuit board 1820 may include a second conductive layer 1821 deployed corresponding to the first conductive layer 1811 and exposed to the fourth surface 1804, or deployed in a location that is close to the fourth surface 1804 rather than the third surface 1803 inside the second printed circuit board 1820.

According to various embodiments, the first printed circuit board 1810 may include a conductive line 1813 deployed between the first conductive layer 1811 and the second surface 1802, and electrically connected to the wireless communication circuitry (e.g., wireless communication module 192 of FIG. 2) with a predetermined length. According to an embodiment, at least a part of the conductive line 1813 may be deployed in a location that overlaps the first conductive layer 1811. According to an embodiment, the first printed circuit board 1810 may include a first feeding part 1812 electrically connected to the conductive line 1813 and extending up to the second surface 1802 of the first printed circuit board 1810. According to an embodiment, the first feeding part 1812 may include a conductive via vertically penetrating the first printed circuit board 1810. According to an embodiment, the second printed circuit board 1820 may include a second feeding part 1822 electrically connected to the second conductive layer 1821 and formed to extend up to the third surface 1803 to face the first feeding part 1812. According to an embodiment, the first feeding part 1812 may be deployed to be exposed to the second surface 1802. According to an embodiment, the second feeding part 1822 may be deployed to be exposed to the third surface 1803. For example, if the first printed circuit board 1810 and the second printed circuit board 1820 overlap each other, the first feeding part 1812 and the second feeding part 1822 may be electrically connected to each other through a soldering portion 1830 or conductive bonding portion. Accordingly, the antenna module 1800 may operate as a pair of conductive patches in which the first conductive layer 1811 of the first printed circuit board 1810 and the second conductive layer 1821 of the second printed circuit board 1820 are deployed spaced apart from each other, and the first feeding part 1812 and the second feeding part 1822 may operate as one feeding part. According to the antenna module 1800 according to an embodiment, a space 1805 in which the second surface 1802 of the first printed circuit board 1810 and the third surface 1803 of the second printed circuit board 1820 face each other is maintained in a vacuum state, and thus the second surface 1802 and the third surface 1803 may be attached to each other through a conductive bonding process. According to an embodiment, the first printed circuit board 1810 and the second printed circuit board 1820 may be bonded together through an anisotropic conductive film (ACF).

Figure 19:
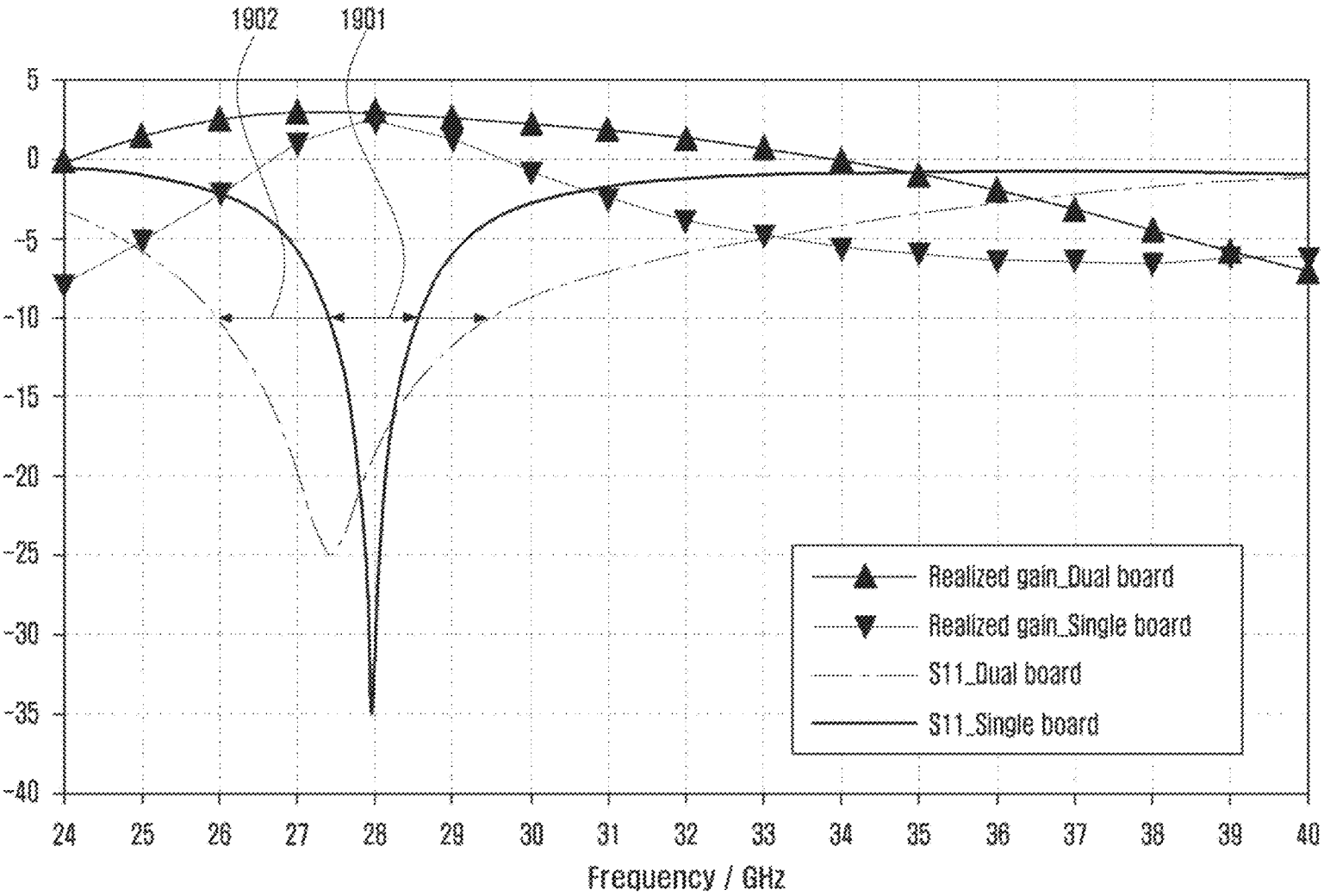
FIG. 19 is a graph illustrating a gain and a reflection coefficient of an antenna module of FIG. 18A according to an embodiment of the disclosure.

FIG. 19 is a graph illustrating a gain and a reflection coefficient of an antenna module of FIG. 18A according to an embodiment of the disclosure in order to compare the radiation performance of an antenna module having a dual-board structure with that configured in a single board (e.g., signal printed circuit board).

Referring to FIG. 19, the antenna module (e.g., antenna module 1800 of FIG. 18A) having a dual-board structure of FIG. 18A represents a higher gain than the gain of the antenna module implemented on the single board, and it secures a relatively wide bandwidth. For example, the antenna module implemented on the single board secures a bandwidth of about 1 GHz in the range of 27.5 GHz to 28.5 GHz (section 1901) based on −10 dB, whereas the antenna module having the dual-board structure can secure a relatively wider bandwidth of about 3.5 GHz in the range of 26 GHz to 29.5 GHz (section 1902).

The antenna according to various embodiments of the disclosure may be configured to operate in dual-band of the first frequency band (e.g., low band) and the second frequency band (e.g., high band) through slots formed on a pair of conductive layers, and thus the bandwidth of the second frequency band (e.g., high band) can be extended using another conductive layer (e.g., plate type stub) deployed between the conductive layers.

According to various embodiments, an electronic device (e.g., mobile electronic device 300 of FIG. 3A) may include a housing including a first plate (e.g., front plate 302 of FIG. 3A), a second plate (e.g., rear plate 311 of FIG. 3B) directed in an opposite direction to the first plate, and a side member (e.g., side bezel structure 318 of FIG. 3A) surrounding a space between the first plate and the second plate and being combined with or being integrally formed with the second plate; a display (e.g., display 301 of FIG. 3A) configured to be seen through at least a part of the first plate; an antenna structure (e.g., antenna structure R1 of FIG. 5B) arranged inside the housing, the antenna structure including a first conductive layer (e.g., first conductive layer 520 of FIG. 5B) including a first region (e.g., first region A1 of FIG. 5B) including a first U-shaped slot (e.g., first U-shaped slot 521 of FIG. 5B) and a second region (e.g., second region A2 of FIG. 5B) coming in contact with the first region, and a second conductive layer (e.g., second conductive layer 530 of FIG. 5B) facing the first conductive layer to be spaced apart from the first conductive layer, and including a third region (e.g., third region A3 of FIG. 5B) including a second U-shaped slot (e.g., second U-shaped slot 531 of FIG. 5B) facing the first U-shaped slot and a fourth region (e.g., fourth region A4 of FIG. 5B) coming in contact with the third region and facing the second region; and at least one wireless communication circuitry (e.g., wireless communication circuitry 590 of FIG. 5B) electrically connected to the first conductive layer or the second conductive layer and configured to transmit and/or receive a signal having a frequency in the range of 3 GHz to 100 GHz.

According to various embodiments, the antenna structure may be configured so that the first frequency band (e.g., low band) is determined in accordance with sizes of the first U-shaped slot of the first conductive layer and the second U-shaped slot of the second conductive layer.

According to various embodiments, the antenna structure may include a first dielectric material (e.g., first dielectric material 541 of FIG. 5B) filling a first space (i.e., first space 5411 of FIG. 5B) between the first region of the first conductive layer and the third region of the second conductive layer, and a second dielectric material (e.g., second dielectric material 542 of FIG. 5B) filling a second space (e.g., second space 5421 of FIG. 5B) between the second region of the first conductive layer and the fourth region of the second conductive layer.

According to various embodiments, the antenna structure may further include a third conductive layer (e.g., third conductive layer 560 of FIG. 8A) deployed substantially in parallel to the first conductive layer in at least the second dielectric material and having an area that is smaller than an area of the first conductive layer as seen from an upside of the first conductive layer.

According to various embodiments, the third conductive layer may include a first edge (e.g., first edge 561 of FIG. 8A) extending along a second direction (e.g., second direction (② direction) of FIG. 8A) that is vertical to a first direction (first direction (① direction) directed from the first space toward the second space as seen from the upside of the first conductive layer, and the first edge may include a recess (e.g., recess 562 of FIG. 8A) formed in the first direction.

According to various embodiments, the antenna structure may be configured so that a bandwidth of a second frequency band (e.g., high band) is determined in accordance with a width of the recess formed along the first direction and/or a depth of the recess formed along the second direction.

According to various embodiments, the antenna structure (e.g., antenna structure R2 of FIG. 8A) may include an electrical path (e.g., first feeding line 550 of FIG. 8B) extending between the second conductive layer and the third conductive layer, at least partly overlapping the third conductive layer as seen from the upside of the first conductive layer, and electrically connecting the second conductive layer and the wireless communication circuitry to each other.

According to various embodiments, the third conductive layer may be deployed in a location in which the third conductive layer can be coupled to the electrical path.

According to various embodiments, the electrical path may include a first feeding line (e.g., first feeding line 550 of FIG. 8B) extending in the second space or extending from the second space to at least a part of the third space between the second conductive layer and the third conductive layer, a first feeding part (e.g., first feeding part 551 of FIG. 8B) deployed at one end of the first feeding line and electrically connected to the second conductive layer, and a first feeder (e.g., first feeder 552 of FIG. 8B) electrically connected to the wireless communication circuit from the other end of the first feeding line.

According to various embodiments, the first feeding line may be deployed to cross a center of the third conductive layer as seen from the upside of the first conductive layer.

According to various embodiments, the antenna structure may further include a fourth conductive layer (e.g., fourth conductive layer 570 of FIG. 10B) deployed substantially in parallel to the first conductive layer in at least the second dielectric material, deployed in line with the third conductive layer with a smaller area than an area of the first conductive layer, and having the same shape as a shape of the third conductive layer.

According to various embodiments, the antenna structure may include a plurality of insulating layers, and the third conductive layer and the fourth conductive layer may be deployed on the different insulating layers.

According to various embodiments, the antenna structure (e.g., antenna structure R3 of FIG. 10B) may include a first electrical path (e.g., first feeding line 550 of FIG. 10B) extending between the second conductive layer and the third conductive layer, at least partly overlapping the third conductive layer as seen from the upside of the first conductive layer, and electrically connecting the second conductive layer and the wireless communication circuitry to each other, and a second electrical path (e.g., second feeding line 553 of FIG. 10B) extending between the first electrical path and the fourth conductive layer, at least partly overlapping the fourth conductive layer as seen from the upside of the first conductive layer, and electrically connecting the first conductive layer and the wireless communication circuitry to each other.

According to various embodiments, the electronic device may further include a printed circuit board (e.g., printed circuit board 510 of FIG. 5B) including a plurality of insulating layers, wherein the first conductive layer is deployed on a first layer among the insulating layers, and the second conductive layer is deployed on a second layer that is spaced apart from the first layer among the insulating layers.

According to various embodiments, the second space may be electrically connected to the first conductive layer to the second conductive layer through the plurality of insulating layers, and is formed through a plurality of conductive vias (e.g., electrical connection member 543 of FIG. 5B) deployed at predetermined intervals.

According to various embodiments, the wireless communication circuitry may be deployed on the printed circuit board, or may be deployed spaced apart from the printed circuit board through a conductive cable.

According to various embodiments, the electronic device may further include an additional antenna structure (e.g., second antenna structure R5 of FIG. 12B) extending from a first space between the first region and the third region to at least a part of a second space between the second region and the fourth region, and having a beam pattern formed thereon in the same direction as the antenna structure.

According to various embodiments, the additional antenna structure (e.g., second antenna structure R5 of FIG. 12B) may include a first conductive pattern (first conductive line 5811 of FIG. 12B) deployed from the second space to at least a partial region of the first space by a first conductive line (e.g., first conductive line 5811 of FIG. 12B), and electrically connected to the wireless communication circuitry, and a second conductive pattern (e.g., second conductive pattern 582 of FIG. 12B) deployed from the second space to at least the partial region of the first space by a second conductive line (e.g., second conductive line 5821 of FIG. 12B) deployed spaced apart from the first conductive line on an insulating layer that is not equal to the first conductive pattern.

According to various embodiments, the antenna structure may include an electrical path extending between the second conductive layer and the third conductive layer, at least partly overlapping the third conductive layer as seen from an upside of the first conductive layer, and electrically connecting the second conductive layer and the wireless communication circuitry to each other, and the electrical path is deployed in a location that does not overlap the first conductive line and/or the second conductive line as seen from the upside of the first conductive layer.

According to various embodiments, the wireless communication circuitry may be configured to transmit and/or receive the signal having the frequency in the range of 3 GHz to 100 GHz through the additional antenna structure.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including a first plate, a second plate directed in an opposite direction to the first plate, and a side member surrounding a space between the first plate and the second plate and being combined with or being integrally formed with the second plate;

a display configured to be seen through at least a part of the first plate;

an antenna structure arranged inside the housing, the antenna structure including:

a first conductive layer including a first region including a first U-shaped slot and a second region coming in contact with the first region; and a second conductive layer facing the first conductive layer to be spaced apart from the first conductive layer, and including a third region including a second U-shaped slot facing the first U-shaped slot and a fourth region coming in contact with the third region and facing the second region; and at least one wireless communication circuitry electrically connected to the first conductive layer or the second conductive layer and configured to transmit and/or receive a signal having a frequency in a range of 3 GHz to 100 GHz.

2. The electronic device of claim 1, wherein the antenna structure is configured so that a first frequency band is determined in accordance with sizes of the first U-shaped slot of the first conductive layer and the second U-shaped slot of the second conductive layer.

3. The electronic device of claim 2, wherein the first frequency band comprises a frequency band in a range of about 24 GHz to 34 GHz.

4. The electronic device of claim 1, wherein the antenna structure comprises:

a first dielectric material filling a first space between the first region of the first conductive layer and the third region of the second conductive layer; and a second dielectric material filling a second space between the second region of the first conductive layer and the fourth region of the second conductive layer.

5. The electronic device of claim 4, wherein the antenna structure further comprises a third conductive layer deployed substantially in parallel to the first conductive layer in at least the second dielectric material and having an area that is smaller than an area of the first conductive layer as seen from an upside of the first conductive layer.

6. The electronic device of claim 5, wherein the third conductive layer comprises a first edge extending along a second direction that is vertical to a first direction directed from the first space toward the second space as seen from the upside of the first conductive layer, and the first edge includes a recess formed in the first direction.

7. The electronic device of claim 6, wherein the antenna structure is configured so that a bandwidth of a second frequency band is determined in accordance with a width of the recess formed along the first direction and/or a depth of the recess formed along the second direction.

8. The electronic device of claim 7, wherein the second frequency band comprises a frequency band in a range of about 37 GHz to 44 GHz.

9. The electronic device of claim 5, wherein the antenna structure comprises an electrical path extending between the second conductive layer and the third conductive layer, at least partly overlapping the third conductive layer as seen from the upside of the first conductive layer, and electrically connecting the second conductive layer and the at least one wireless communication circuitry to each other.

10. The electronic device of claim 9, wherein the third conductive layer is deployed in a location in which the third conductive layer can be coupled to the electrical path.

11. The electronic device of claim 9, wherein the electrical path comprises:

a first feeding line extending in the second space or extending from the second space to at least a part of a third space between the second conductive layer and the third conductive layer;

a first feeding part deployed at one end of the first feeding line and electrically connected to the second conductive layer; and a first feeder electrically connected to the at least one wireless communication circuitry from another end of the first feeding line.

12. The electronic device of claim 11, wherein the first feeding line is deployed to cross a center of the third conductive layer as seen from the upside of the first conductive layer.

13. The electronic device of claim 5, wherein the antenna structure further comprises a fourth conductive layer deployed substantially in parallel to the first conductive layer in at least the second dielectric material, deployed in line with the third conductive layer with a smaller area than an area of the first conductive layer as seen from the upside of the first conductive layer, and having the same shape as a shape of the third conductive layer.

14. The electronic device of claim 13, wherein the antenna structure comprises a plurality of insulating layers, and wherein the third conductive layer and the fourth conductive layer are deployed on the different insulating layers.

15. The electronic device of claim 13, wherein the antenna structure comprises:

a first electrical path extending between the second conductive layer and the third conductive layer, at least partly overlapping the third conductive layer as seen from the upside of the first conductive layer, and electrically connecting the second conductive layer and the wireless communication circuitry to each other; and a second electrical path extending between the first electrical path and the fourth conductive layer, at least partly overlapping the fourth conductive layer as seen from the upside of the first conductive layer, and electrically connecting the first conductive layer and the wireless communication circuitry to each other.

16. The electronic device of claim 1, further comprising a printed circuit board including a plurality of insulating layers, wherein the first conductive layer is deployed on a first layer among the insulating layers, and wherein the second conductive layer is deployed on a second layer that is spaced apart from the first layer among the insulating layers.

17. The electronic device of claim 16, wherein the second space is electrically connected from the first conductive layer to the second conductive layer through the plurality of insulating layers, and is formed through a plurality of conductive vias deployed at predetermined intervals.

18. The electronic device of claim 16, wherein the wireless communication circuitry is deployed on the printed circuit board, or is deployed spaced apart from the printed circuit board through a conductive cable.

19. The electronic device of claim 1, further comprising an additional antenna structure extending from a first space between the first region and the third region to at least a part of a second space between the second region and the fourth region, and having a beam pattern formed thereon in the same direction as the antenna structure.

20. The electronic device of claim 19, wherein the additional antenna structure comprises:

a first conductive pattern deployed from the second space to at least a partial region of the first space by a first conductive line, and electrically connected to the wireless communication circuitry; and a second conductive pattern deployed from the second space to at least the partial region of the first space by a second conductive line deployed spaced apart from the first conductive line on an insulating layer that is not equal to the first conductive pattern.

* * * * *